US011798731B2

(12) United States Patent
Marathias et al.

(10) Patent No.: US 11,798,731 B2
(45) Date of Patent: Oct. 24, 2023

(54) INDUCTOR ASSEMBLIES AND METHODS FOR FORMING THE SAME

(71) Applicant: RAYCAP, S.A., Athens (GR)

(72) Inventors: Megaklis Marathias, Drama (GR); Elias Fermelis, Koropi (GR); Kostas Bakatsias, Athens (GR); George Peppas, Drama (GR); Achilleas Noutsos, Drama (GR); Zafiris G. Politis, St. Stefanos (GR)

(73) Assignee: RAYCAP, S.A., Athens (GR)

( * ) Notice: Subject to any disclaimer, the term of this patent is extended or adjusted under 35 U.S.C. 154(b) by 304 days.

(21) Appl. No.: 17/196,336

(22) Filed: Mar. 9, 2021

(65) Prior Publication Data

US 2021/0202158 A1 Jul. 1, 2021

Related U.S. Application Data

(63) Continuation of application No. 16/114,287, filed on Aug. 28, 2018, now Pat. No. 11,114,232.
(Continued)

(51) Int. Cl.
*H01F 27/29* (2006.01)
*H01F 27/28* (2006.01)
(Continued)

(52) U.S. Cl.
CPC ..... *H01F 27/29* (2013.01); *H01F 27/2847* (2013.01); *H01F 27/32* (2013.01);
(Continued)

(58) Field of Classification Search
CPC ..... H01F 27/29; H01F 27/2847; H01F 27/32; H01F 37/005; H01F 41/063; H01F 41/12;
(Continued)

(56) References Cited

U.S. PATENT DOCUMENTS 2,998,583 A 8/1961 Worcester
3,068,433 A 12/1962 Theodore et al.
(Continued)

FOREIGN PATENT DOCUMENTS

DE 2947801 A1 6/1980
DE 102015108969 A1 12/2016
(Continued)

OTHER PUBLICATIONS

"30kW Coupled Inductor, 112uH, 14kHz" Electronic Craftsmen, Retrieved from URL: https://www.ecraftsmen.com/portfolio/30kw-coupled-inductor-112uh-14khz (Retrieved on Jun. 13, 2019).
(Continued)

*Primary Examiner* — Tuyen T Nguyen
(74) *Attorney, Agent, or Firm* — Myers Bigel, P.A.

(57) ABSTRACT

A dual coil inductor assembly includes an inner coil assembly including an inner coil and first and second terminals, and an outer coil assembly including an outer coil and third and fourth terminals. The inner coil includes an inner metal foil, and an inner electrical insulator sheet spirally co-wound with the inner metal foil. The outer coil includes an outer metal foil, and an outer electrical insulator sheet spirally co-wound with the outer metal foil. The inner coil is disposed within an outer coil air core of the outer coil so that the outer coil circumferentially surrounds the inner coil. The first and second terminals are electrically connected to the inner metal foil at respective first and second locations spaced apart along the inner metal foil. The third and fourth terminals are electrically connected to the outer metal foil at respective third and fourth locations spaced apart along the outer metal foil.

31 Claims, 46 Drawing Sheets

Related U.S. Application Data

(60) Provisional application No. 62/988,122, filed on Mar. 11, 2020, provisional application No. 62/557,289, filed on Sep. 12, 2017.

(51) Int. Cl.
*H01F 37/00* (2006.01)
*H01F 41/063* (2016.01)
*H01F 27/32* (2006.01)
*H01F 41/12* (2006.01)

(52) U.S. Cl.
CPC ..... *H01F 37/005* (2013.01); *H01F 41/063* (2016.01); *H01F 41/12* (2013.01); *H01F 27/2852* (2013.01); *H01F 27/327* (2013.01); *H01F 2027/2857* (2013.01)

(58) Field of Classification Search
CPC ..... H01F 27/2852; H01F 27/327; H01F 2027/2857; H01F 27/323; H01F 41/061
See application file for complete search history.

(56) References Cited

U.S. PATENT DOCUMENTS

| | | | | |
|---|---|---|---|---|
| 3,086,184 | A | 4/1963 | Nichols | |
| 3,112,556 | A | 12/1963 | Albert | |
| 3,195,088 | A * | 7/1965 | Sandoz | H01F 27/2847 336/187 |
| 3,225,269 | A | 12/1965 | Worcester | |
| 3,247,476 | A | 4/1966 | Pintell | |
| 3,388,351 | A | 6/1968 | Sweetana, Jr. | |
| 3,633,272 | A | 1/1972 | Benke et al. | |
| 3,704,390 | A | 11/1972 | Grahame | |
| 4,327,311 | A | 4/1982 | Wroblewski | |
| 5,030,933 | A | 7/1991 | Ikeda | |
| 5,202,584 | A | 4/1993 | Burke et al. | |
| 8,614,617 | B2 | 12/2013 | Mitani et al. | |
| 2002/0067237 | A1 | 6/2002 | Nakata et al. | |
| 2002/0167069 | A1* | 11/2002 | Odendaal | H01F 27/027 257/532 |
| 2008/0070788 | A1 | 3/2008 | Kramer et al. | |
| 2008/0186122 | A1* | 8/2008 | Xu | H01F 27/2847 336/185 |
| 2012/0280776 | A1 | 11/2012 | Hashimoto et al. | |
| 2019/0080837 | A1 | 3/2019 | Kostakis et al. | |

FOREIGN PATENT DOCUMENTS

| | | | |
|---|---|---|---|
| EP | 2597656 | A1 | 5/2013 |
| EP | 3054465 | A1 | 8/2016 |
| GB | 806452 | A | 12/1958 |
| GB | 1203948 | A | 9/1970 |
| JP | H01179406 | A | 7/1989 |
| JP | 2001284133 | A | 10/2001 |
| JP | 2013131684 | A | 7/2013 |
| JP | 2014056970 | A | 3/2014 |

OTHER PUBLICATIONS

"70 uH 220 amp Chassis Mount" West Coast Magnetics, Retrieved from URL: https://wcmagnetics.com/product/70-uh-220-amp-chassis-mount/ (Retrieved on Jun. 13, 2019).
"Air Core Smoothing Reactors" Hilkar, Retrieved from URL: http://www.hilkar.com/aircoresmoothingreactors.html (Retrieved on Jun. 13, 2019).
"Chokes and Inductors" Sonal Transformer, Retrieved from URL: http://www.sonaltransformer.com/chokes-and-inductors.html (Retrieved on Jun. 13, 2019).
"Custom made wound components" ELMA TT, Retrieved from URL: http://www.elmatt.si/leaflets/03%20Custom%20made%20wound%20components.pdf (Retrieved on Jun. 13, 2019).
"DC Inductors, Chokes & AC Reactors" Electronic Craftsmen, Retrieved from URL: https://www.ecraftsmen.com/dc-inductors-chokes-ac-reactors (Retrieved on Jun. 13, 2019).
"Industrial Chokes/Reactors" Unitech, Retrieved from URL: http://www.unitechtransformers.com/industrial-chokes-reactors.htm (Retrieved on Jun. 13, 2019).
"Input Line Choke, 220 V/380 V/415 V" IndiaMART, Retrieved from URL: https://www.indiamart.com/proddetail/input-line-choke-13481164262.html (Retrieved on Jun. 13, 2019).
"Power Inductors" Falco Electronics, Retrieved from URL: http://www.falco.com/Prods/PI.aspx (Retrieved on Jun. 13, 2019).
"TDCK Series DC Choke, DC Reactor for VFD" Thinkvert, Retrieved from URL: http://thinkvert.com/product-details/tdck-series-dc-choke-dc-reactor-for-vfd/ (Retrieved on Jun. 13, 2019).
"Very High Current Power Inductor 450 Amperes Rating Shoebox Series" Coil Winding Specialist, Inc., Retrieved from URL: http://www.coilws.com/index.php?main_page=index&cPath=208_212_366 (Retrieved on Jun. 13, 2019).
International Search Report and the Written Opinion of the International Searching Authority corresponding to International Patent Application No. PCT/EP2021/055955 (19 pages) (dated Jun. 24, 2021).

* cited by examiner

INDUCTOR ASSEMBLIES AND METHODS FOR FORMING THE SAME

RELATED APPLICATIONS

The present application claims the benefit of and priority from U.S. Provisional Patent Application No. 62/988,122, filed Mar. 11, 2020, and is a continuation application of and claims priority from U.S. patent application Ser. No. 16/114,287, filed Aug. 28, 2018, which claims the benefit of and priority from U.S. Provisional Patent Application No. 62/557,289, filed Sep. 12, 2017, the disclosures of which are incorporated herein by reference.

FIELD

The present invention relates to inductor assemblies and, more particularly, to inductor assemblies including inductor coils and methods for making the same.

BACKGROUND

Inductors coils are used in the AC power networks for power factor correction, voltage regulation, reduction of di/dt, and protection of downstream equipment.

SUMMARY

According to embodiments of the invention, an inductor assembly includes a coil including a spirally wound metal foil.

In some embodiments, the coil has a longitudinal coil axis and a radial coil thickness, the metal foil has a foil width extending substantially parallel to the coil axis, and the foil width is greater than the coil thickness.

In some embodiments, the metal foil has a foil thickness in the range of from about 0.5 mm to 1 mm.

In some embodiments, the coil includes an electrical insulator layer spirally co-wound with the metal foil.

In some embodiments, the electrical insulator layer has a thickness in the range of from about 0.05 to 1 mm.

In some embodiments, the ratio of the foil width to the foil thickness is in the of from about 170 to 500.

According to some embodiments, the metal foil and the electrical insulator layer are not bonded to one another across their widths.

In some embodiments, the coil has a substantially cylindrical outer profile.

According to some embodiments, the inductor assembly includes an electrically insulating epoxy resin surrounding and engaging the coil.

In some embodiments, the inductor assembly further includes a second coil including a second spirally wound metal foil, and the epoxy resin surrounds and engages the second coil, and is interposed between the first and second coils.

According to some embodiments, the inductor assembly includes an enclosure defining an enclosed chamber, wherein the coil is disposed in the chamber.

In some embodiments, the inductor assembly includes at least one mounting bracket supporting the enclosure and the coil.

According to some embodiments, the inductor assembly includes a terminal bus bar electrically connected to the metal foil and including a terminal, and an electrically insulating heat shrunk tube surrounding a portion of the terminal bus bar.

In some embodiments, the coil includes a second metal foil spirally co-wound with the first metal foil to form a multilayer conductor.

In some embodiments, the coil includes an electrical insulator layer spirally co-wound with the first and second metal foils.

According to some embodiments, the first and second metal foils and the electrical insulator layer are not bonded to one another across their widths.

According to some embodiments, the coil has a coil longitudinal axis, the coil has an innermost winding of the metal foil and an outermost winding of the metal foil, the inductor assembly includes a first terminal bus bar connected to the innermost winding and projecting outwardly from an axial end of the inductor assembly, and the inductor assembly includes a second terminal bus bar connected to the outermost winding and projecting outwardly from the axial end of the inductor assembly.

According to embodiments of the invention, a multi-unit inductor system includes first and second inductor assemblies. The first inductor assembly includes a first coil, the first coil including a spirally wound first metal foil. The second inductor assembly includes a second coil, the second coil including a spirally wound second metal foil. The first coil is electrically connected to the second coil.

In some embodiments, the first coil has a first coil longitudinal axis and the second coil has a second coil longitudinal axis. Each of the first and second inductor assemblies includes: a first terminal bus bar connected to the coil thereof and projecting outwardly from an axial end of the inductor assembly; and a second terminal bus bar connected to the coil thereof and projecting outwardly from the axial end of the inductor assembly. The first and second inductor assemblies are positioned side-by-side and the first terminal bus bar of the second inductor assembly is electrically connected to the second terminal bus bar of the first inductor assembly.

According to embodiments of the invention, a method for forming an inductor assembly includes spirally winding a metal foil into the form of a coil.

In some embodiments, the method includes spirally co-winding an electrical insulator sheet with the metal foil.

According to some embodiments, the metal foil and the electrical insulator sheet are not bonded to one another during the step of co-winding the electrical insulator sheet and the metal foil.

According to some embodiments, a dual coil inductor assembly includes an inner coil assembly and an outer coil assembly. The inner coil assembly includes an inner coil and first and second terminals. The inner coil includes an inner metal foil, and an inner electrical insulator sheet spirally co-wound with the inner metal foil. The outer coil assembly includes an outer coil and third and fourth terminals. The outer coil includes an outer metal foil, and an outer electrical insulator sheet spirally co-wound with the outer metal foil. The outer coil defines an outer coil air core. The inner coil is disposed within the outer coil air core so that the outer coil circumferentially surrounds the inner coil. The first terminal is electrically connected to the inner metal foil at a first location, the second terminal is electrically connected to the inner metal foil at a second location, and the first and second locations are spaced apart along the inner metal foil. The third terminal is electrically connected to the outer metal foil at a third location, the fourth terminal is electrically connected to the outer metal foil at a fourth location, and the third and fourth locations are spaced apart along the outer metal foil.

According to some embodiments, the dual coil inductor assembly includes: a first terminal bus bar including the first terminal and secured to an innermost winding of the inner metal foil; a second terminal bus bar including the second terminal and secured to an outermost winding of the inner metal foil; a third terminal bus bar including the third terminal and secured to an innermost winding of the outer metal foil; and a fourth terminal bus bar including the fourth terminal and secured to an outermost winding of the outer metal foil.

In some embodiments, the dual coil inductor assembly includes a clamp plate and a fastener mechanically securing one of the first and second terminal bus bars in electrical contact with the inner metal foil.

In some embodiments, the inner metal foil and the inner electrical insulator sheet are not bonded to one another across their widths, and the outer metal foil and the outer electrical insulator sheet are not bonded to one another across their widths.

According to some embodiments, a method for using a dual coil inductor assembly includes providing a dual coil inductor assembly including an inner coil assembly and an outer coil assembly. The inner coil assembly includes an inner coil and first and second terminals. The inner coil includes an inner metal foil, and an inner electrical insulator sheet spirally co-wound with the inner metal foil. The outer coil assembly includes an outer coil and third and fourth terminals. The outer coil includes an outer metal foil, and an outer electrical insulator sheet spirally co-wound with the outer metal foil. The outer coil defines an outer coil air core. The inner coil is disposed within the outer coil air core so that the outer coil circumferentially surrounds the inner coil. The first terminal is electrically connected to the inner metal foil at a first location, the second terminal is electrically connected to the inner metal foil at a second location, and the first and second locations are spaced apart along the inner metal foil. The third terminal is electrically connected to the outer metal foil at a third location, the fourth terminal is electrically connected to the outer metal foil at a fourth location, and the third and fourth locations are spaced apart along the outer metal foil. The method includes connecting the dual coil inductor assembly to first and second lines of an AC electrical system, including: electrically connecting an input of the first line to the first terminal; electrically connecting an output of the first line to the second terminal; electrically connecting an input of the second line to the third terminal; and electrically connecting an output of the second line to the fourth.

According to some embodiments, the first line is a phase line and the second line is a neutral line.

According to some embodiments, the first line is a first phase line and the second line is a second phase line.

DETAILED DESCRIPTION

Figure 1:
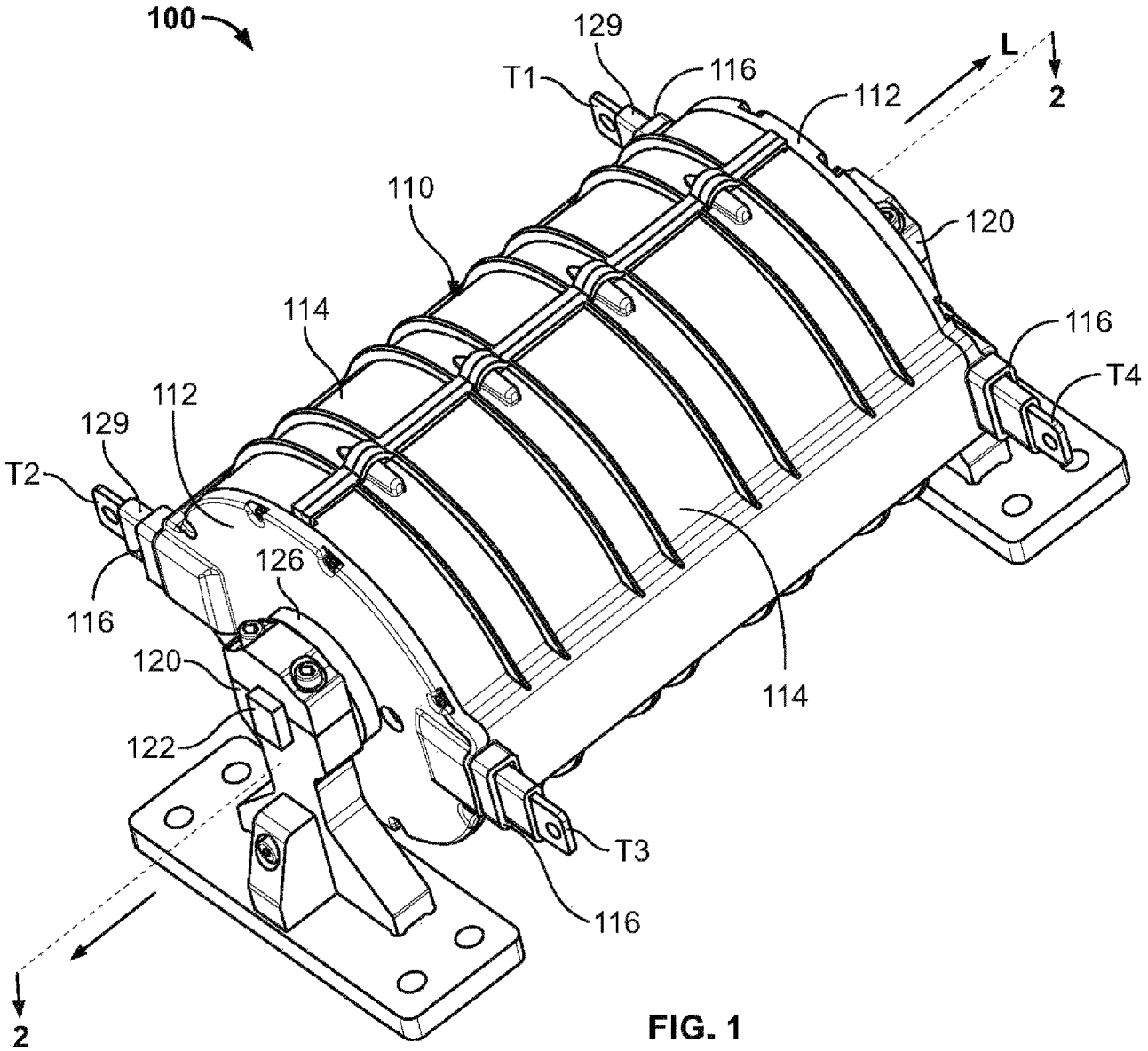
FIG. 1 is a top, perspective view of an inductor assembly according to embodiments of the invention.
Figure 2:
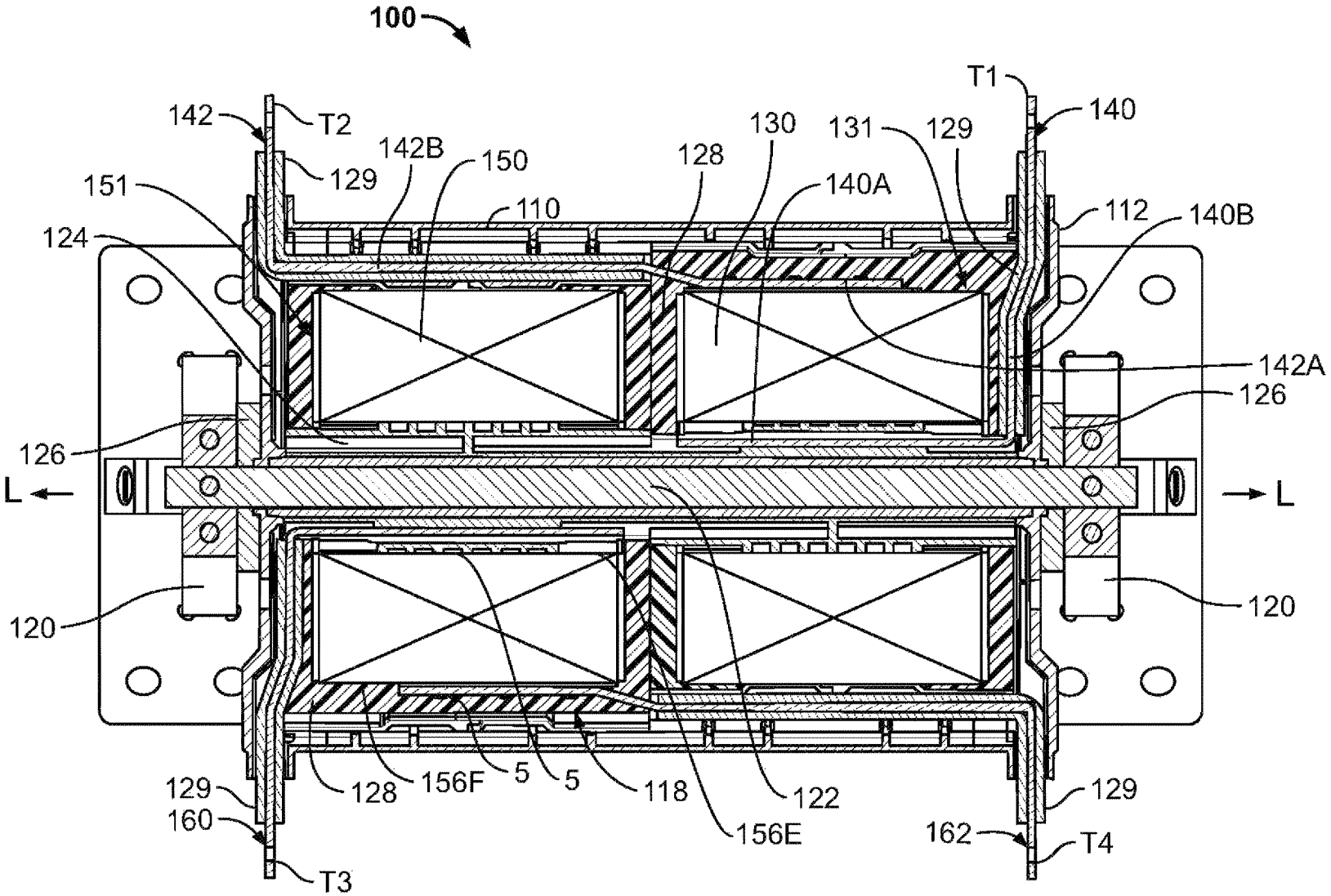
FIG. 2 is a cross-sectional view of the inductor assembly of FIG. 1 taken along the line 2-2 of FIG. 1.
Figure 3:
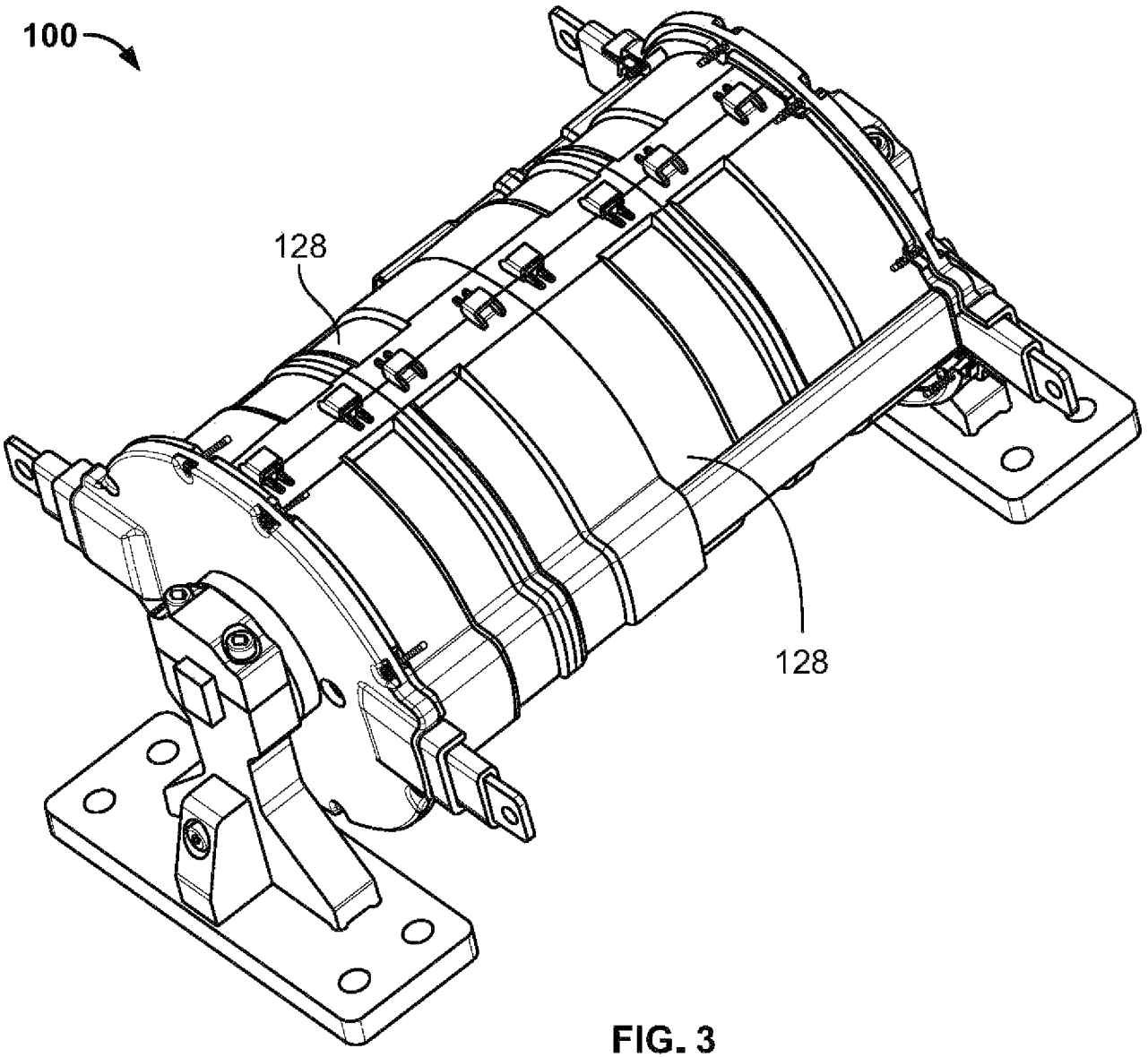
FIG. 3 is a perspective view of the inductor assembly of FIG. 1 wherein shells of the inductor assembly are removed for the purpose of explanation.
Figure 4:
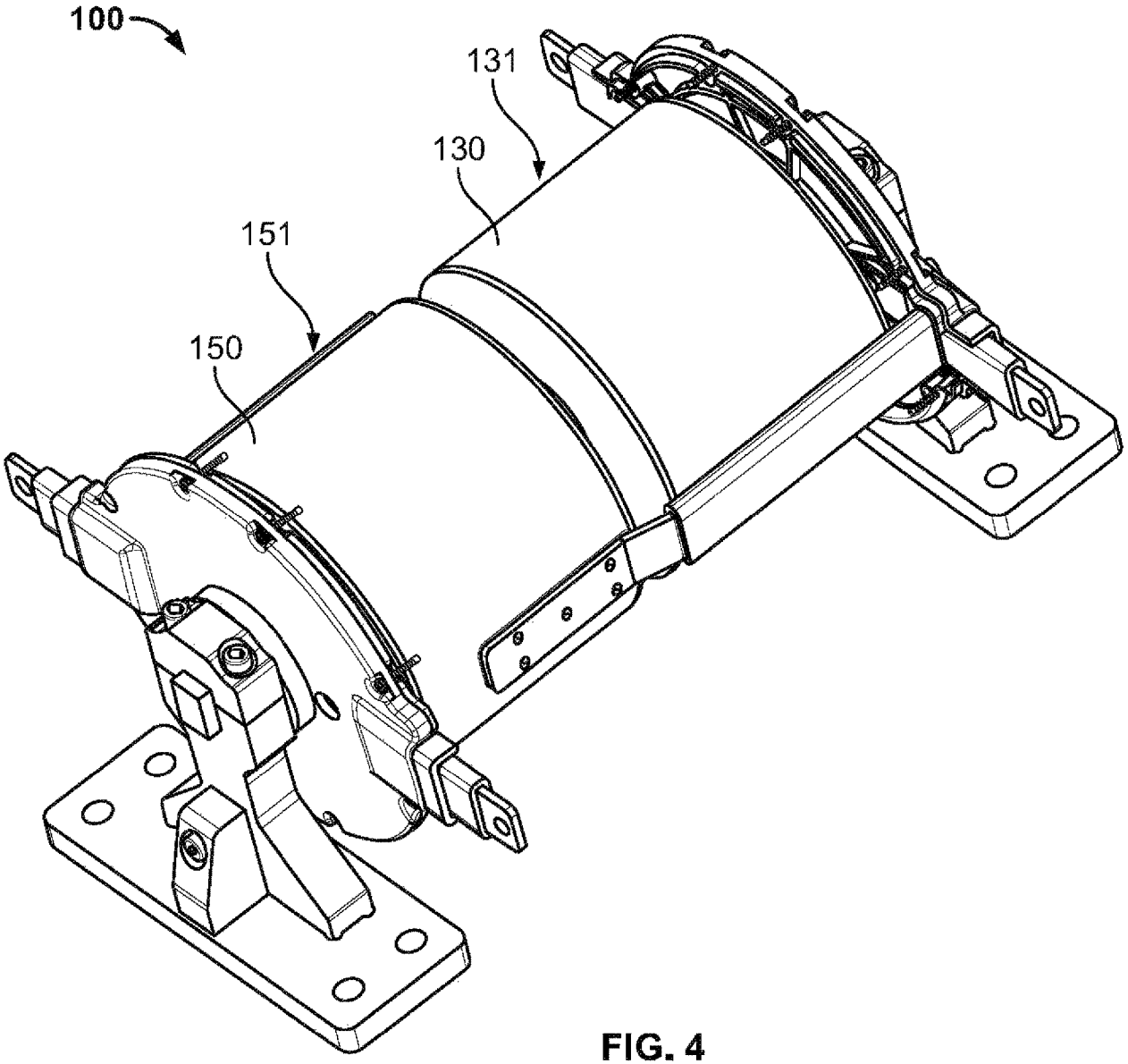
FIG. 4 is a perspective view of the inductor assembly of FIG. 1 wherein the shells and potting of the inductor assembly are removed for the purpose of explanation.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Typical inductance coil designs use a conductor which is insulated using a varnish and is turned around a spool. However, such designs typically will not be able to withstand significant transient overvoltages between the turns of the coil and will be large in size, as the load current requires a significant cross-section of the conductor. In that case, there is a significant space lost in between the turns of the conductor, as it has a round shape. If an insulation cover were mounted over the coil to ensure that it can withstand very high transient overvoltages, then the overall coil assembly would become even larger in size. Further, vibration might be an issue as there is minimal contact between the turns of the coil, allowing some possible movement.

With reference to FIGS. 1-11 a dual coil inductor assembly 100 according to embodiments of the invention is shown therein. The inductor assembly 100 has a longitudinal axis L-L.

The inductor assembly 100 includes an enclosure 110, a pair of axially spaced apart support bases 120, a support shaft 122, an electrically insulating fitting 124, a pair of bushings 126, potting 128, insulation sleeves or tubes 129, a first coil assembly 131, and a second coil assembly 151.

The bases 120 and shaft 122 are metal (in some embodiments, aluminum). The shaft 122 is supported by and affixed to the bases 120 at either end.

The fitting 124 is mounted around the shaft 122. The fitting 124 may be formed of a plastic or polymeric material such as Polyethersulfone with a dielectric strength in the range of from about 30 to 40 kV/mm.

The coil assemblies 131, 151 (described in more detail below) are mounted on the fitting 124 and the shaft 122. The coil assemblies 131, 151 each include a pair of terminal bus bars 140, 142, 160, 162.

The enclosure 110 includes a pair of laterally opposed shells 114 and a pair of axially opposed end plates 112 that are fastened together to form the enclosure 110. The enclosure 110 defines an internal cavity or chamber 118 within which the support shaft 122, the fitting 124, the potting 128, the insulation tubes 129, the first coil assembly 131, and the second coil assembly 151 are disposed and contained. Four terminal openings 116 are defined in the enclosure 110 and communicate with the chamber 118.

The enclosure components 112, 114 may be formed of any suitable material. In some embodiments, the enclosure components 112, 114 are formed of an electrically insulating polymeric flame retardant material such as Noryl N190X by SABIC with a dielectric strength of about 19 kV/mm.

Each of the four insulation tubes 129 surrounds a length of a respective terminal bus bar 140, 142, 160, 162 extending through the chamber 118, through a terminal opening 116, and beyond the terminal opening 116 a prescribed distance. The tubes 129 may be formed of any suitable material. In some embodiments, the tubes 129 are formed of an electrically insulating polymeric material. In some embodiments, the tubes 129 are formed of an electrically insulating elastomeric material. In some embodiments, the tubes 129 are formed of an electrically insulating heat shrinkable polymer (e.g., elastomer) that has been heat shrunk about the corresponding terminal bus bar 140, 142, 160, 162.

The potting 128 fills the void space within the chamber 118 that is not occupied by the other components. The potting 128 may formed of any suitable material. The potting 128 is electrically insulating. In some embodiments, the potting 128 is formed of a material having a breakdown voltage of at least 18 kV/mm. In some embodiments, the potting 128 is an epoxy resin or a Polyurethane resin.

Each bushing 126 is annular and is sandwiched or interposed between an end plate 112 and the adjacent base 120 and mounted on the shaft 122. The bushings 126 may be formed of any suitable material. In some embodiments, the bushings are formed of a resilient polymeric material. In some embodiments, the bushings 126 are formed of an elastomer and, in some embodiments, a silicone elastomer or rubber.

The coil assembly 131 includes a multi-layer coil 130, an inner terminal bus bar 140, and an outer terminal bus bar 142.

The coil 130 is an air core coil. The coil 130 has a coil axis A-A and axially opposed ends 130A, 130B. The coil 130 includes an electrically conductive conductor sheet, strip or foil 132 and an electrically insulative insulator strip or sheet 134. The foil 132 and sheet 134 are spirally co-wound or wrapped about the axis A-A to form windings 136. The windings 136 extend progressively from an innermost winding 136E of the conductor foil 132 in an inner passage 138 to an outermost winding 136F of the conductor foil 132 on the outer diameter of the coil 130. Each winding 136 is radially superimposed on, stacked on, or wrapped around the preceding winding 136.

The conductor foil 132 has opposed side edges 132A that are axially spaced apart along the coil axis A-A and extend substantially parallel to one another. The conductor foil 132 is spirally wound such that each edge 132A remains substantially in or proximate a single lateral plane E-E (FIG. 7) throughout the coil 130 from the winding 136E to the winding 136F. That is, the conductor foil 132 is maintained in alignment with itself and is spirally, not helically, wound.

Figure 8:
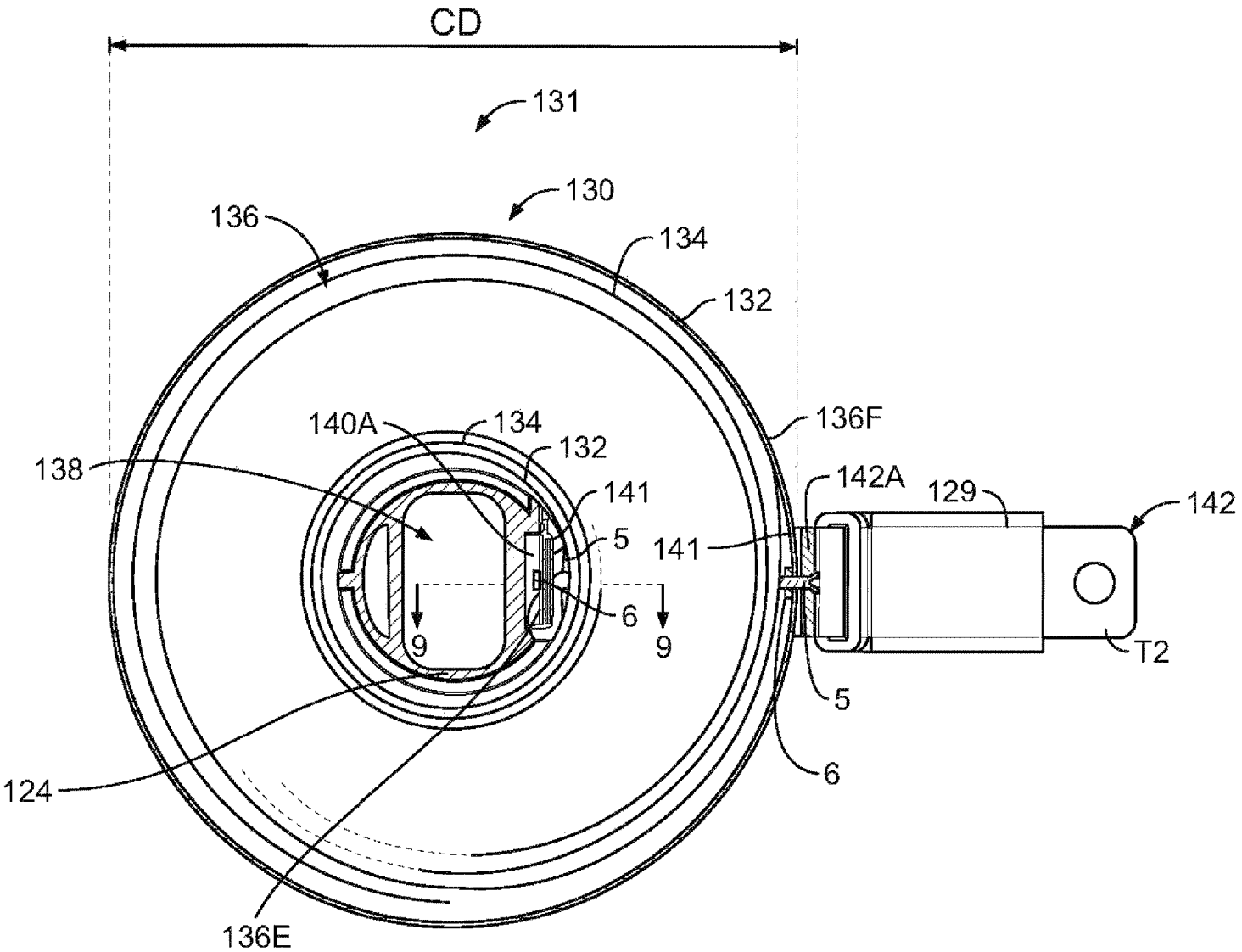
FIG. 8 is an end view of the coil assembly of FIG. 6.

According to some embodiments, the coil 130 includes at least 10 turns or windings from the winding 136E to the winding 136F and, in some embodiments, from about 60 to 100 turns. It will be appreciated that in the figures the layers 132, 134 and turns of the coils 130, 150 are not specifically shown or, in FIG. 8, are only partially shown. As such, the depictions of the layers 132, 134 in the drawings may not be to scale with regard to the number of turns, the thicknesses of the layers, or the spacing between layers.

The conductor foil 132 may be formed of any suitable electrically conductive material. In some embodiments, the conductor foil 132 is formed of metal. In some embodiments, the conductor foil 132 is formed of copper or aluminum.

The insulator sheet 134 may be formed of any suitable electrically insulative material. In some embodiments, the insulator sheet 134 is formed of a polymeric material. In some embodiments, the insulator sheet 134 is formed of polyester film. In some embodiments, the insulator sheet 134 is formed of a material having a breakdown voltage of at least 4 kV/mm and, in some embodiments, in the range of from about 13 kV/mm to 20 kV/mm.

The coil 130 is generally tubular. In some embodiments, the outer profile of the coil 130 is substantially cylindrical and is substantially circular in lateral cross-section.

The coil 130 has a thickness CT (FIG. 7), a length CL (FIG. 7; parallel with the coil axis L-L), and an outer diameter CD (FIG. 8). The thickness CT is the radial distance from the innermost conductor winding 136E to the outermost conductor winding 136F in a lateral plane N-N (FIG. 7) orthogonal to the coil axis A-A.

According to some embodiments, the coil 130 is generally cylindrical with a length CL greater than its outer diameter CD. According to some embodiments, the ratio CL/CD is at least 0.2 and, in some embodiments, is in the range of from about 0.3 to 1.5.

Figure 9:
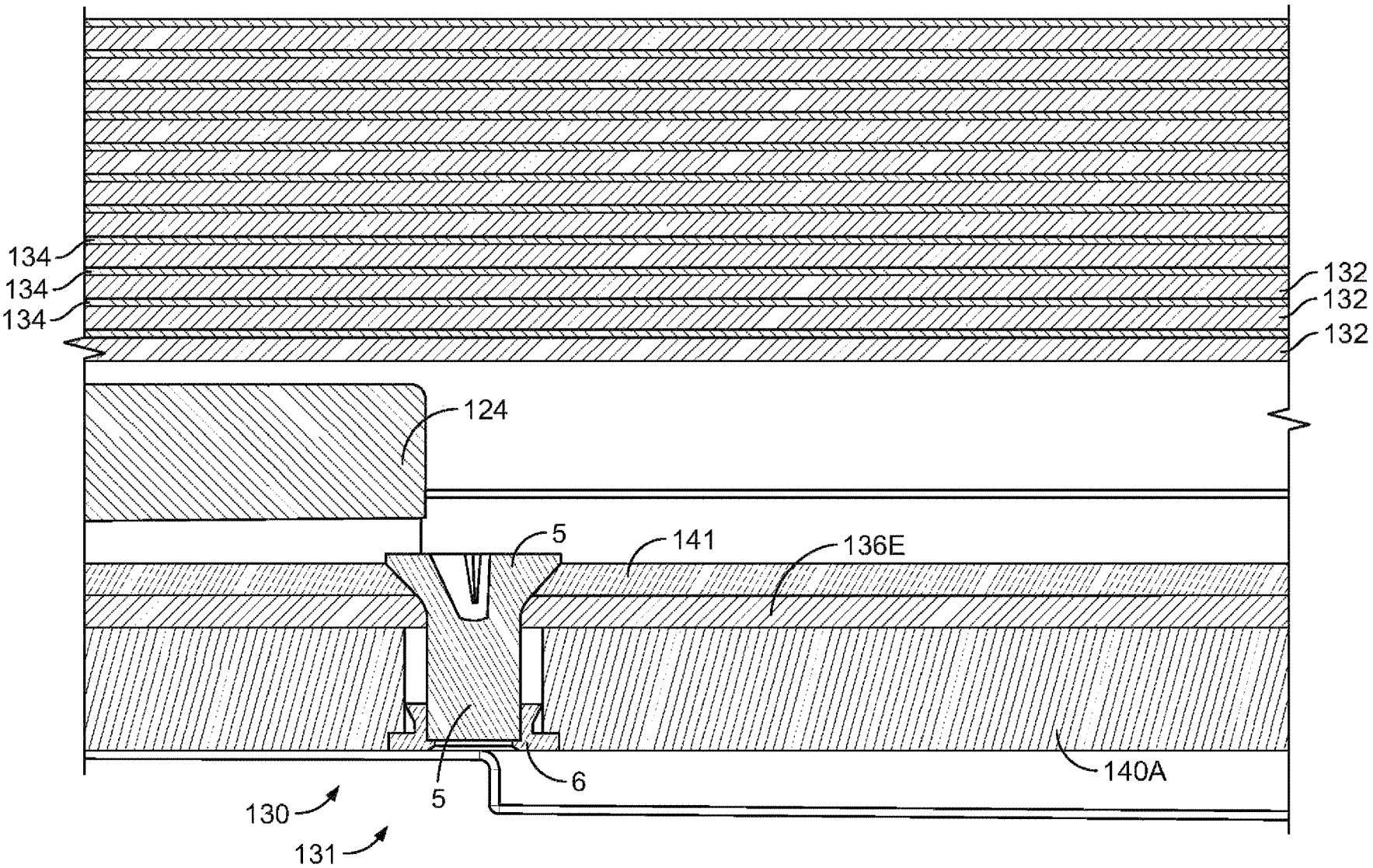
FIG. 9 is an enlarged, fragmentary, cross-sectional view of the coil assembly of FIG. 6.
Figure 10:
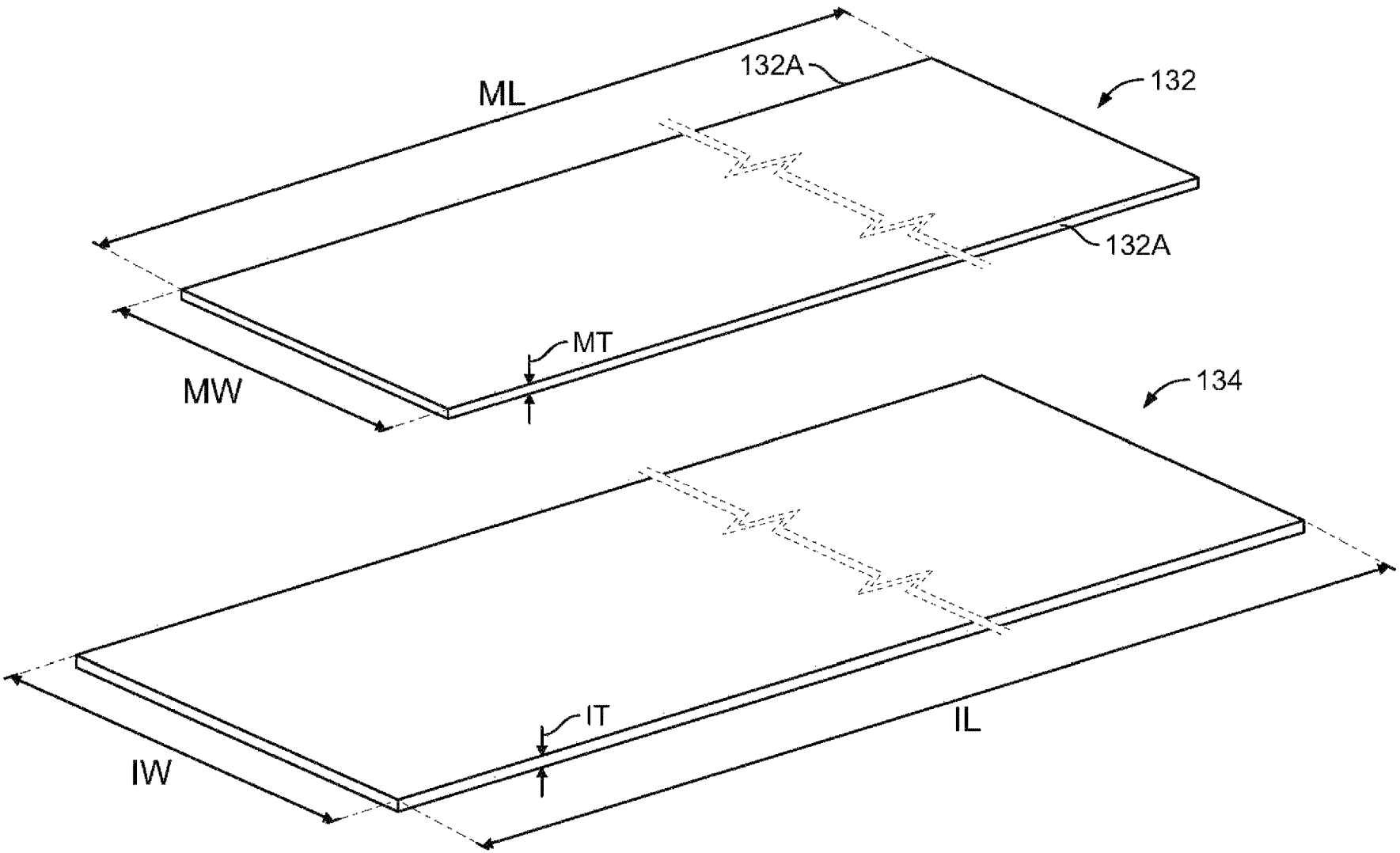
FIG. 10 is a fragmentary, perspective view of a conductor foil and an insulator sheet forming parts of the coil assembly of FIG. 6, wherein the conductor foil and the insulator sheet are shown flattened out for the purpose of explanation.

FIGS. 9-10 are fragmentary views of the conductor foil 132 and the insulator sheet 134 laid flat (e.g., prior to winding into the coil 130). The conductor foil 132 has a thickness MT, a length ML, and a width MW. The insulator sheet 134 has a thickness IT, a length IL, and a width IW.

According to some embodiments, the conductor foil width MW is greater than the coil outer diameter CD. In some embodiments, the ratio MW/CD is at least 0.2 and, in some embodiments, is in the range of from about 0.4 to 1.5.

According to some embodiments, the conductor foil width MW is greater than the coil thickness CT. In some embodiments, the ratio MW/CT is at least 0.5 and, in some embodiments, is in the range of from about 2 to 3.

According to some embodiments, the thickness MT is in the range of from about 0.1 to 2 mm and, in some embodiments, in the range of from about 0.5 mm to 1 mm. According to some embodiments, the length ML is in the range of from about 1 m to 40 m. According to some embodiments, the width MW is in the range of from about 0.5 cm to 30 cm.

According to some embodiments, the thickness IT is in the range of from about 0.05 to 1 mm. According to some embodiments, the length IL is in the range of from about 1 m to 40 m. According to some embodiments, the width IW is in the range of from about 0.5 cm to 30 cm.

According to some embodiments, the ratio MW/MT is at least 2.5 and, in some embodiments, is in the range of from about 170 to 500.

According to some embodiments, the ratio IW/IT is at least 2.5 and, in some embodiments, is in the range of from about 1000 to 4000.

Figure 7:
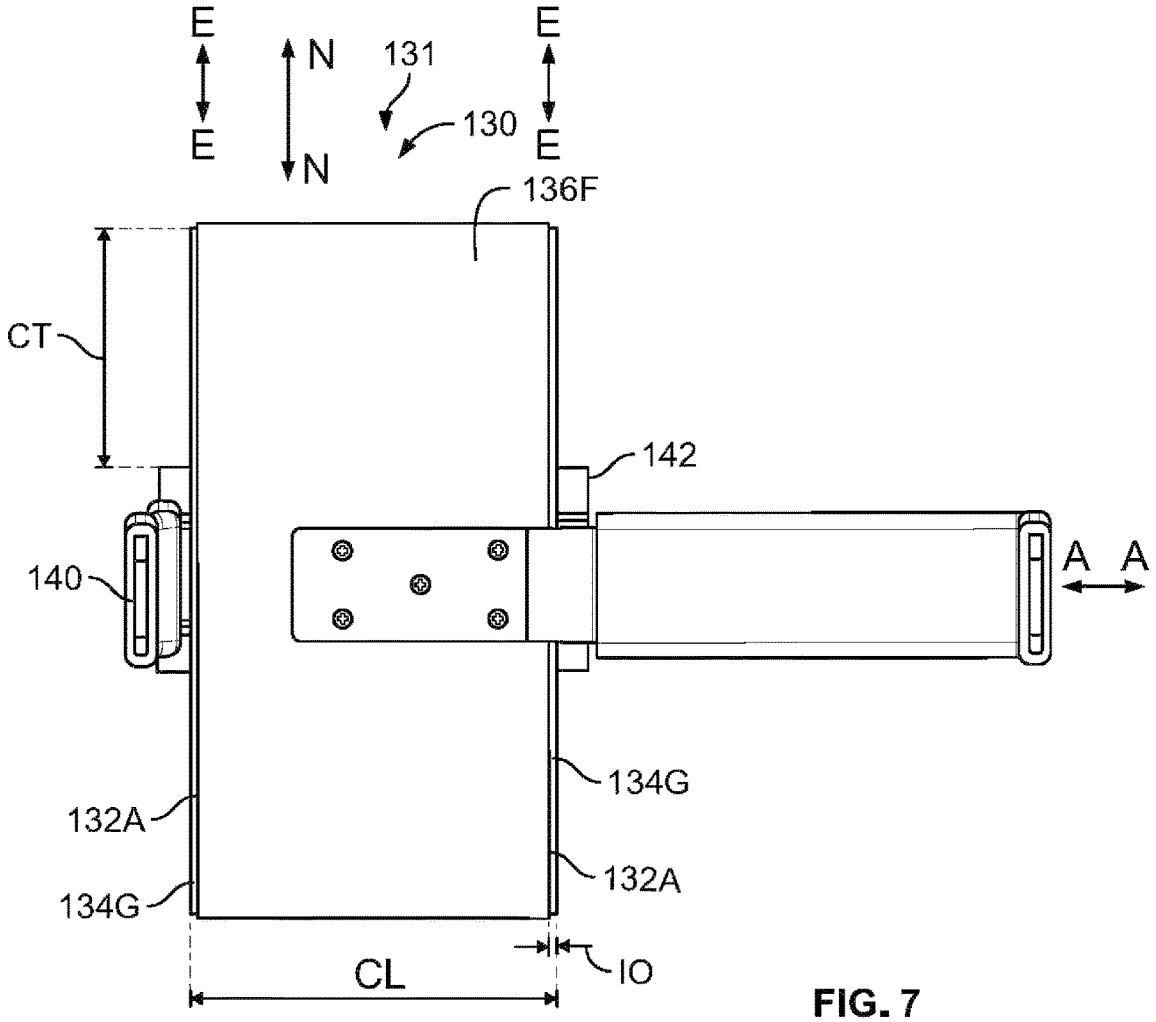
FIG. 7 is a side view of the coil assembly of FIG. 6.

According to some embodiments, edge sections 134G of the insulator sheet 134 extend axially outwardly beyond the adjacent edges of the conductor foil 132 a distance IO (FIG. 7). In some embodiments, the distance IO is at least 1 mm and, in some embodiments, is in the range of from about 3 mm to 10 mm.

According to some embodiments, the coil 130 is formed by the following method. The conductor foil 132 is individually formed as a discrete tape, strip, sheet or foil. The insulator sheet 134 is separately individually formed as a discrete tape, strip, sheet or foil. The preformed foil 132 and preformed sheet 134 are thereafter mated, laminated or layered together and spirally co-wound into the coil configuration to form the coil 130. In some embodiments, the layers 132, 134 are co-wound about a cylindrical mandrel, form or support. In some embodiments, the layers 132, 134 are co-wound about the fitting 124.

In some embodiments, the foil 132 and the sheet 134 are not bonded to one another along their lengths prior to winding into the coil. That is, the foil 132 and the sheet 134 are loosely co-wound and are not bonded or laminated to one another until after formation of the coil 130. In some embodiments, the foil 132 and the sheet 134 are not bonded to one another in the completed coil 130 except by the potting 128 at the ends of the coil 130. Thus, in this case, the foil 132 and the sheet 134 are not bonded to one another across their widths. In some embodiments, the foil 132 and the sheet 134 are tightly wound so that air gaps between the windings of the conductor foil 132 are minimized or eliminated.

The terminal bus bars 140, 142 may be formed of any suitable electrically conductive material. In some embodiments, the terminal bus bars 140, 142 are formed of metal. In some embodiments, the terminal bus bars 140, 142 are formed of copper or tin-plated copper.

The inner terminal bus bar 140 (FIG. 2) includes a contact leg 140A and a terminal leg T1 joined by a connector leg 140B. The contact leg 140A is secured in mechanical and electrical contact with the innermost winding 136E of the conductor foil 132 by screws 5, nuts 6, and a clamping member or plate 141 (FIG. 8). The conductor foil winding 136E is interposed or sandwiched between the contact leg 140A and the clamping plate 141. The screws 5 penetrate through the winding 136E and are secured by the nuts 6 such that the contact leg 140A and the clamping plate 141 compressively clamp onto the winding 136E therebetween. The terminal leg T1 extends out of the enclosure 110 through an opening 116.

Figure 5:
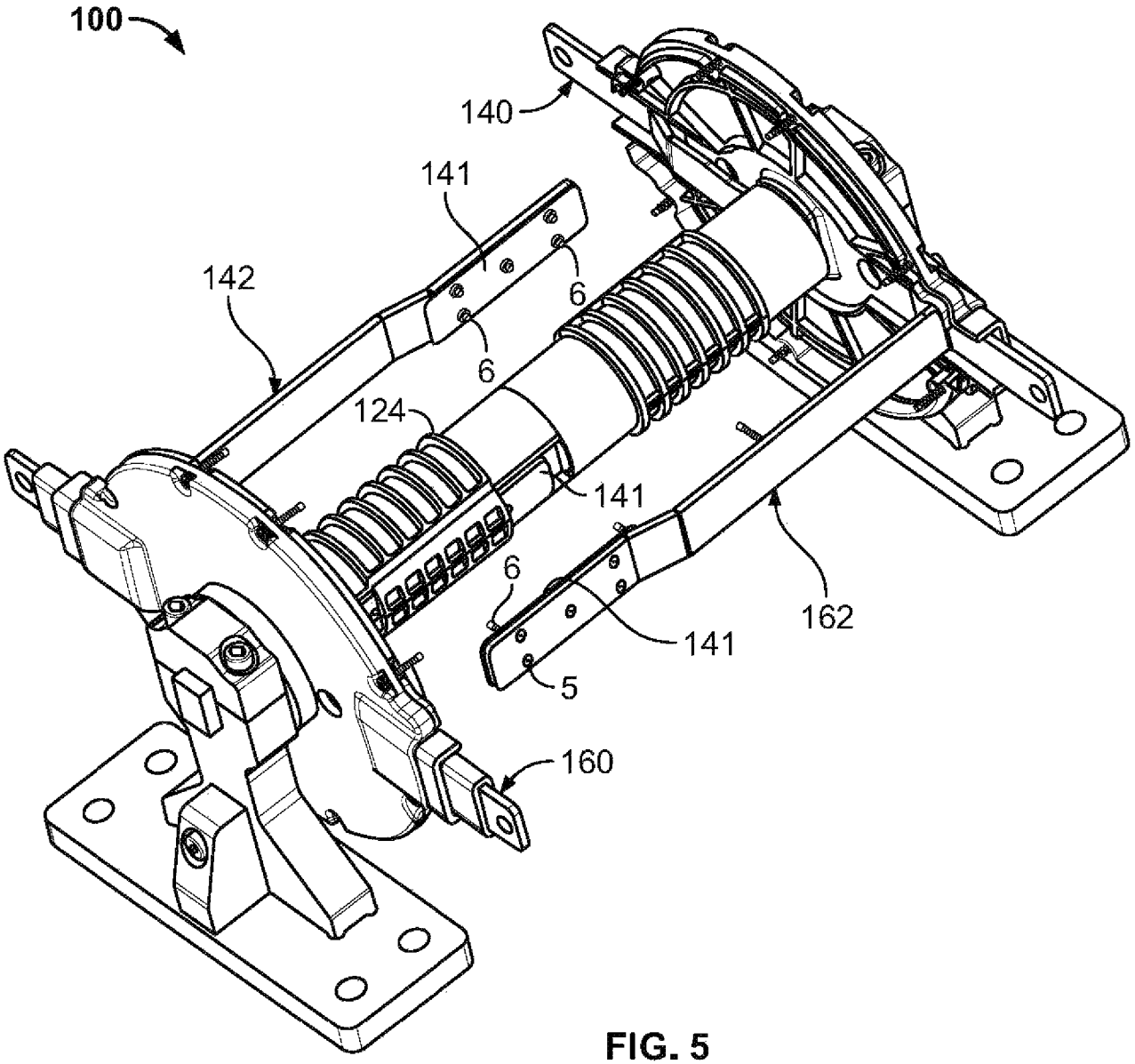
FIG. 5 is a perspective view of the inductor assembly of FIG. 1 wherein the shells, the potting and coils of the inductor assembly are removed for the purpose of explanation.
Figure 6:
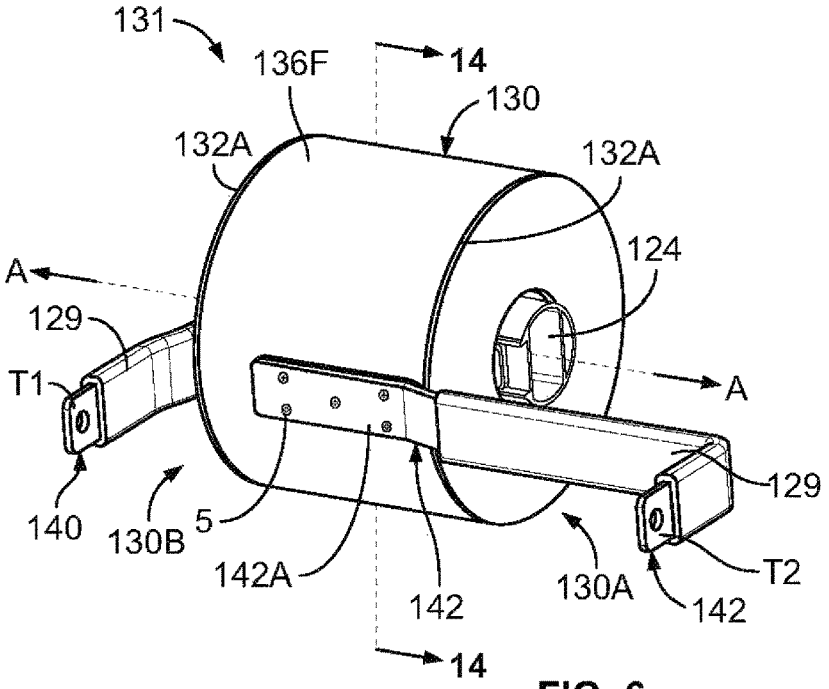
FIG. 6 is a perspective view of a coil assembly forming a part of the inductor assembly of FIG. 1.

The outer terminal bus bar 142 (FIG. 2) includes a contact leg 142A and a terminal leg T2 joined by a connector leg 142B. The contact leg 142A is secured in mechanical and electrical contact with the outermost winding 136F of the conductor foil 132 by screws 5, nuts 6, and a clamping plate 141 (FIG. 5). The winding 136F is clamped between the contact leg 142A and the clamping plate 141 by the screws 5 (which penetrate through the winding 136F) and the nuts 6 in the same manner as described above for the contact leg 140A, the screws 5, the nuts 6, and the clamping plate 141. The terminal leg T2 extends out of the enclosure 110 through an opening 116.

The coil assembly 151 is constructed in the same manner as the coil assembly 131 and includes a multi-layer coil 150, an inner terminal bus bar 160, and an inner terminal bus bar 162 corresponding to the 130, the inner terminal bus bar 140, and the outer terminal bus bar 142. The coil 150 has a coil axis B-B.

The terminal leg T3 of the inner terminal bus bar 160 is secured in mechanical and electrical contact with the innermost winding 156E of the conductor foil of the coil 150 by screws 5, nuts 6, and a clamping plate 141 in the same manner as described above for the contact leg 140A, the screws 5, the nuts 6, and the clamping plate 141. The terminal leg T3 extends out of the enclosure 110 through an opening 116.

The terminal leg T4 of the outer terminal bus bar 162 is secured in mechanical and electrical contact with the outermost winding 156F of the conductor foil of the coil 150 by screws 5, nuts 6, and a clamping plate 141 in the same manner as described above for the contact leg 140A, the screws 5, the nuts 6, and the clamping plate 141. The terminal leg T4 extends out of the enclosure 110 through an opening 116.

Thus, in accordance with some embodiments, the coils 130, 150 use a metal foil or conductor that is very thin (e.g., from 0.2 mm up to 1.5 mm) and very wide (e.g., from 30 mm up to 200 mm). Then, this conductor in the form of a foil is wrapped around a plastic cylinder (e.g., the fitting 124). In between the turns of the foil, a thin insulating sheet is used that will provide adequate insulation between the turns of the coil (e.g., from 5 kV up to 20 kV). Bus bars are connected to the inner and outer windings of the conductor foil and project out from the enclosure. The bus bars are further electrically insulated using heat shrinkable electrically insulating sleeves. The heat shrinkable sleeves can prevent flashover between the bus bars and the remainder of the coils. The coils are covered inside a plastic enclosure and then potted with epoxy resin to provide electrical insulation in between the turns of the conductor foil at the two axial ends of the coil. Further, the potting prevents humidity from penetrating inside the coil that might reduce the insulation of the coil or age the insulation properties of the insulation used. Further, the potting will also make the coil more stable in case of vibration and also increase the insulation between the two outputs of the coil.

Figure 11:
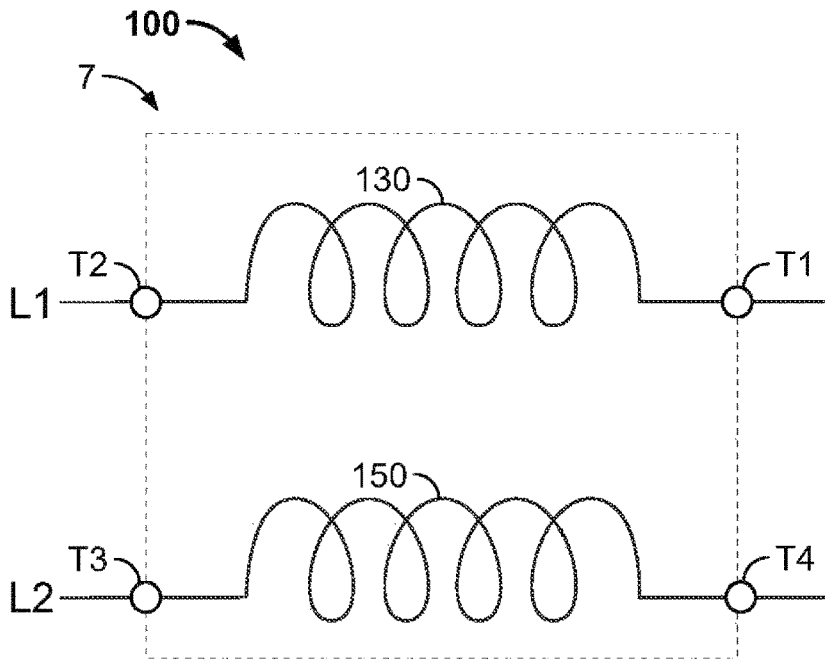
FIG. 11 is an electrical diagram representing a two-phase AC electrical power system including the inductor assembly of FIG. 1.

According to method embodiments, the inductor assembly 100 is a two phase coil used in a two phase AC electrical power system 7 as illustrated by the diagram in FIG. 11. The input of line L1 is connected to the terminal T2 and the output of line L1 is connected to the terminal T1. The input of line L2 is connected to the terminal T3 and the output of line L2 is connected to the terminal T4. In some embodiments, AC power system has a voltage L1-L2 of about 650 Vrms and a load current of about 100 A. Circuit breakers may be provided between the input terminals T2, T3 of the inductor assembly 100 and the power supply. The output terminals T1, T4 of the inductor assemblies 100 may be connected to a power distribution panel.

In the event of a surge current (high di/dt) in a line, the insulation tube 129 will isolate the covered terminal bus bar and thereby prevent flashover between the coil connected to that line and a terminal bus bar of the other coil. For example, it can be seen in FIG. 3 that the connecting leg 140B of the bus bar 140 extends along the length of the coil 150. When a surge current is applied to the coil 150, the tube 129 on the terminal bus bar 140 can prevent flashover from the coil 150 to the connecting leg 140B of the bus bar 140.

The potting 128 (e.g., epoxy resin) covers the ends of the coils 130, 150 and thereby stabilizes the coils 130, 150 and increases the electrical insulation between the turns of the conductor foil (e.g., the conductor foil 132) within each coil 130, 150. The potting 128 also increases the electrical insulation between the adjacent ends of the two coils 130, 150. The potting 128 further increases the electrical insulation between the coils 130, 150 and the bus bars 140, 142, 160, 162.

The external plastic enclosure 110 can take vibrations and provide environmental protection for the coils 130, 150. The enclosure 110 also increases electrical insulation for the coils 130, 150. The strong mounting brackets or bases 120 and support shaft 122 can ensure that the inductor assembly 100 can withstand vibration.

The bushings 126 can serve to take up manufacturing tolerances in the inductor assembly 100, thereby reducing vibration. The bushings 126 can also serve to damp or absorb forces (e.g., vibration) applied to the inductor assembly 100. The bushings 126 can also resiliently and temporarily take up expansion of the inductor assembly 100 caused by heating of the coils 130, 150.

The potting can also take up manufacturing tolerances in the inductor assembly 100, thereby reducing vibration.

Because screws 5 or other fasteners and clamping plates 141 are used to secure the bus bars 140, 142, 160, 162 to the innermost and outermost windings 136E, 136F, 156E, 156F, it is not necessary to use a welding or soldering technique that may melt the thin coil conductor foil.

Figure 12:
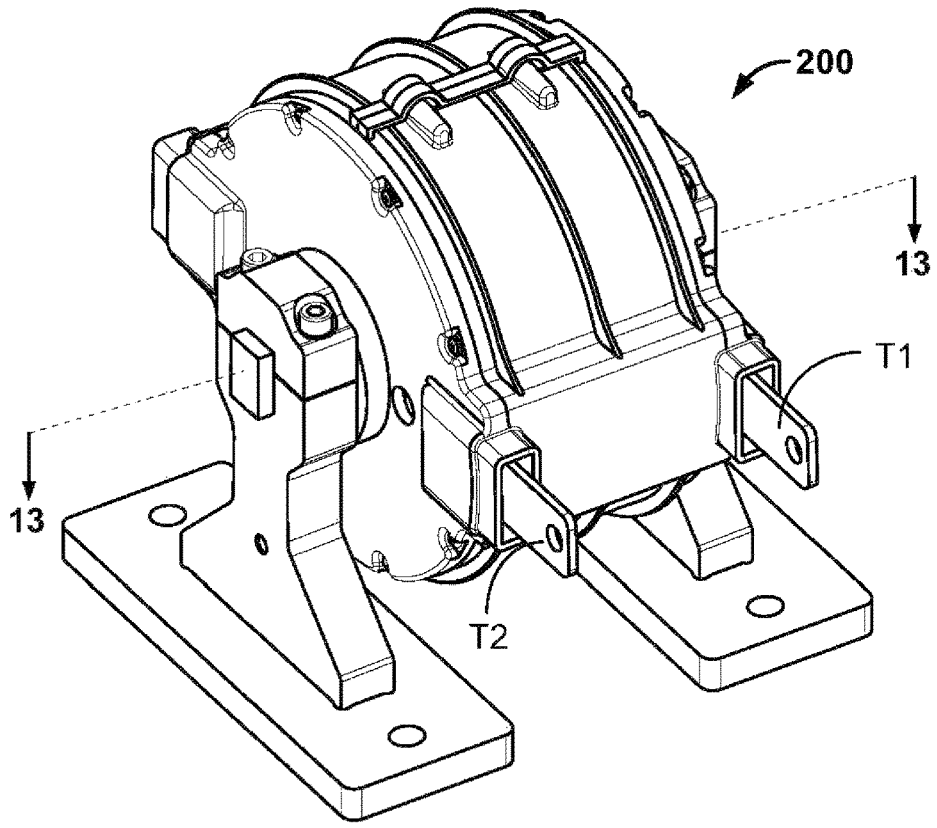
FIG. 12 is a perspective view of an inductor assembly according to further embodiments of the invention.
Figure 13:
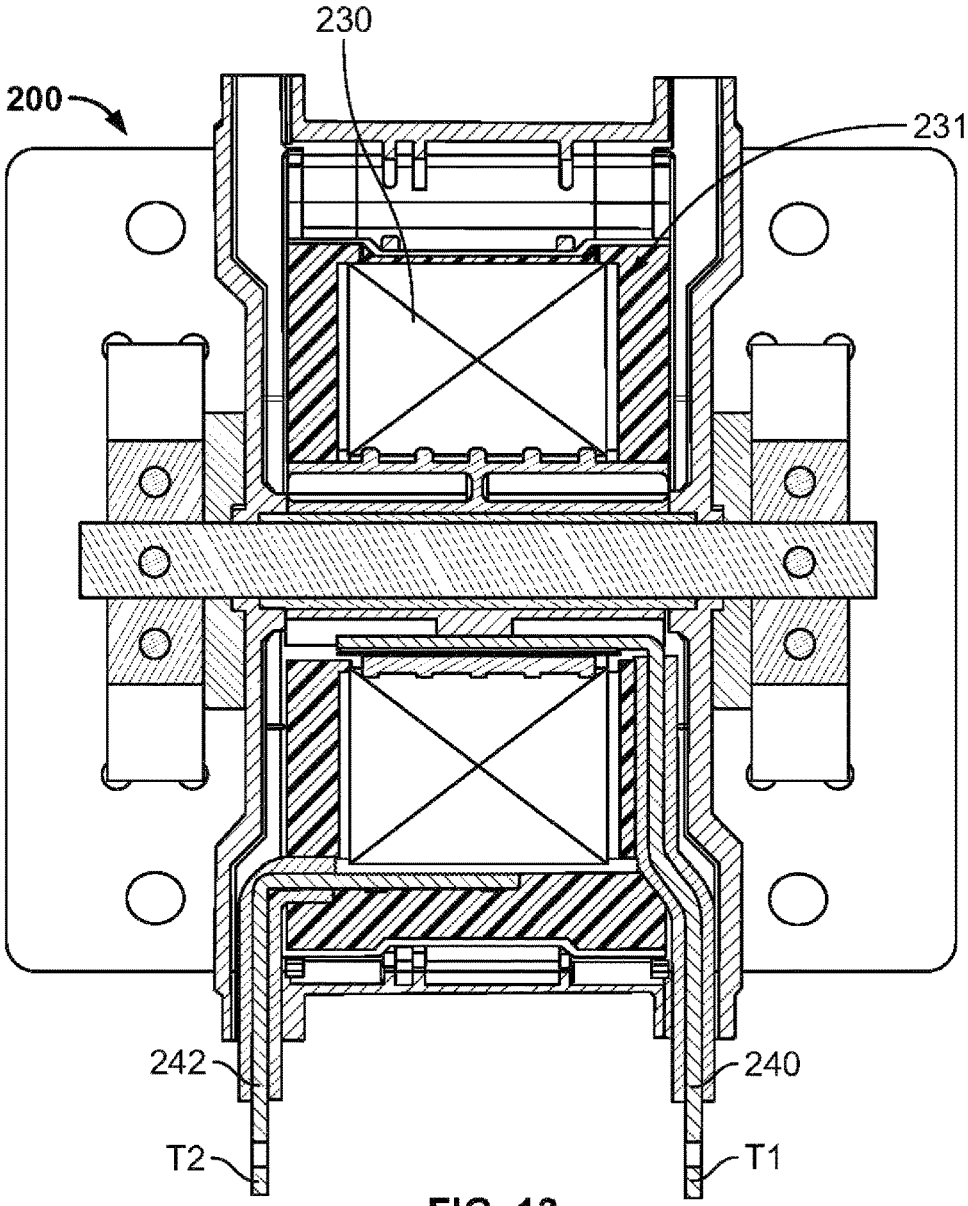
FIG. 13 is a cross-sectional view of the inductor assembly of FIG. 12 taken along the line 13-13 of FIG. 12.
Figure 14:
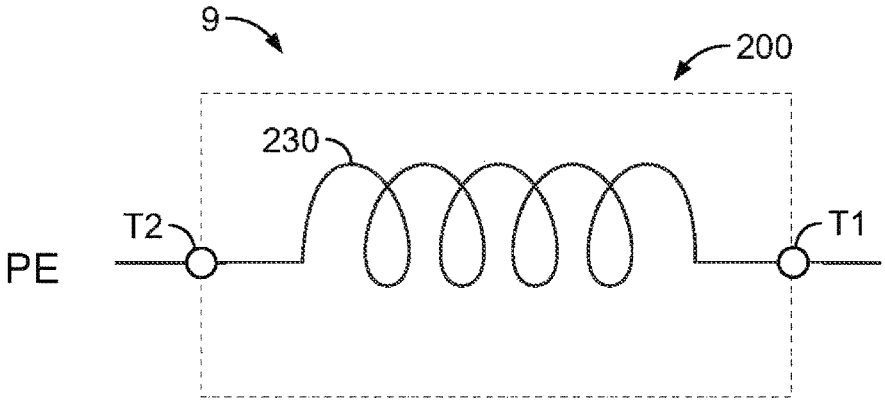
FIG. 14 is an electrical diagram representing an electrical power system including the inductor assembly of FIG. 12.
Figure 15:
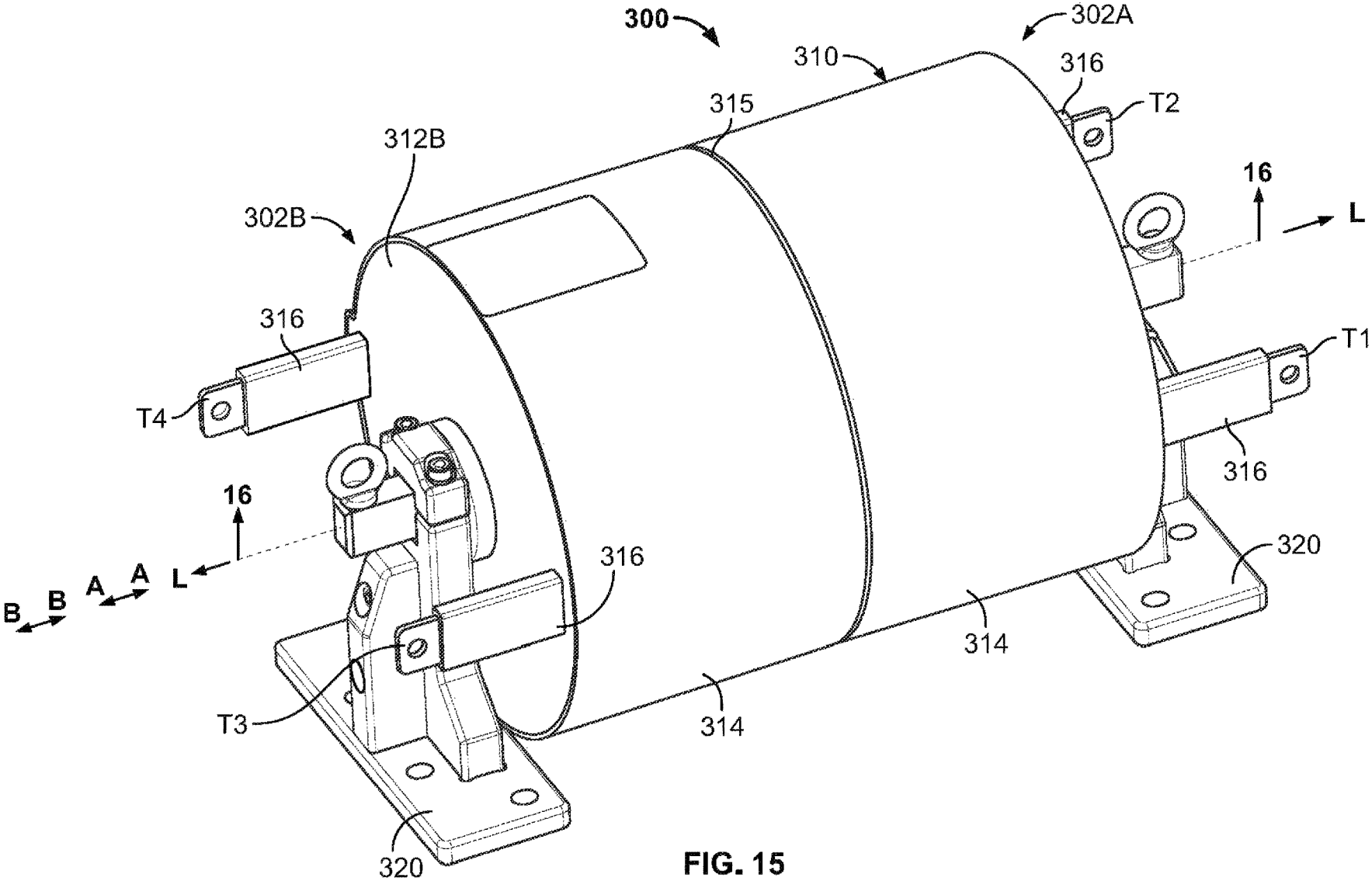
FIG. 15 is a perspective view of an inductor assembly according to further embodiments of the invention.

FIGS. 12-14 show an inductor assembly 200 according to further embodiments of the invention. The inductor assembly 200 is constructed similarly to the inductor assembly 100 but includes only a single coil assembly 231. The coil assembly 231 includes a coil 230 and terminal bus bars 240, 242 corresponding to and constructed in same manner as described for the coil assembly 131, the coil 130 and the terminal bus bars 140, 142. The terminal bus bars 240, 242 have terminal legs T1 and T2 corresponding to the terminal legs T1 and T2 of the inductor assembly 100.

As schematically illustrated in FIG. 14, the inductor assembly 200 can be connected in series to the protective earth (PE) of a power system 9 with a voltage of 650 Vrms between its lines and a load current of 100 A. The inductor assembly 200 may be rated for half of the actual line currents (i.e., around 50 A) according to relevant standards. The output T1 of the inductor assembly 200 is connected to the PE terminals inside a distribution panel.

According to some embodiments of the invention, an inductor assembly as described herein has a specific load current rating of around 100 A, can operate in a normal low voltage (LV) application (up to 1000 Vac), is able to sustain very high transient overvoltage events that might be developed across its ends (in the range of 100 kV), is able to comply with extreme vibrating conditions, is able to be installed in outside environments, substantially reduces or minimizes the risk of fire under failure, has a small footprint and size (e.g., less than 43000 $cm^3$), and is relatively lightweight (e.g., less than 25 kg).

FIGS. 15-24 show a dual coil inductor assembly 300 according to further embodiments of the invention. The inductor assembly 300 is constructed similarly to the inductor assembly 100 but is configured such that the terminal legs T1, T2 extend from one axial end 302A of the inductor assembly 300, and the terminal legs T3, T4 extend from the opposite axial end 302B of the inductor assembly 300.

The inductor assembly 300 includes an enclosure assembly 310, a pair of axially spaced apart support bases 320, a support shaft 322, an electrically insulating fitting 324, a pair of bushings 326, potting 328, insulation sleeves or tubes 329, a first coil assembly 331, and a second coil assembly 351 corresponding to the components 110, 120, 122, 124, 126, 128, 129, 131, and 151, respectively, except as shown and discussed.

The enclosure assembly 310 includes a pair of axially opposed, cylindrical, cup shaped shells 314 and a pair of axially opposed end plates 312A and 312B. Each shell 314 defines a chamber 318 to contain a respective one of the assemblies 331, 351 and potting 328. Two terminal openings 316 are defined in each end plate 312 and communicate with the adjacent chamber 318. An electrically insulating partition bushing 315 is interposed between the adjacent inner ends of the shells 314. The partition bushing 315 may be formed of a material as described above for the bushings 126.

Figure 21:
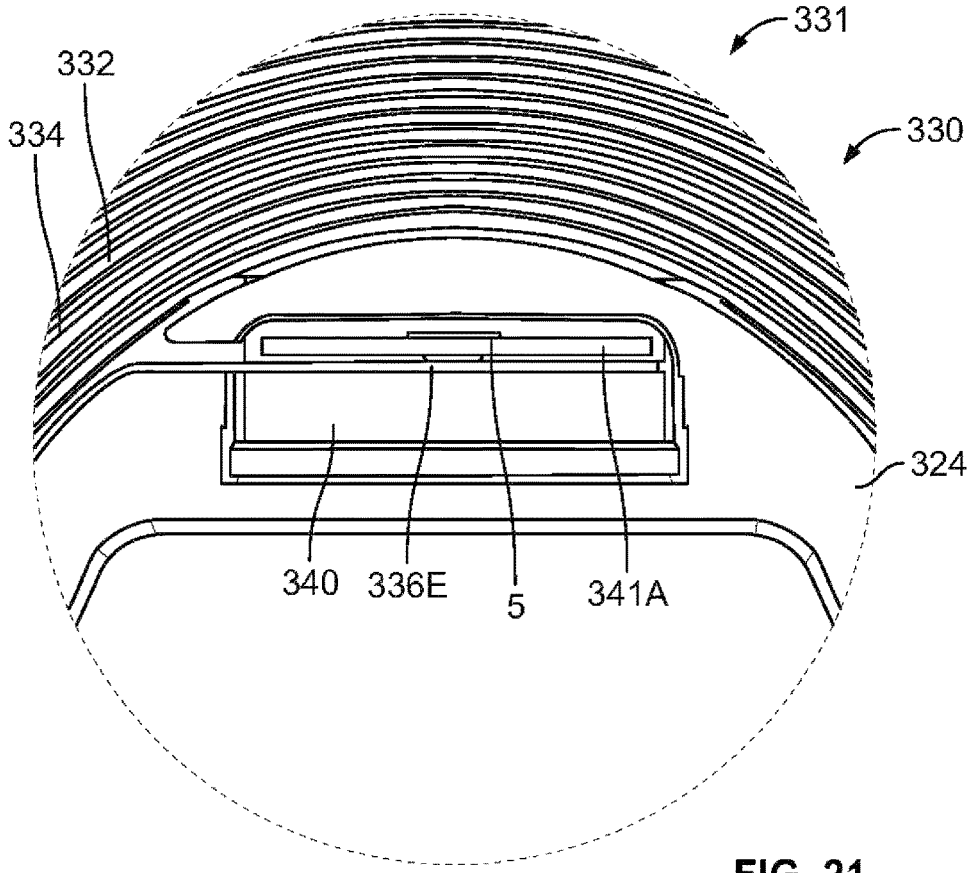
FIG. 21 is an enlarged, fragmentary, end view of the coil assembly of FIG. 19.
Figure 22:
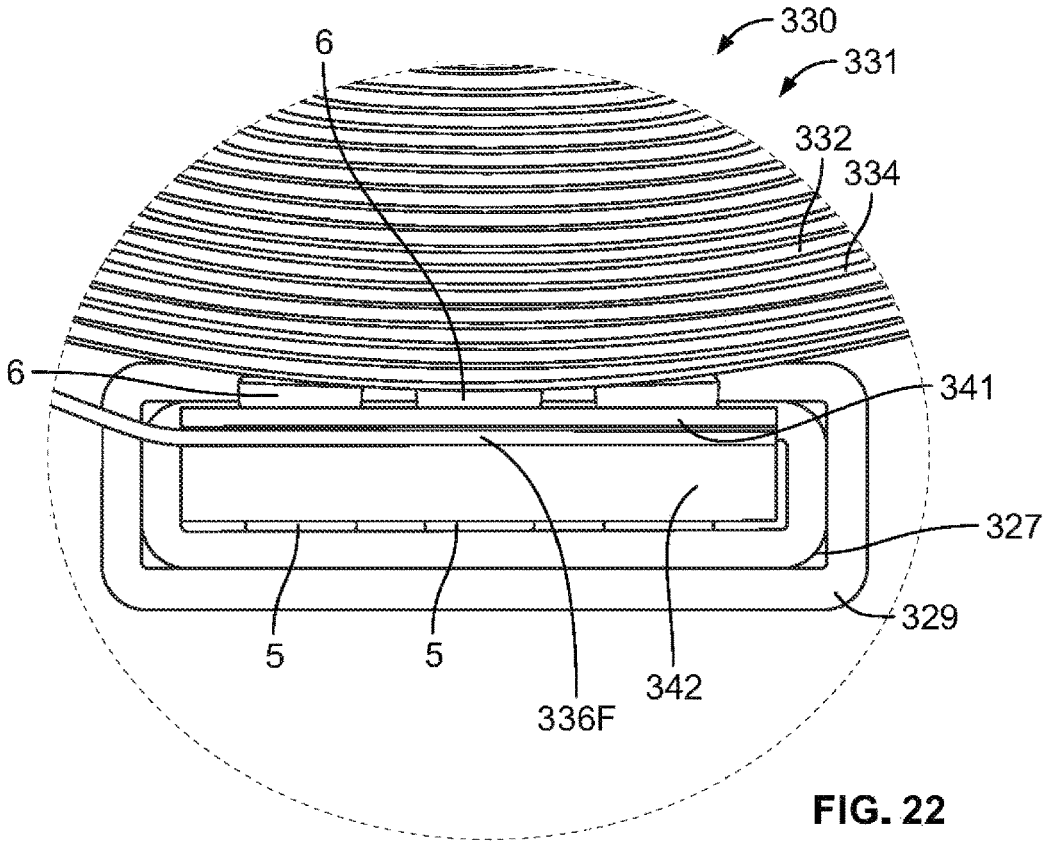
FIG. 22 is an enlarged, fragmentary, end view of the coil assembly of FIG. 19.
Figure 23:
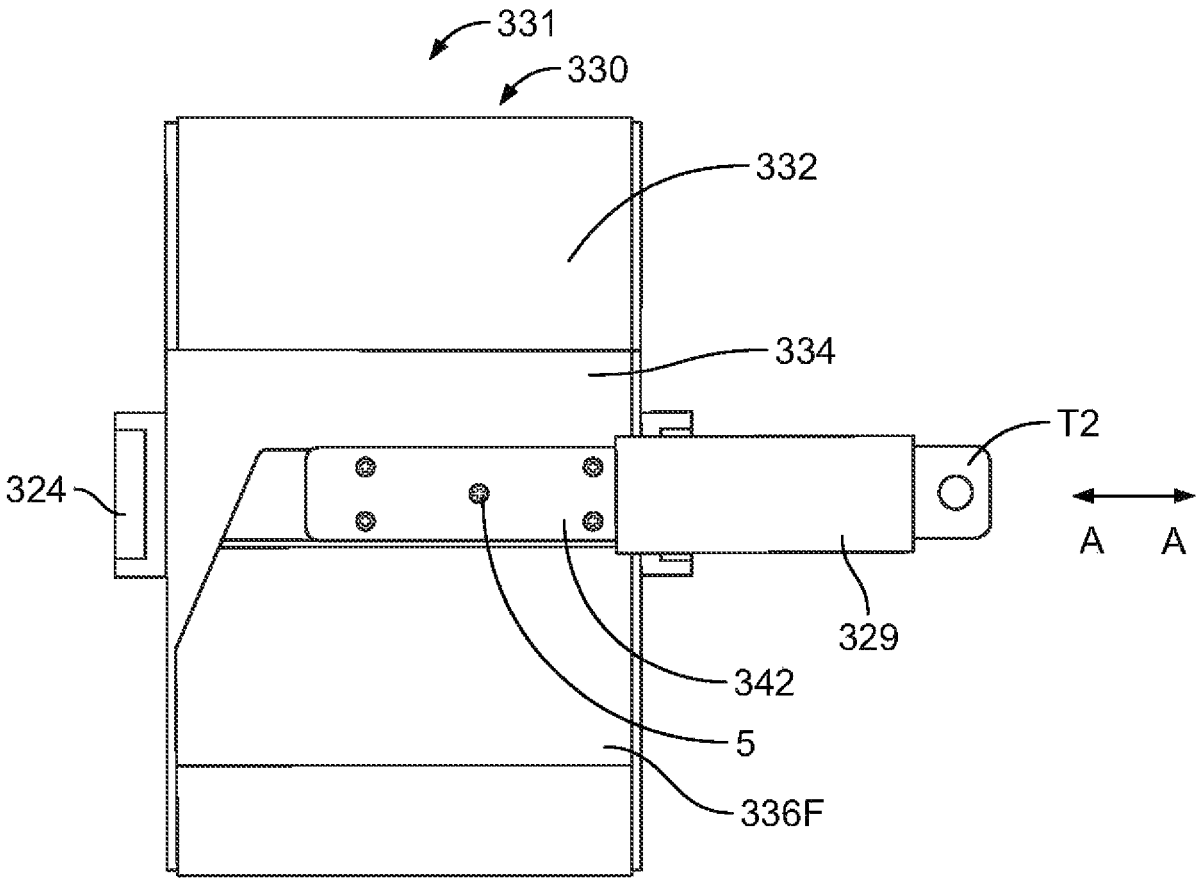
FIG. 23 is a side view of the coil assembly of FIG. 19.

The coil assemblies 331, 351 are constructed in the same manner as the coil assemblies 131, 151 except in the configuration of their terminal bus bars 340, 342, 360, 362. With reference to FIG. 21, the terminal bus bar 340 is connected to the innermost winding 336E of the coil 330 and has a terminal leg T1 extending through an opening 316 in the end plate 312A. With reference to FIG. 22, the terminal bus bar 342 is connected to the outermost winding 336F of the coil 330 and has a terminal leg T2 extending through the other opening 316 in the end plate 312A. The terminal bus bar 360 is connected to the innermost winding of the coil 350 and has a terminal leg T3 extending through an opening 316 in the end plate 312B. The terminal bus bar 362 is connected to the outermost winding of the coil 350 and has a terminal leg T4 extending through the other opening 316 in the end plate 312B. Each terminal leg T1, T2, T3, T4 is covered by an insulation tube 329 that extends through the respective opening 316. Each terminal leg T1, T2, T3, T4 may further be covered by an inner insulation tube 327 within the insulation tube 329. The insulation tube 327 may be formed of the same material as described for the insulation tube 129.

FIGS. 19-23 show the coil assembly 331 in more detail. The coil assembly 351 is constructed in the same manner as the coil assembly 331. As can be seen in FIGS. 19-23, the coil 330 includes a foil 332, an insulator sheet 334, clamp plates 341, and fasteners 5, 6 corresponding to and assembled in the same manner as the components 132, 134, 141, 5 and 6, respectively, of the coil assembly 131. The end of the innermost winding 336E of the foil 332 is mechanically secured in electrical contact with the terminal bus bar 340 by a clamp plate 341A and fasteners 5, 6. The bus bar 340, clamp plate 341A and winding 336E may be received in a slot in the fitting 324 as illustrated. The end of the outermost winding 336F of the foil 332 is mechanically secured in electrical contact with the terminal bus bar 342 by a clamp plate 341 and fasteners 5, 6.

Figure 16:
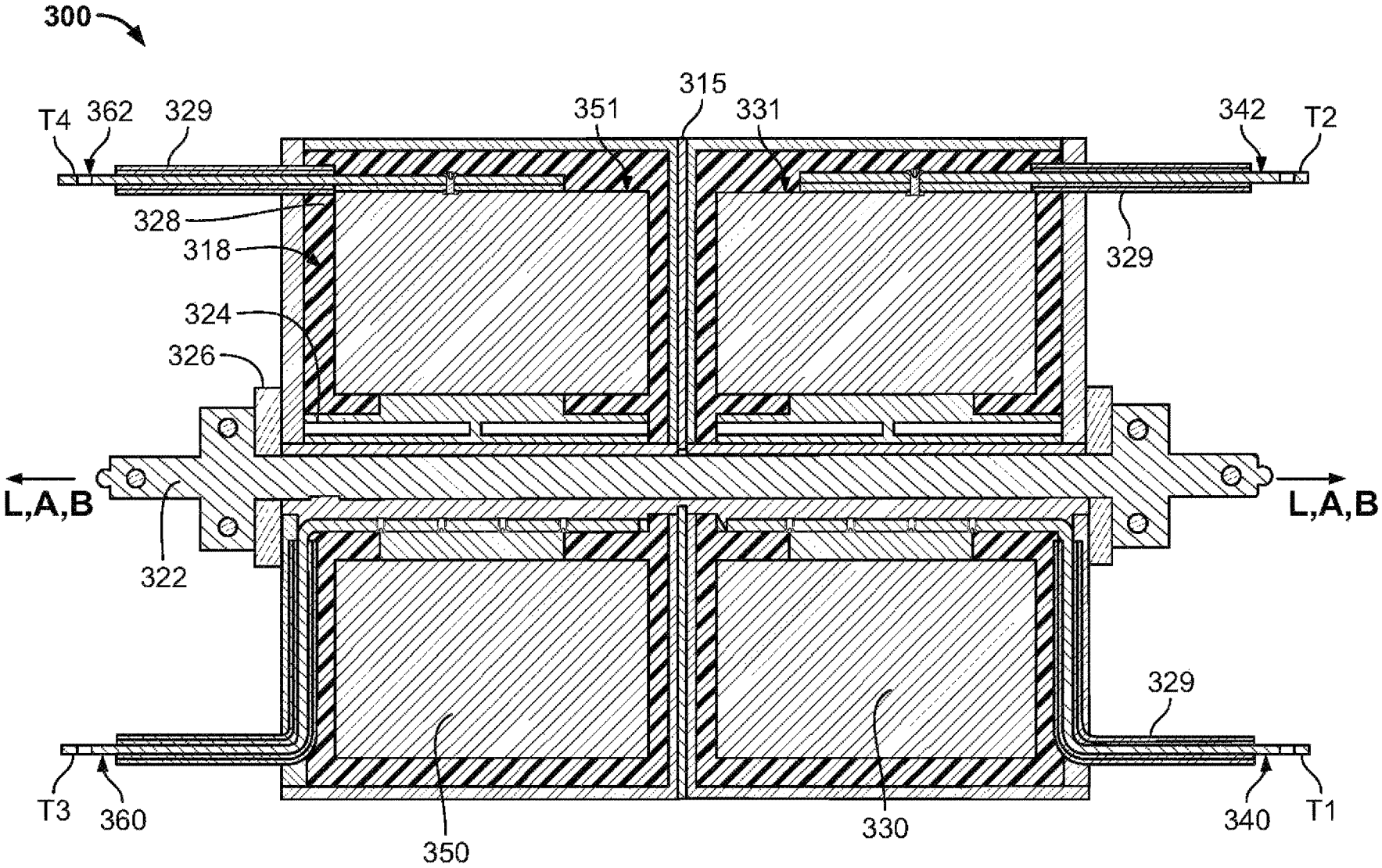
FIG. 16 is a cross-sectional view of the inductor assembly of FIG. 15 taken along the line 16-16 of FIG. 15.
Figure 17:
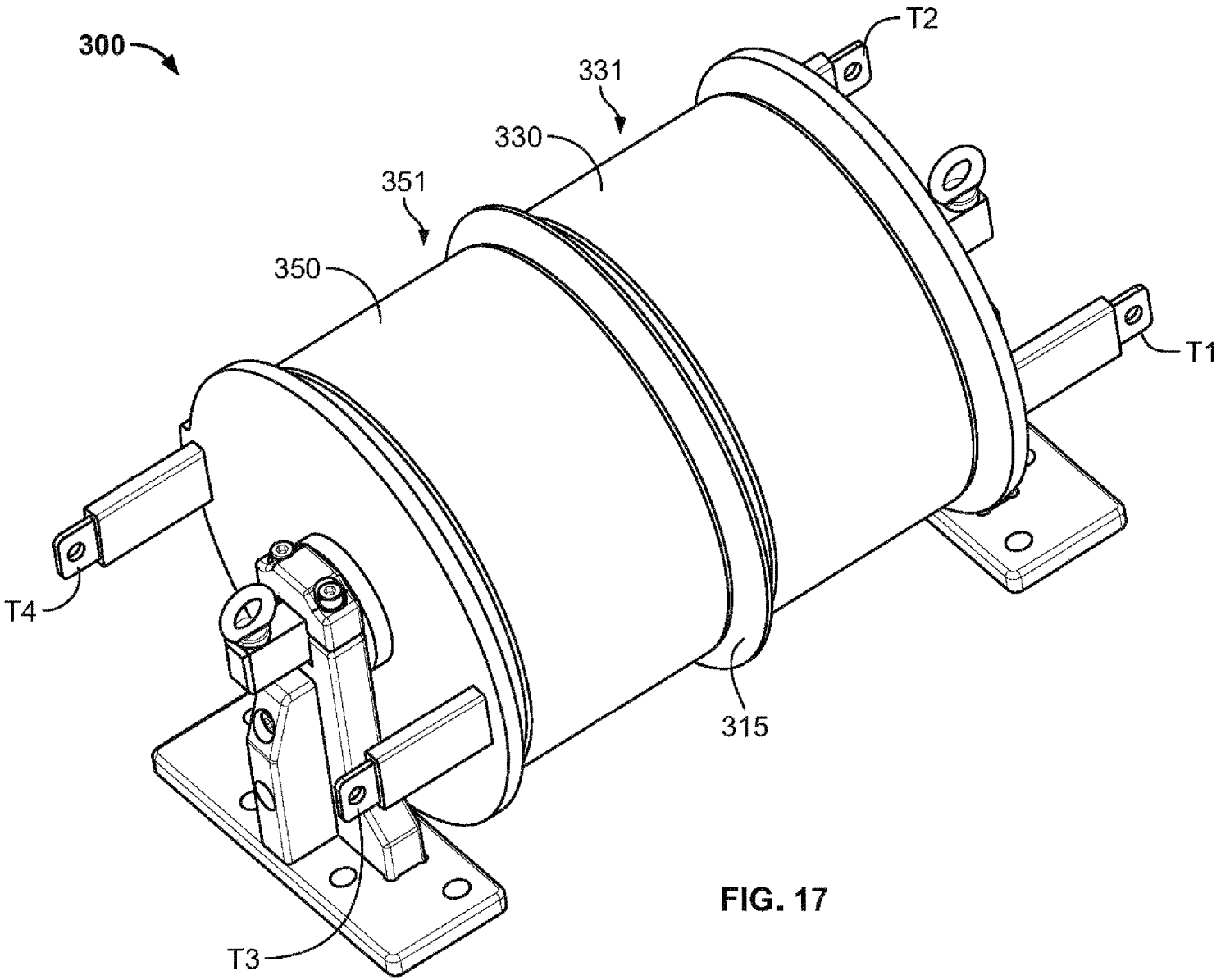
FIG. 17 is a perspective view of the inductor assembly of FIG. 15 wherein shells of the inductor assembly are removed for the purpose of explanation.
Figure 18:
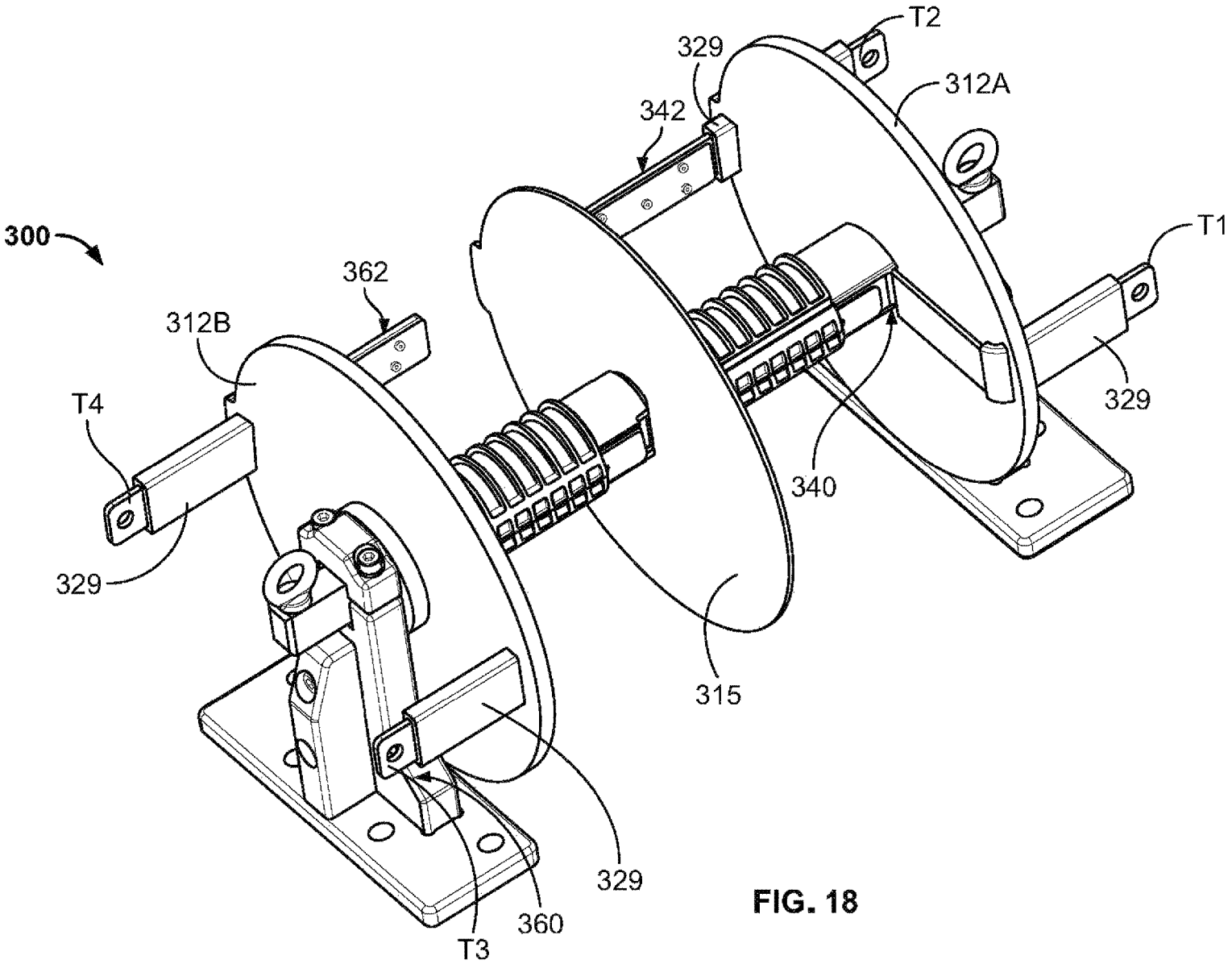
FIG. 18 is a perspective view of the inductor assembly of FIG. 15 wherein the shells, potting and coils of the inductor assembly are removed for the purpose of explanation.
Figure 19:
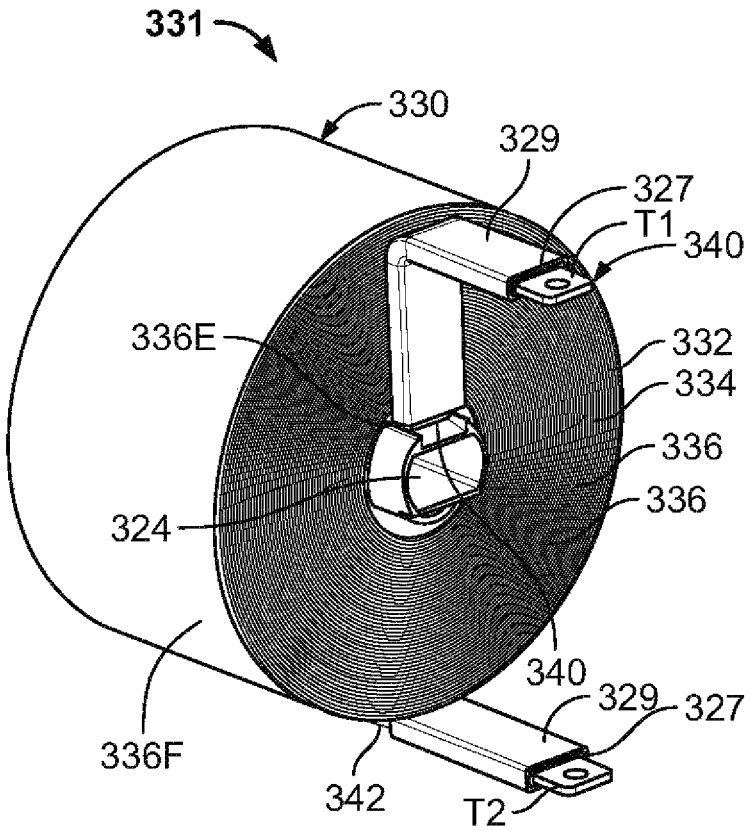
FIG. 19 is a perspective view of a coil assembly forming a part of the inductor assembly of FIG. 15.
Figure 20:
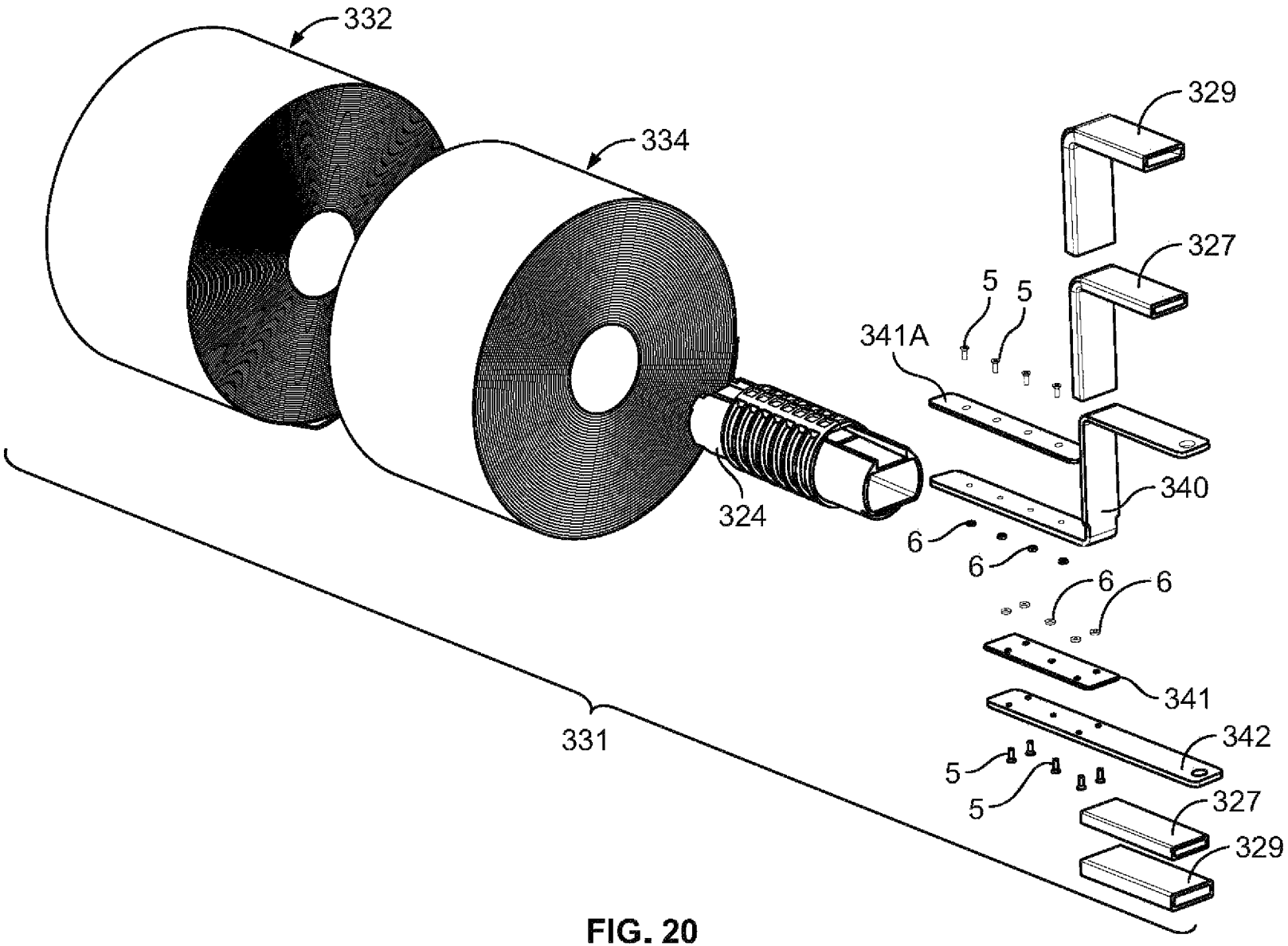
FIG. 20 is an exploded, perspective view of the coil assembly of FIG. 19.

As will be appreciated from FIG. 16, the dual coil inductor assembly 300 has a longitudinal axis L-L, the coil 330 has a coil axis A-A, and the coil 350 has a coil axis B-B. The coil axes A-A, B-B are substantially parallel with and, in some embodiments, substantially coaxial with, the axis L-L. In some embodiments, the coil axes A-A, B-B are substantially parallel with one another. The terminal legs T1, T2, T3, T4 each extend or project axially from an end 302A, 302B of the inductor assembly 300 in a direction along the axis L-L. In some embodiments, the terminal legs T1, T2, T3, T4 each extend along an axis that is substantially parallel with the axis L-L.

Thus, the input terminal T1 and the output terminal T2 of the coil 330 extend from the same end 302A of the unit 300. The input terminal T3 and the output terminal T4 of the coil 350 extend from the same opposing end 302B of the unit 300. This construction can enable the coils 330, 350 to be better insulated from one another because there is no terminal bus bar from one coil 330, 350 extending across the other coil 330, 350.

Figure 24:
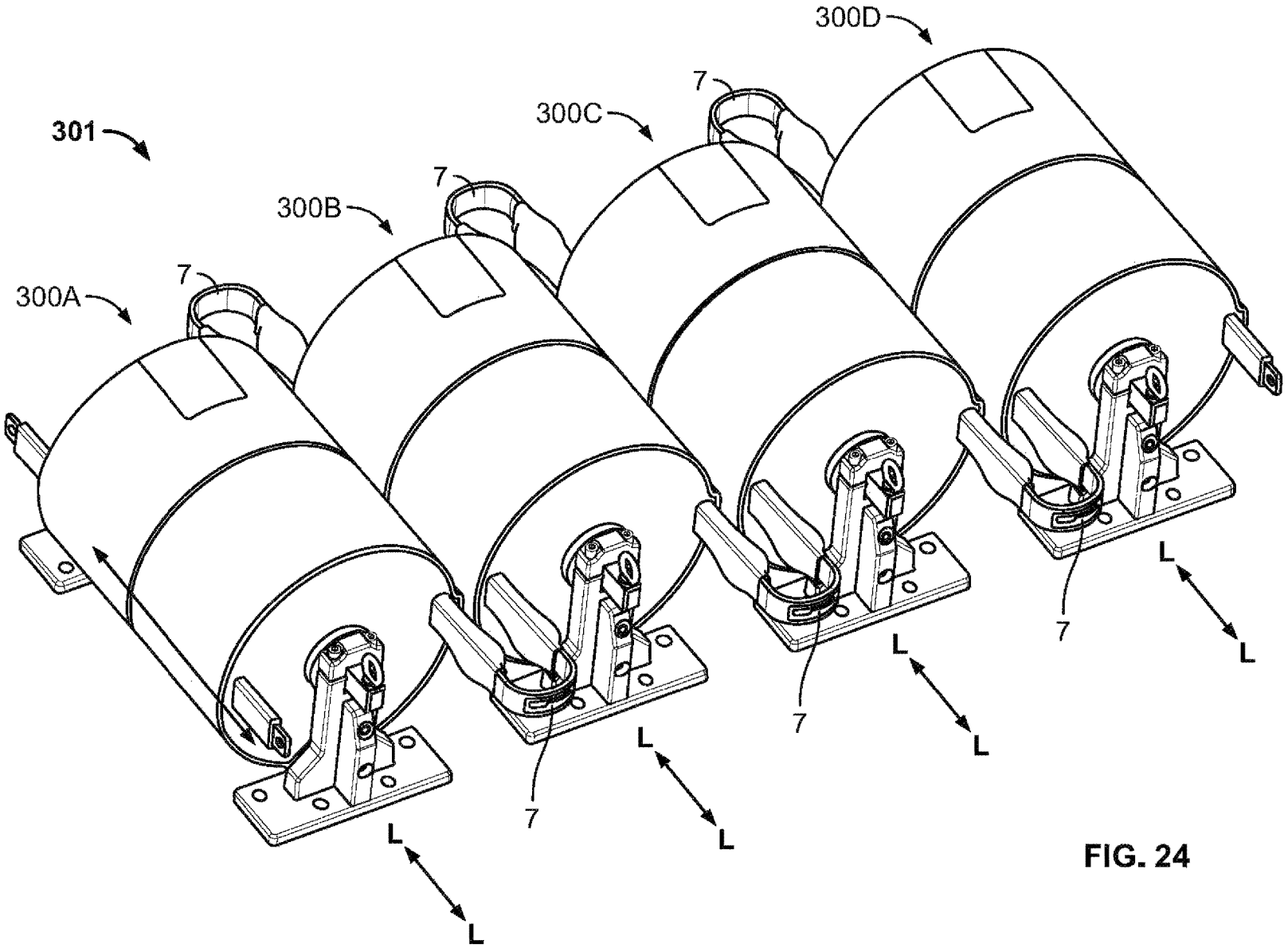
FIG. 24 is a perspective view of a multi-unit inductor system including a plurality of the inductor assemblies of FIG. 15.
Figure 26:
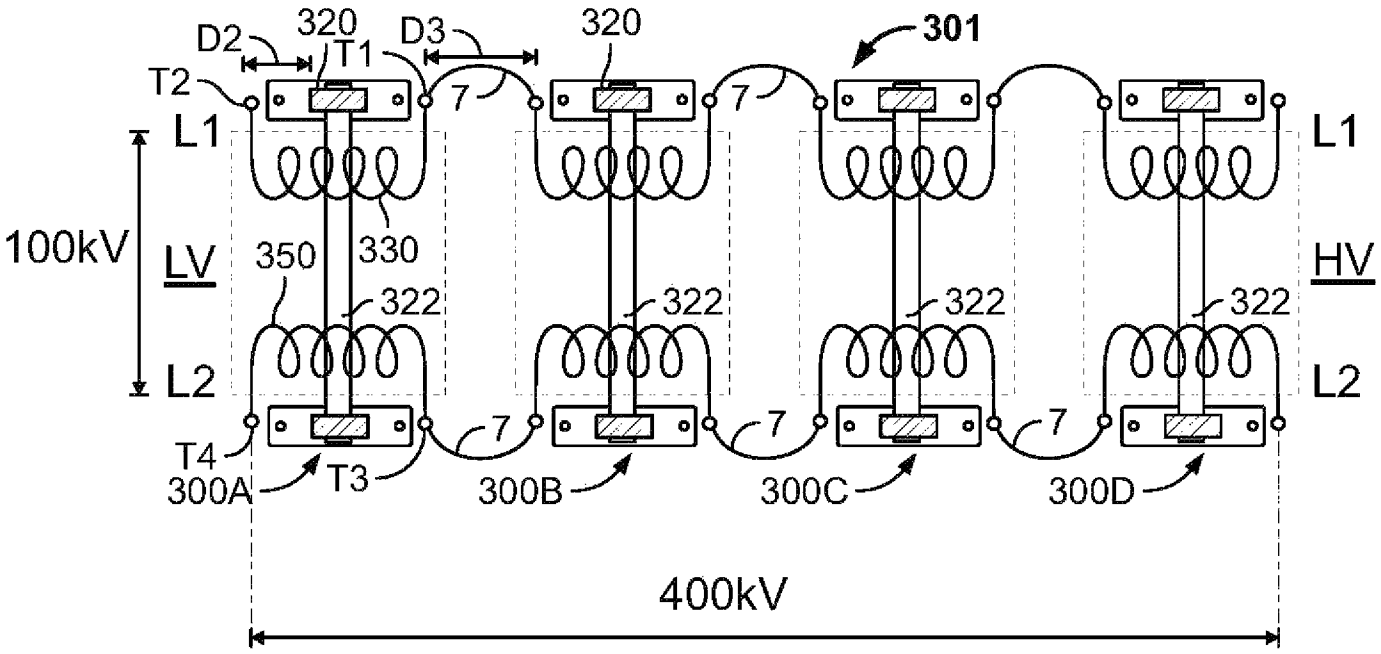
FIG. 26 is a schematic diagram of the multi-unit inductor system of FIG. 5.

The terminal configuration of the inductor assembly 300 also permits the assembly of a multi-unit inductor system 301 as shown in FIGS. 24 and 26, for example. The system 301 includes a plurality (as shown, four) of dual coil inductor assemblies 300A-D (each constructed as described for the assembly 300) in a relatively compact side-by-side arrangement. The inductor coils 330 of the inductor assemblies 300A-D are connected to the line L1 and to one another in series by connecting conductors 7 (e.g., metal cables). The inductor coils 350 of the inductor assemblies 300A-D are connected to the line L2 and to one another in series by connecting conductors 7 (e.g., metal cables).

In the system 301, the longitudinal axes L-L of the inductor assemblies 300A-D extend non-coaxially to one another. That is, the respective longitudinal axes L-L of the inductor assemblies 300A-D extend (as shown) substantially parallel to one another but laterally displaced from one other, or may extend transversely to one another.

Figure 25:
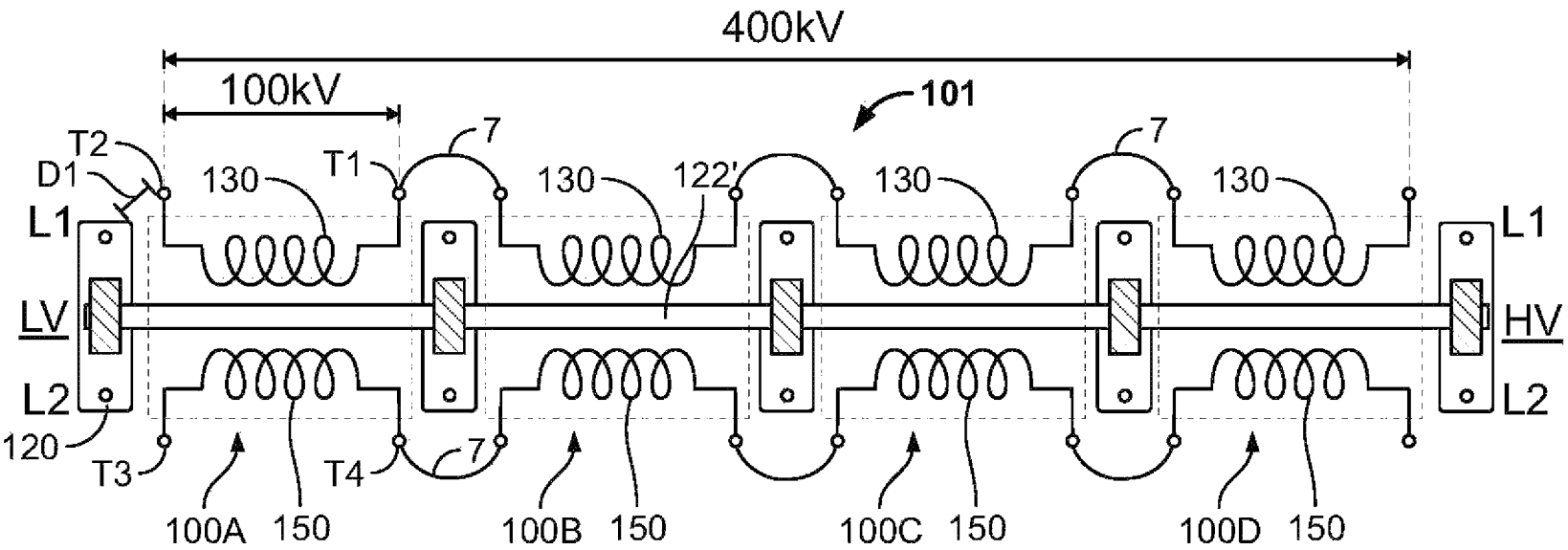
FIG. 25 is a schematic diagram a multi-unit inductor system including a plurality of the inductor assemblies of FIG. 1.

The configuration of the system 301 avoids a coaxial configuration of inductor assemblies 100A-D as shown in the inductor system 101 of FIG. 25, for example, wherein a common central metal post 122' supports each of the coils 130, 150 of the multiple inductor assemblies 100A-D. In the system 101, the dielectric withstand voltage of the system 101 may be limited by the distance D1 between each terminal T1, T2, T3, T4 and the adjacent base 120. In the event of a lightning strike or other surge event, the induced voltage on the coil terminals due to the high di/dt will result into a flashover; as a result the current may flash over from a terminal T1-T4 to the adjacent base 120, and from the base 120 the current can conduct through the central metal post 122' to the high voltage HV side of the circuit, thereby short circuiting around the coils 130, 150 of the downstream inductor assemblies 100A-D. That is, the overall dielectric withstand voltage of the system 101 is reduced because the voltage potential between the ends LV, HV of the circuit are bridged by the central metal post 122'.

By contrast and with reference to FIG. 26, in the system 301, current from a lightning surge or other surge event may still flash over, due to induced lightning impulse voltage from the high di/di, from a terminal T1, T2, T3, T4 to the adjacent base 320 across a distance D2. However, in order for the current to conduct to the next inductor assembly 300B-D, the current must flash over a distance D3 from the base 320 of the first inductor assembly 300A to the base 320 of the inductor assembly 300B. The distances between the bases 320 of the adjacent inductor assemblies 300A-D can be chosen to provide an increased and sufficient dielectric withstand voltage between the inductor assemblies 300A-D and for the system 301 overall. In this way, a high amount of electrical insulation between the inductor assemblies 300A-D is achieved. As a result, the overall lightning impulse overvoltage of the overall system 301 from the LV side to the HV side is maintained. For example, if the Lightning Impulse breakdown voltage of each inductor assembly 300A-D is 100 kV, then the overall Lightning Impulse breakdown voltage of the system 301 will be 400 kV. This can be accomplished while retaining an electrically conductive metal support shaft 322 in each inductor assembly 300A-D. A metal support shaft 322 may be desirable to provide improved strength, thermal conductive, resistance to thermal damage (e.g., melting), and ease and flexibility in fabrication.

The partition bushing 315 can electrically insulate the coil assemblies 331, 351 from one another. The partition bushing 315 can serve to take up manufacturing tolerances in the inductor assembly 300, thereby reducing vibration. The partition bushing 315 can also serve to damp or absorb forces (e.g., vibration) applied to the inductor assembly 300. The partition bushing 315 can also resiliently and temporarily take up expansion of the inductor assembly 300 caused by heating of the coils 330, 350.

Figure 27:
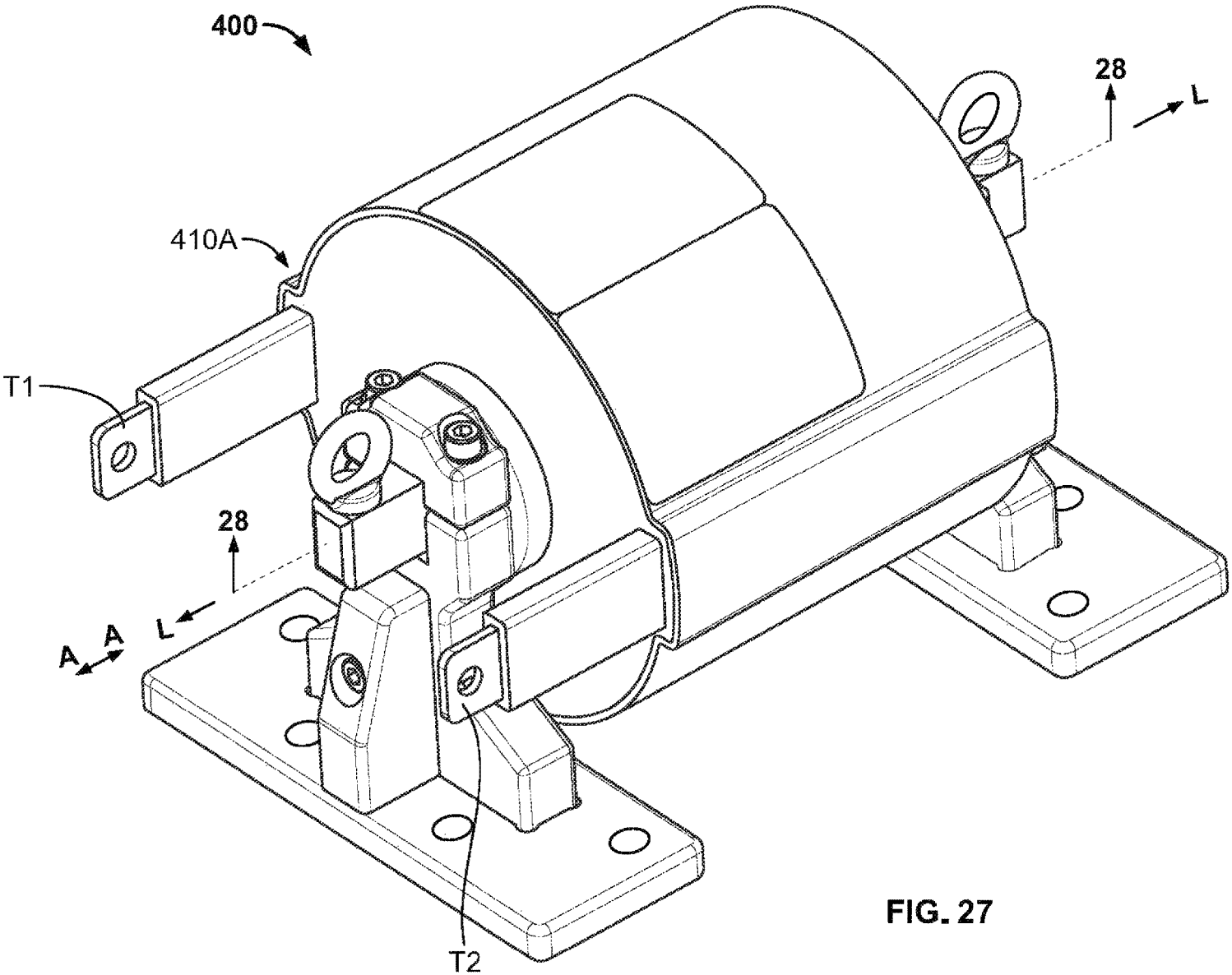
FIG. 27 is a perspective view of an inductor assembly according to further embodiments of the invention.
Figure 28:
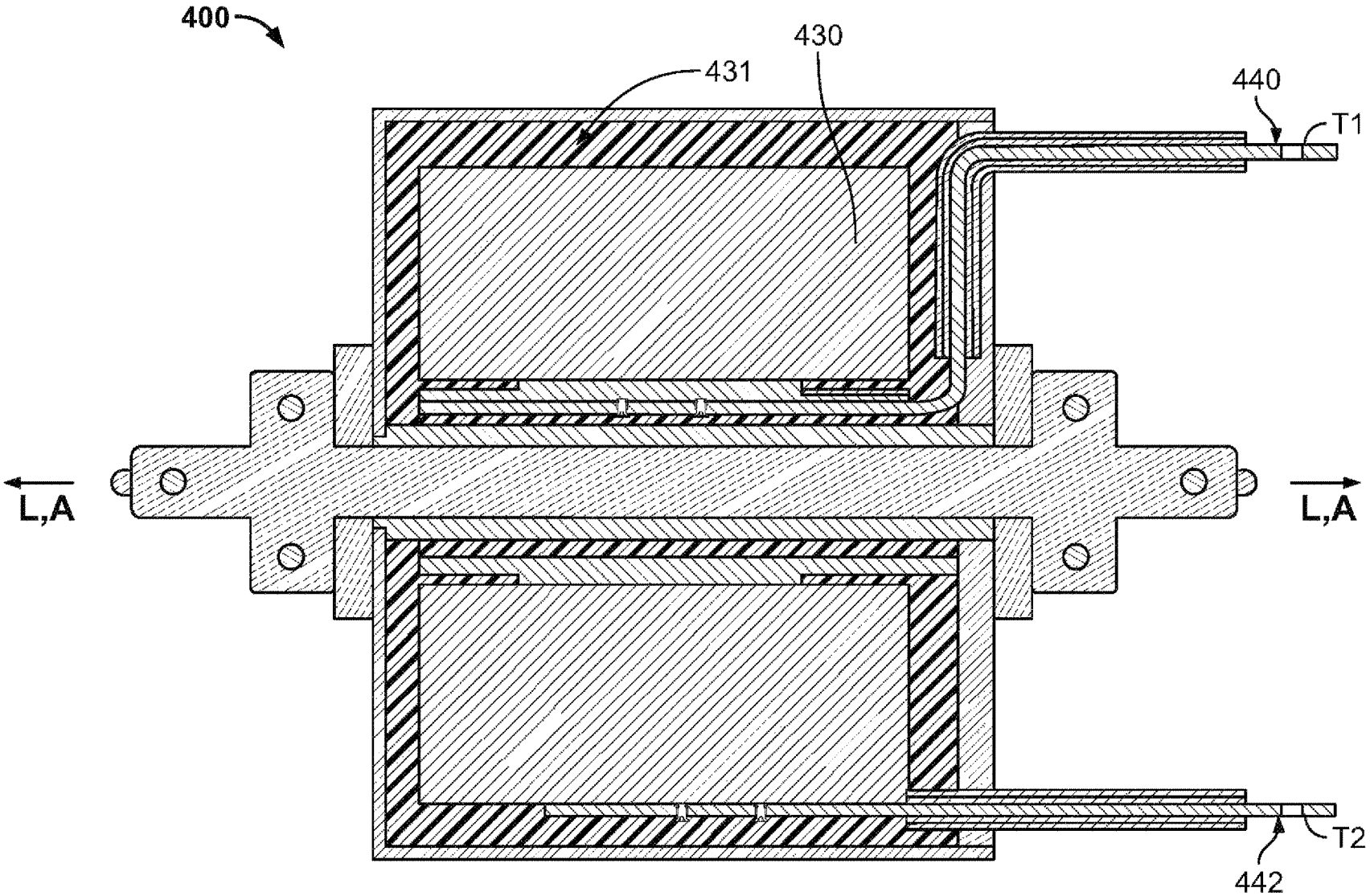
FIG. 28 is a cross-sectional view of the inductor assembly of FIG. 27 taken along the line 28-28 of FIG. 27.
Figure 29:
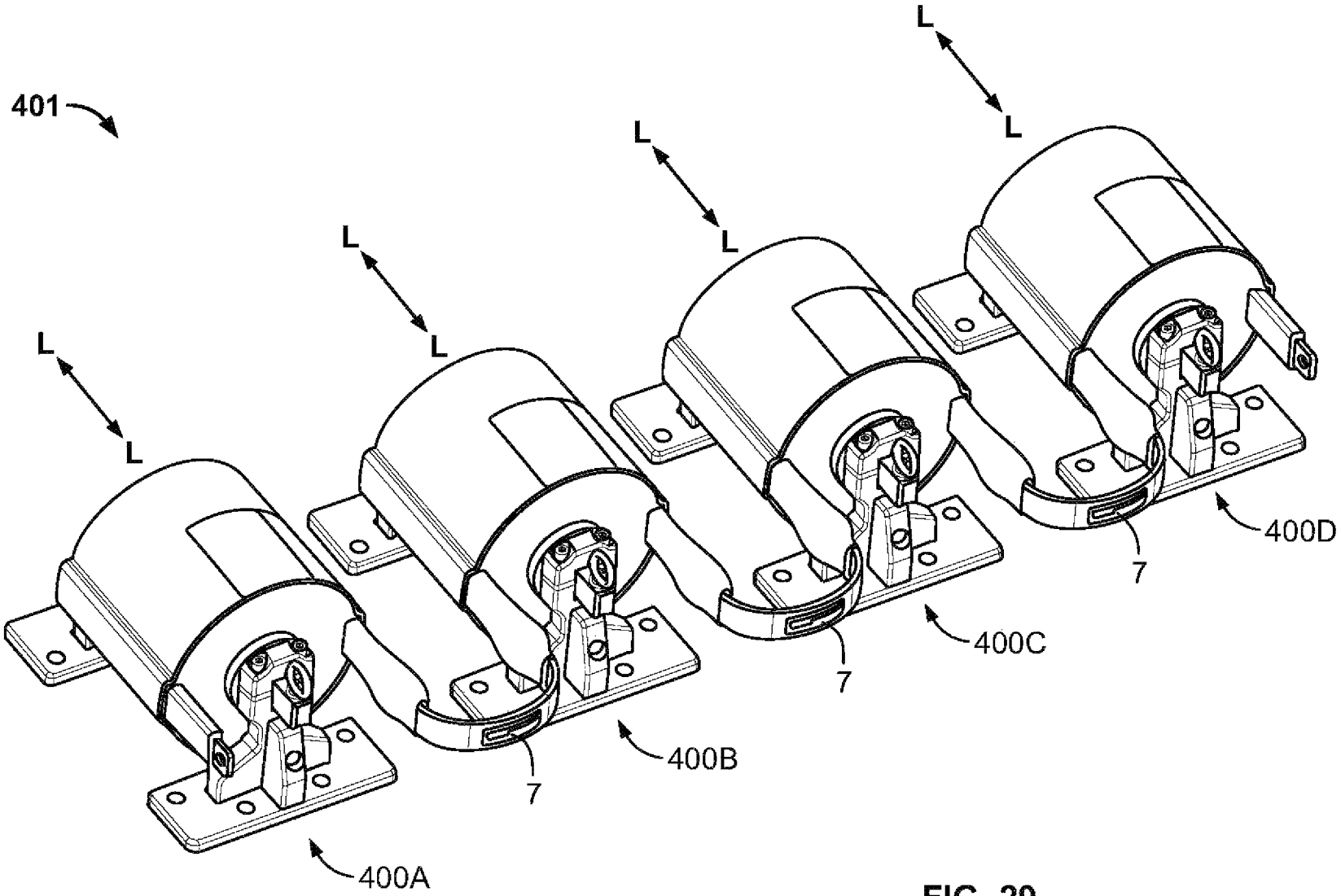
FIG. 29 is a perspective view of a multi-unit inductor system including a plurality of the inductor assemblies of FIG. 27.
Figure 30:
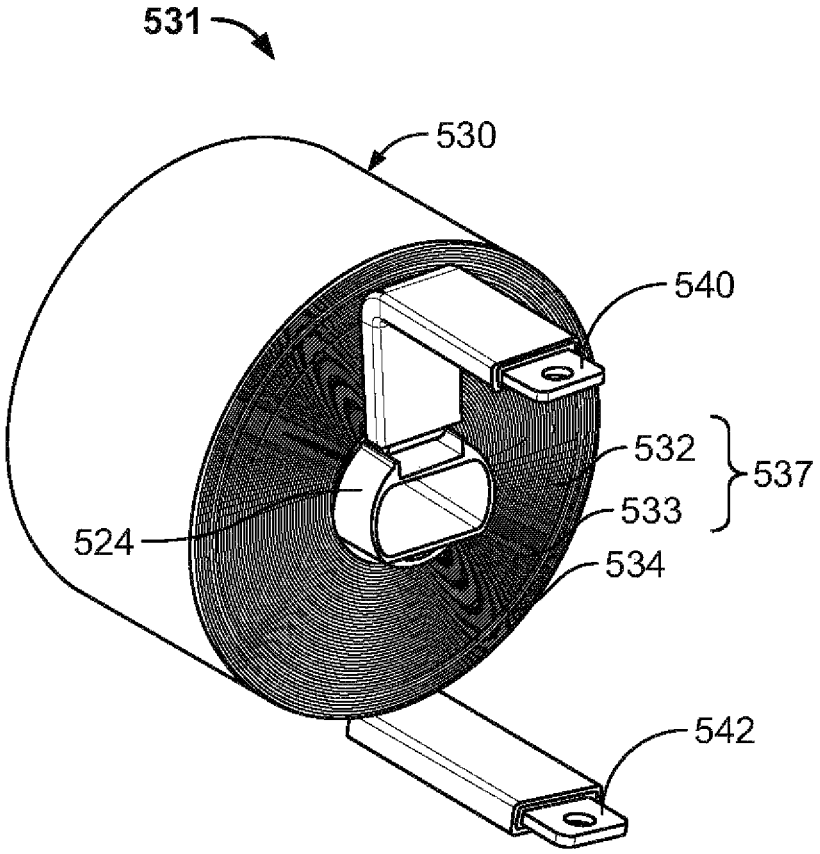
FIG. 30 is a perspective view of a coil assembly according to further embodiments of the invention.
Figure 31:
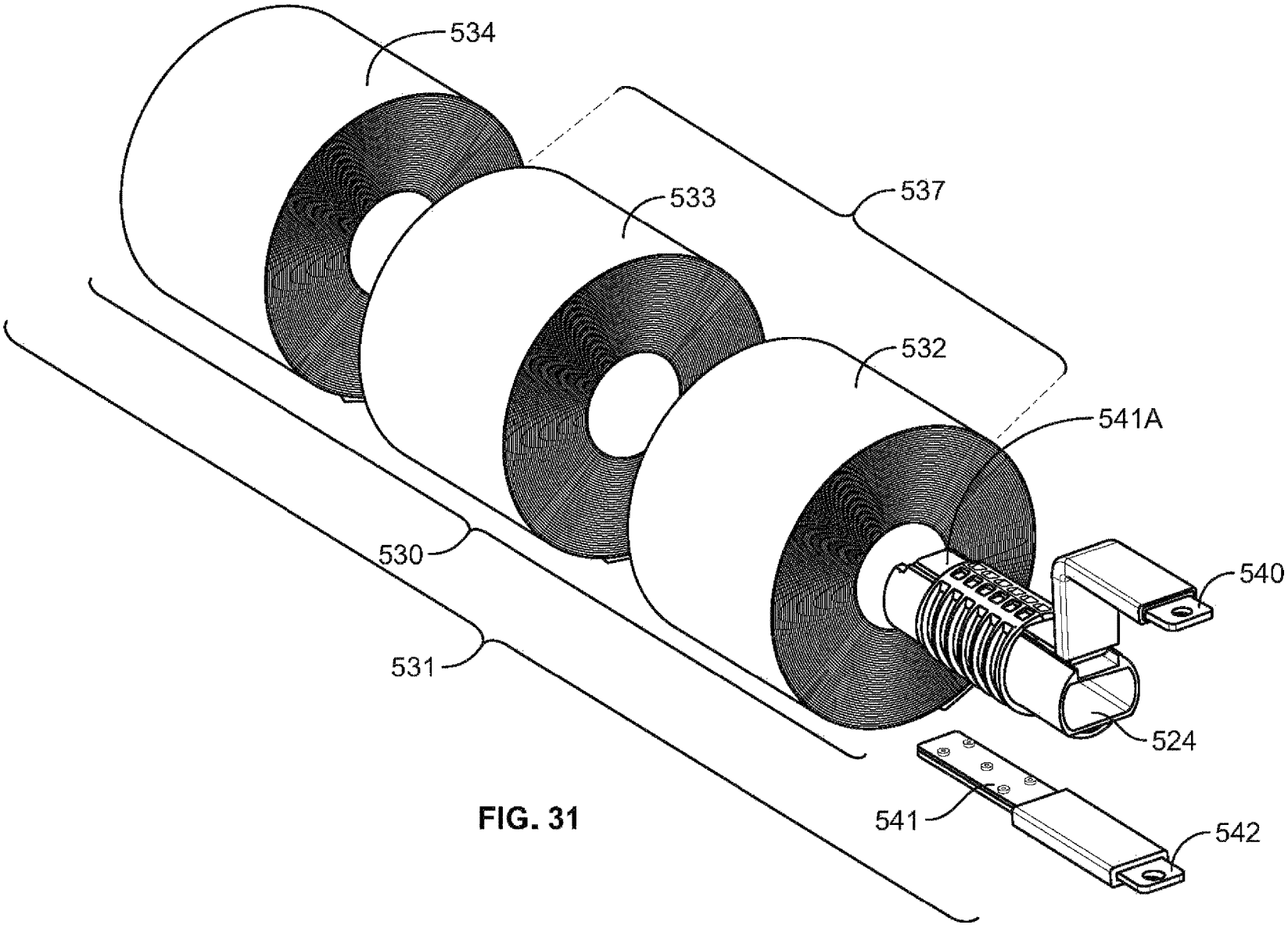
FIG. 31 is an exploded, perspective view of the coil assembly of FIG. 30.
Figure 32:
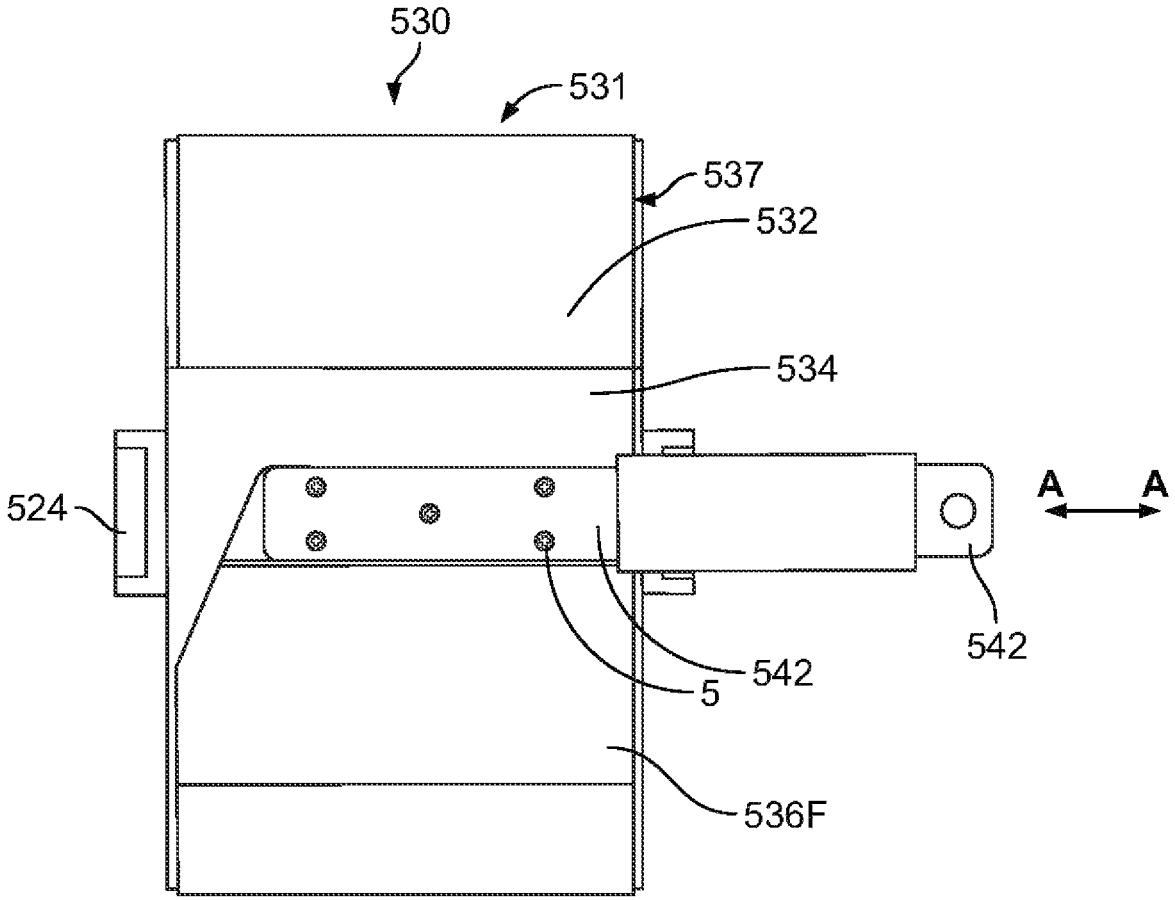
FIG. 32 is a side view of the coil assembly of FIG. 30.
Figure 33:
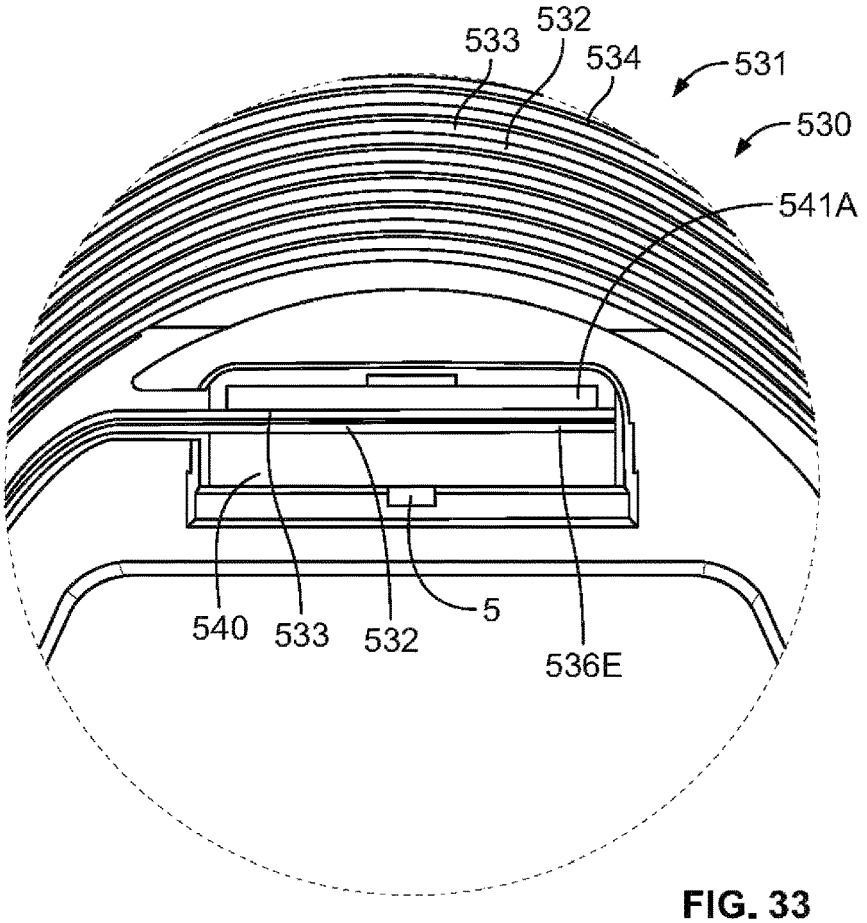
FIG. 33 is an enlarged, fragmentary, end view of the coil assembly of FIG. 30.
Figure 34:
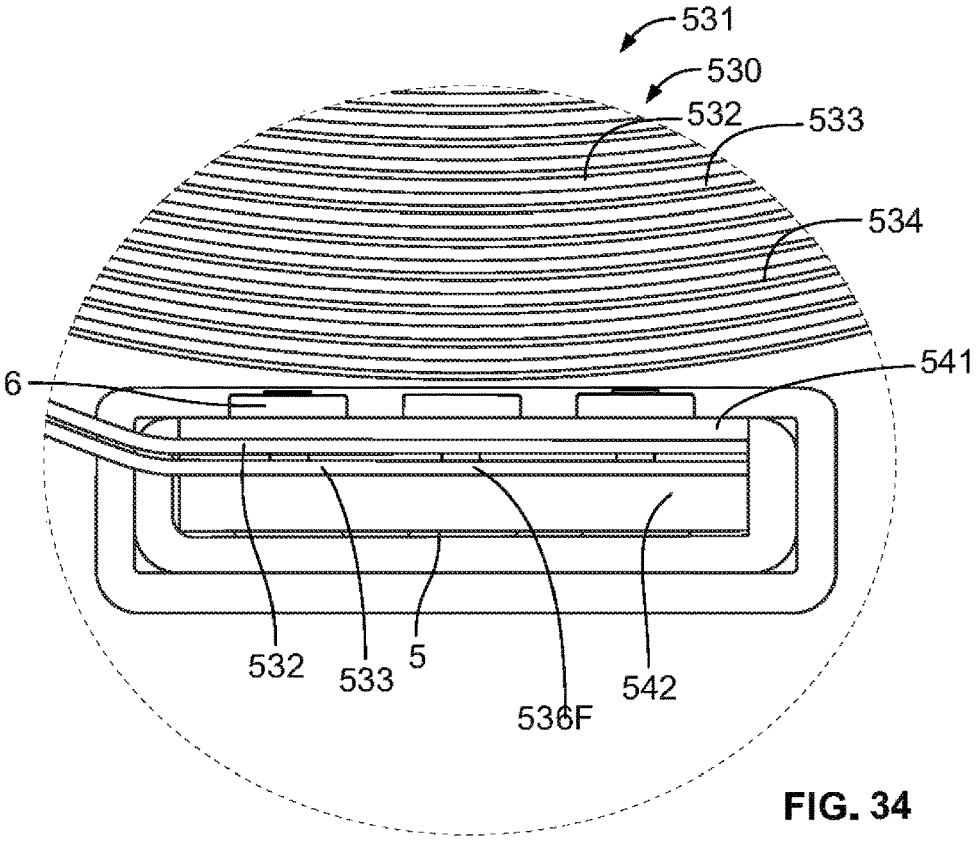
FIG. 34 is an enlarged, fragmentary, end view of the coil assembly of FIG. 30.

FIGS. 27-29 show an inductor assembly 400 according to further embodiments of the invention. The inductor assembly 400 is constructed similarly to the inductor assembly 300 but includes only a single coil assembly 431. The coil assembly 431 includes a coil 430 and terminal bus bars 440, 442 corresponding to and constructed in same manner as described for the coil assembly 131, the coil 130 and the terminal bus bars 140, 142. The terminal bus bars 440, 442 have terminal legs T1 and T2 corresponding to the terminal legs T1 and T2 of the inductor assembly 300.

The inductor assembly 400 has a longitudinal axis L-L and the coil 430 has a coil axis A-A. The coil axis A-A is substantially parallel with and, in some embodiments, substantially coaxial with, the axis L-L. The terminal legs T1, T2 each extend or project axially from the end 410A of the inductor assembly 400 in a direction along the axis L-L. In some embodiments, the terminal legs T1, T2 each extend along an axis that is substantially parallel with the axis L-L. Thus, the input terminal T1 and the output terminal T2 of the coil 430 extend from the same end 402B of the unit 400 as discussed above with regard to the inductor assembly 300.

A plurality of the inductor assemblies 300 can be assembled into a multi-unit inductor system 401 as shown in FIG. 29, for example. The system 401 includes a plurality (as shown, four) of inductor assemblies 400A-D (each constructed as described for the assembly 400) in a relatively compact side-by-side arrangement. The inductor coils 430 of the inductor assemblies 400A-D are connected to the line L1 and to one another in series by connecting conductors 7 (e.g., metal cables).

In the system 401, the longitudinal axes L-L of the inductor assemblies 400A-D extend non-coaxially to one another. That is, the respective longitudinal axes L-L of the inductor assemblies 400A-D extend (as shown) substantially parallel to one another but laterally displaced from one other, or may extend transversely to one another. This configuration can thus provide the advantages discussed above with regard to the inductor assembly 300.

With reference to FIGS. 31-34, a coil assembly 531 according to further embodiments is shown therein. The coil assembly 531 can be used in place of any of the coil assemblies 131, 151, 231, 331, 351, 431. The coil assembly 531 is constructed and operates in the same manner as the coil assembly 331, except at follows.

The coil assembly 331 includes a coil 530 that differs from the coil 330 as discussed below. The coil assembly 531 also includes terminal busbars 540, 542, clamp plates 341, and fasteners 5, 6 corresponding to and assembled in the same manner as the components, 340, 342, 341, 5 and 6, respectively, of the coil assembly 331.

The coil 530 includes a first foil 532 and an insulator sheet 534 corresponding to the foil 332 and the insulator sheet 334. The coil 530 further includes a second conductor or foil 533. The first and second foils 532, 533 collectively form a multilayer electrical conductor 537. The foils 532, 533 may be formed of the same materials and in the same dimensions as described above for the foil 132.

The first foil 532, the second foil 533 and the insulator sheet 534 are spirally co-wound or wrapped about the coil axis A-A to form windings 536 with the second foil 533 interposed or sandwiched between the first foil 532 and insulator sheet 534. The windings 536 extend progressively from an innermost winding 536E of the multilayer conductor 537 (i.e., the conductor foils 532, 533) to an outermost winding 536F of the multilayer conductor 537 (i.e., the conductor foils 532, 533) on the outer diameter of the coil 530. Each winding 536 is radially superimposed on, stacked on, or wrapped around the preceding winding 536. The foils 532, 533 may be wound tightly in fact to face electrical contact with one another.

Each of the conductor foils 532, 533 has opposed side edges that are axially spaced apart along the coil axis A-A and extend substantially parallel to one another. The conductor foils 532, 533 are spirally wound such that each side edge remains substantially in or proximate a single lateral plane (i.e., corresponding to planes E-E of FIG. 7) throughout the coil 530 from the winding 536E to the winding 536F. That is, the multilayer conductor 537 and the conductor foils 532, 533 are maintained in alignment with themselves and are spirally, not helically, wound. In some embodiments, the conductor foils 532, 533 are substantially coextensive.

The end of the innermost winding 536E of the multilayer conductor (i.e., the ends of the foil 532 and the foil 533) is mechanically secured in electrical contact with the terminal bus bar 540 by the clamp plate 541A and fasteners 5, 6. The bus bar 540, clamp plate 541A and winding 536E may be received in a slot in the fitting 524 as illustrated. The end of the outermost winding 536F of the multilayer conductor (i.e., the ends of the foil 532 and the foil 533) is mechanically secured in electrical contact with the terminal bus bar 542 by the clamp plate 541 and fasteners 5, 6.

The multilayer conductor 537 has an increased cross-sectional area as compared to the foil 132 and thereby provides less electrical resistance for a conductor of the same length. As a result, the coil 530 (and thereby an inductor assembly incorporating the coil assembly 531) can be rated for a greater amperage and power.

For example, the two-phase inductor assembly 300 may be rated for 100 A for each line L1, L2 (with the load currents through L1 and L2). The PE inductor assembly 400 may be rated for 50 A (i.e., half the rating of the line inductor). In that case, the coils of the inductor assemblies 300, 400 each use a single conductor foil.

The parallel, superimposed conductor foils 532, 533 of the multilayer conductor 537 double the cross-sectional area of the coil conductor as compared to the single foil conductors of the inductor assemblies 300, 400. As a result, the two-phase inductor assembly incorporating the coil assembly 531 may be rated for 150 A for each line L1, L2, and the PE inductor assembly incorporating the coil assembly 531 may be rated for 75 A.

In some embodiments, the foil 532, the foil 533, and the insulator sheet 534 are not bonded to one another along their lengths prior to winding into the coil. That is, the foils 532, 533 and the sheet 534 are loosely co-wound and are not bonded or laminated to one another until after formation of the coil 530. In some embodiments, the foils 532, 533 and the insulator sheet 534 are not bonded to one another in the completed coil 130 except by the potting 528 at the ends of the coil 530. In this case, the layers, 532, 533, 534 are not bonded to one another across their widths. In some embodiments, the foils 532, 533 and the sheet 534 are tightly wound so that air gaps between the windings of the conductor foils 532, 533 are minimized or eliminated.

The multilayer conductor 537 provides advantages over using a thicker single foil for the coil conductor (e.g., two 0.8 mm foils 522, 533 instead of a single 1.6 mm foil 132) because a thicker single foil may be too thick to make the turns efficiently (i.e., without creating gaps in between the turns of the coil, etc.). The outer diameter of the coil 530 may be modestly increased as compared to the diameter of the coil 130 while maintaining the same coil length. On the other hand, if the conductor cross-section was increased by using the same thickness foil 132 (e.g., 0.8 mm) but doubling the width of the foil 132, then the coil footprint would be substantially double in length, which may require the inductor assembly to have an undesirable footprint.

With reference to FIGS. 35-48 show a combined dual coil inductor assembly 600 according to embodiments of the invention is shown therein. The inductor assembly 600 is constructed similarly to the inductor assemblies 100 and 300 but is configured such that two independent coils 630 and 650 are cowound and integrated into a single coil assembly 631.

Figure 35:
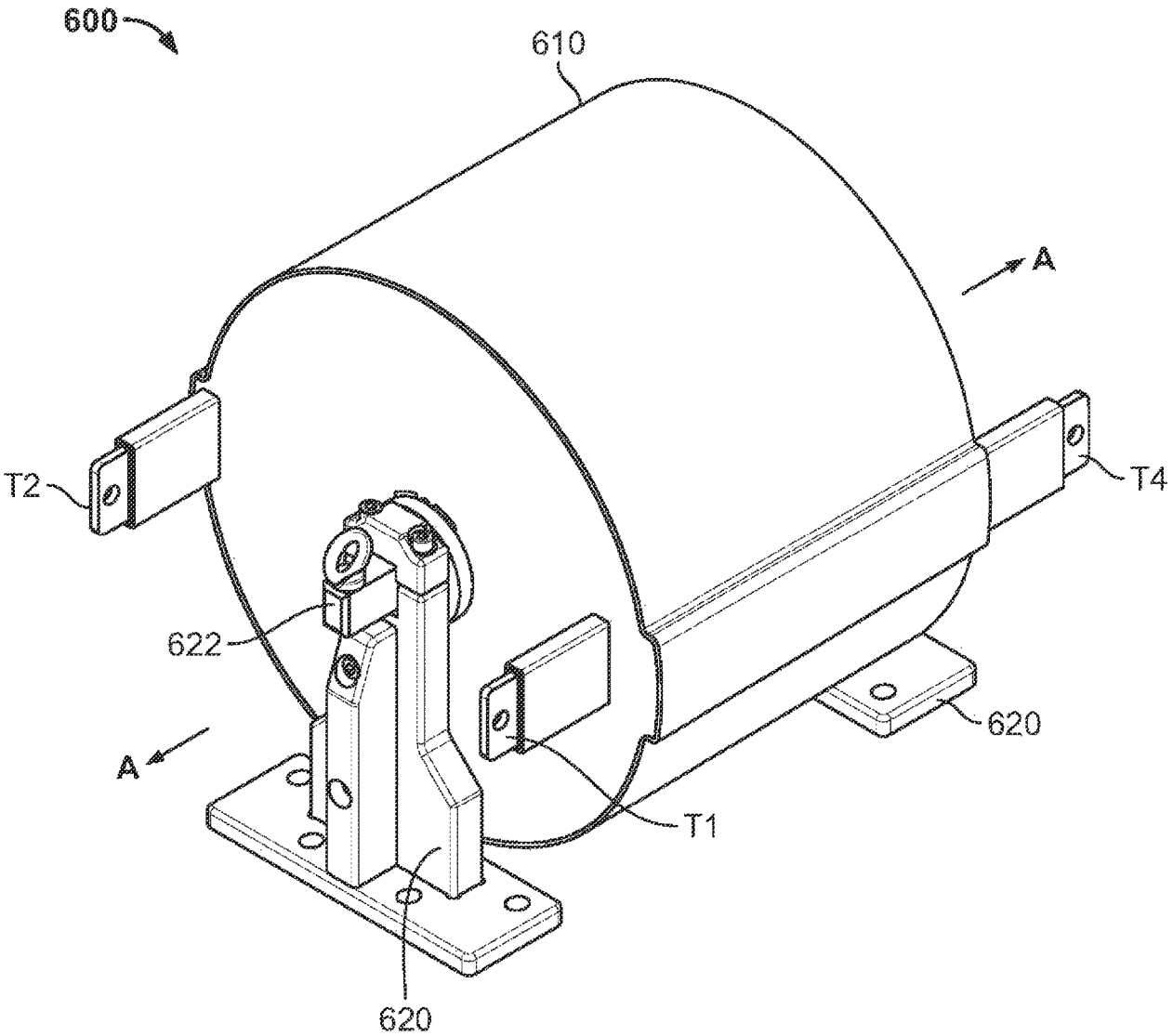
FIG. 35 is a top, perspective view of a dual coil inductor assembly according to further embodiments.
Figure 36:
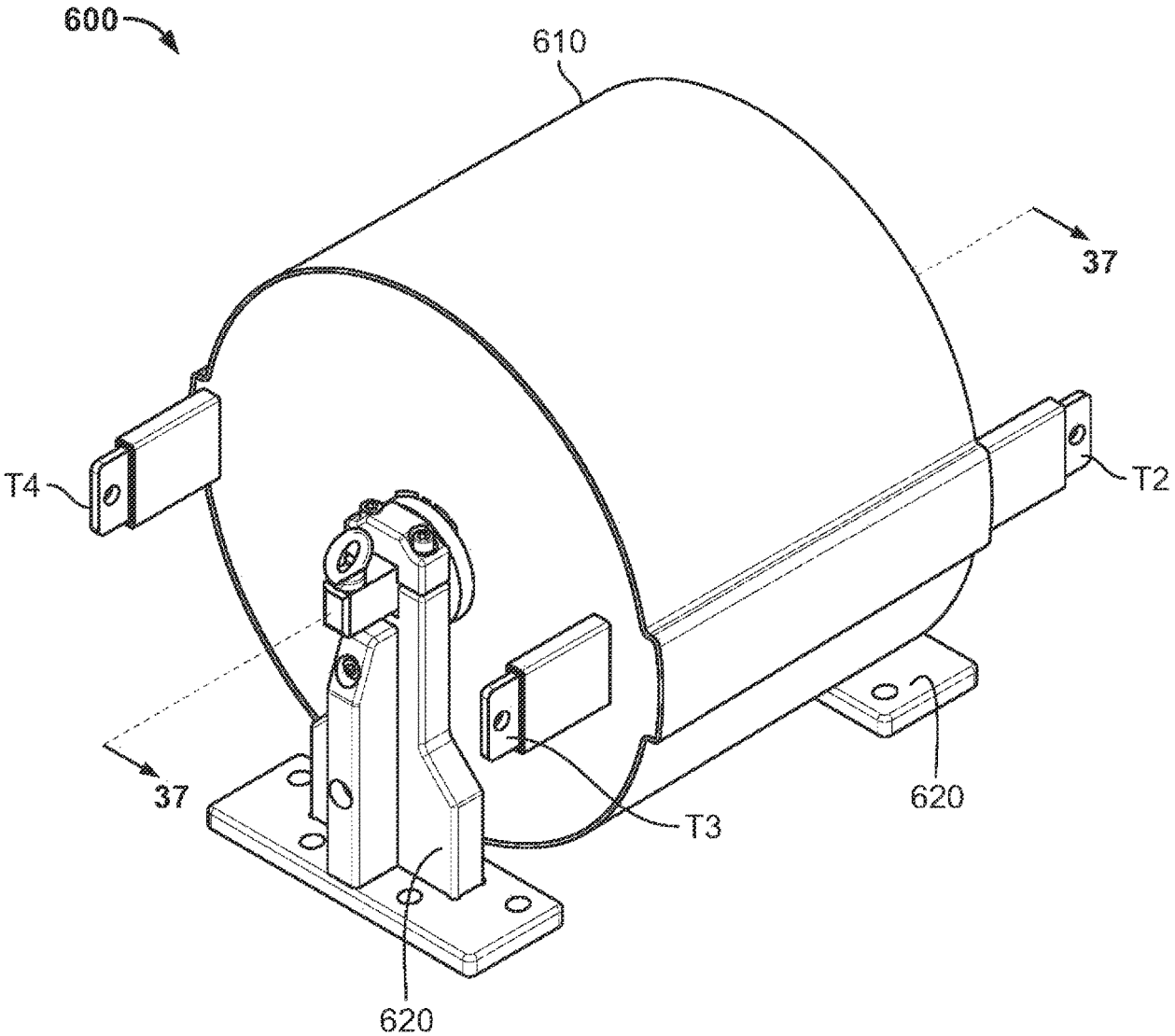
FIG. 36 is an opposing top, perspective view of the dual coil inductor assembly of FIG. 35.
Figure 37:
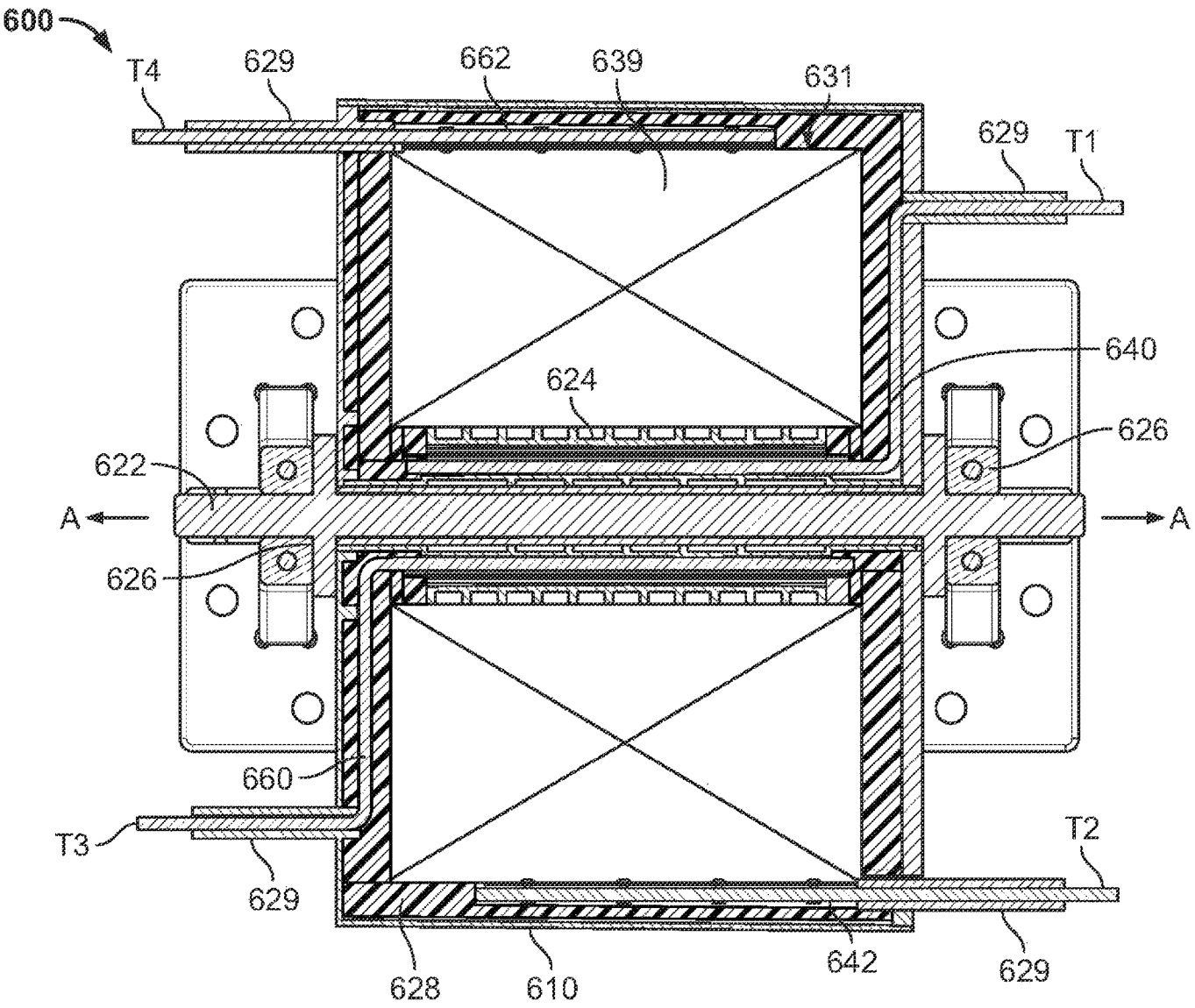
FIG. 37 is a cross-sectional view of the dual coil inductor assembly of FIG. 35 taken along the line 37-37 of FIG. 36.

With reference to FIGS. 35-37, the inductor assembly 600 includes an enclosure assembly 610, a pair of axially spaced apart support bases 620, a support shaft 622, an electrically insulating fitting 624, a pair of bushings 626, potting 628, and insulation sleeves or tubes 629 corresponding to the components 110, 120, 122, 124, 126, 128, and 129, respectively, except as shown and discussed. The inductor assembly 600 includes terminal legs T1, T2 extending from one axial end 602A of the inductor assembly 600, and terminal legs T3, T4 extending from the opposite axial end 602B of the inductor assembly 600. The dual coil assembly 631 is housed in the enclosure assembly 610 as described above.

With reference to FIGS. 38-41, the coil assembly 631 includes a first coil 630 and a second coil 650 that are combined to form a combined coil 639 as discussed below. The coil assembly 631 also includes terminal bus bars 640, 642, 660, 662, clamp plates 641, and fasteners 5, 6 (FIGS. 42-44) corresponding to the components, 340, 342, 360, 362, 341, 5 and 6, respectively, of the coil assembly 331.

The combined coil 639 includes a first foil 632, a second foil 652, a first insulator sheet 634, and a second insulator sheet 654. When spirally wound as discussed below and as shown, the first foil 632 forms the first coil 630. When spirally wound as discussed below and as shown, the second foil 652 forms the second coil 650.

Figure 38:
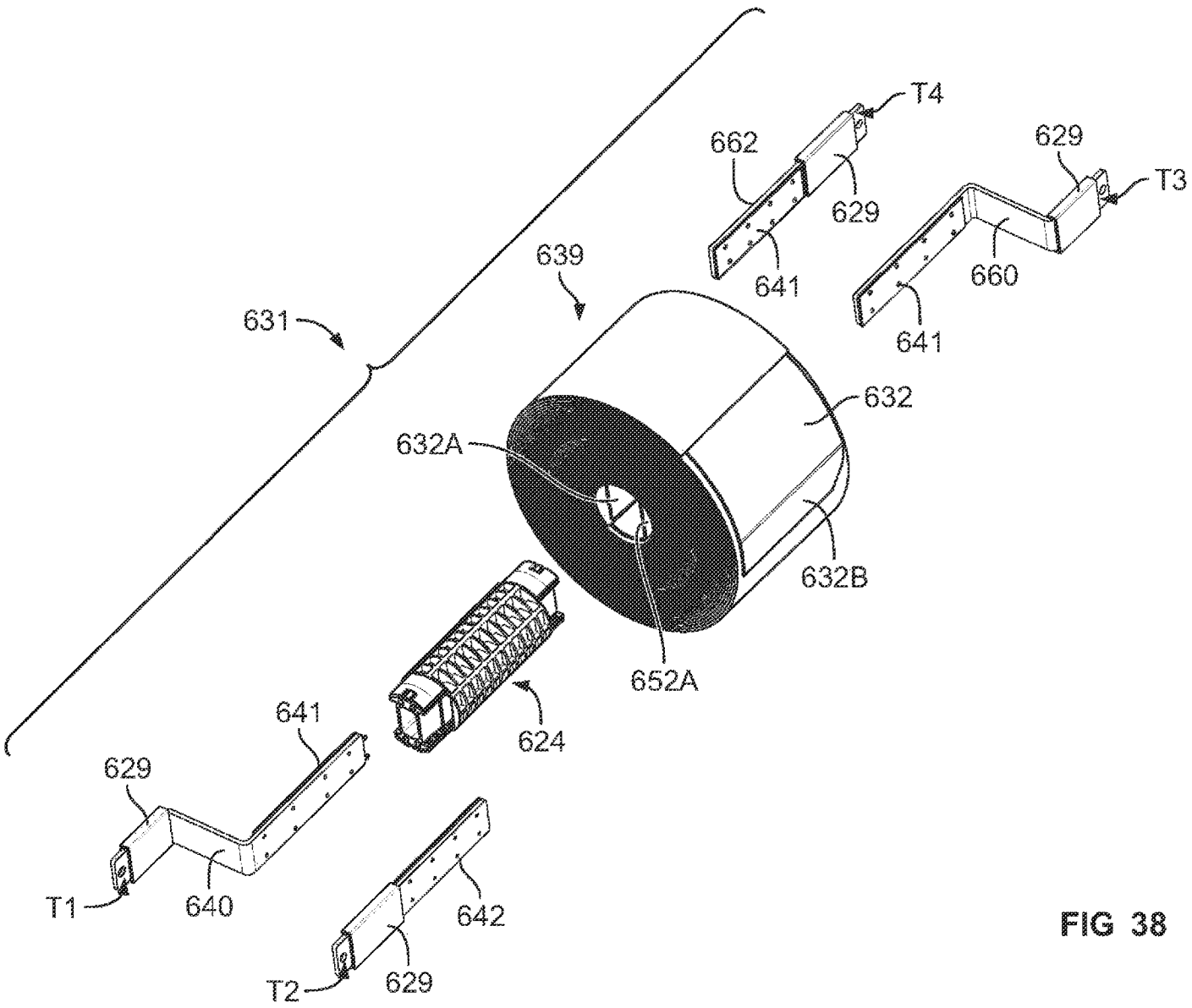
FIG. 38 is an exploded, perspective view of a coil assembly forming a part of the dual coil inductor assembly of FIG. 35.
Figure 39:
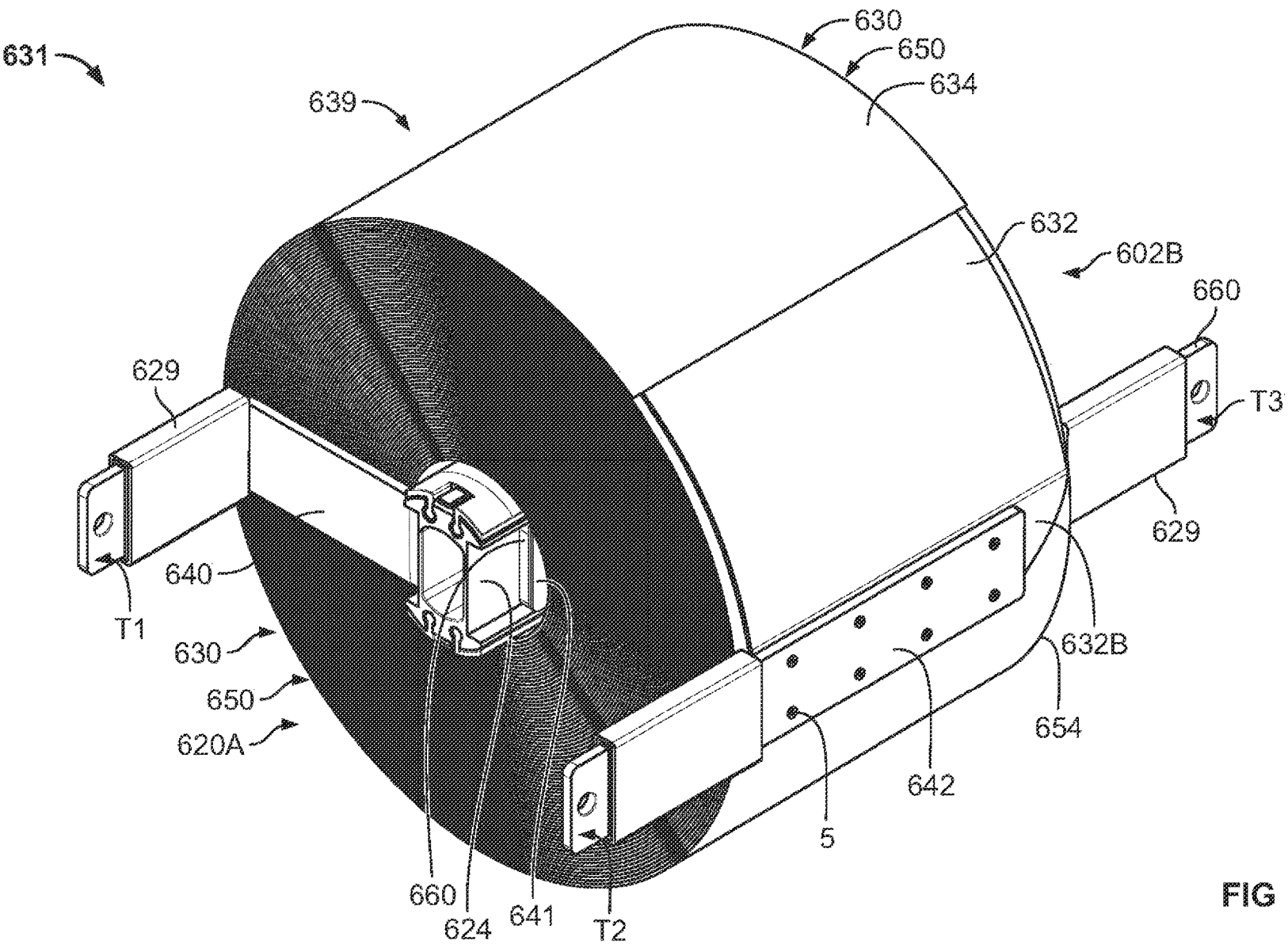
FIG. 39 is a perspective view of the coil assembly of FIG. 38.
Figure 40:
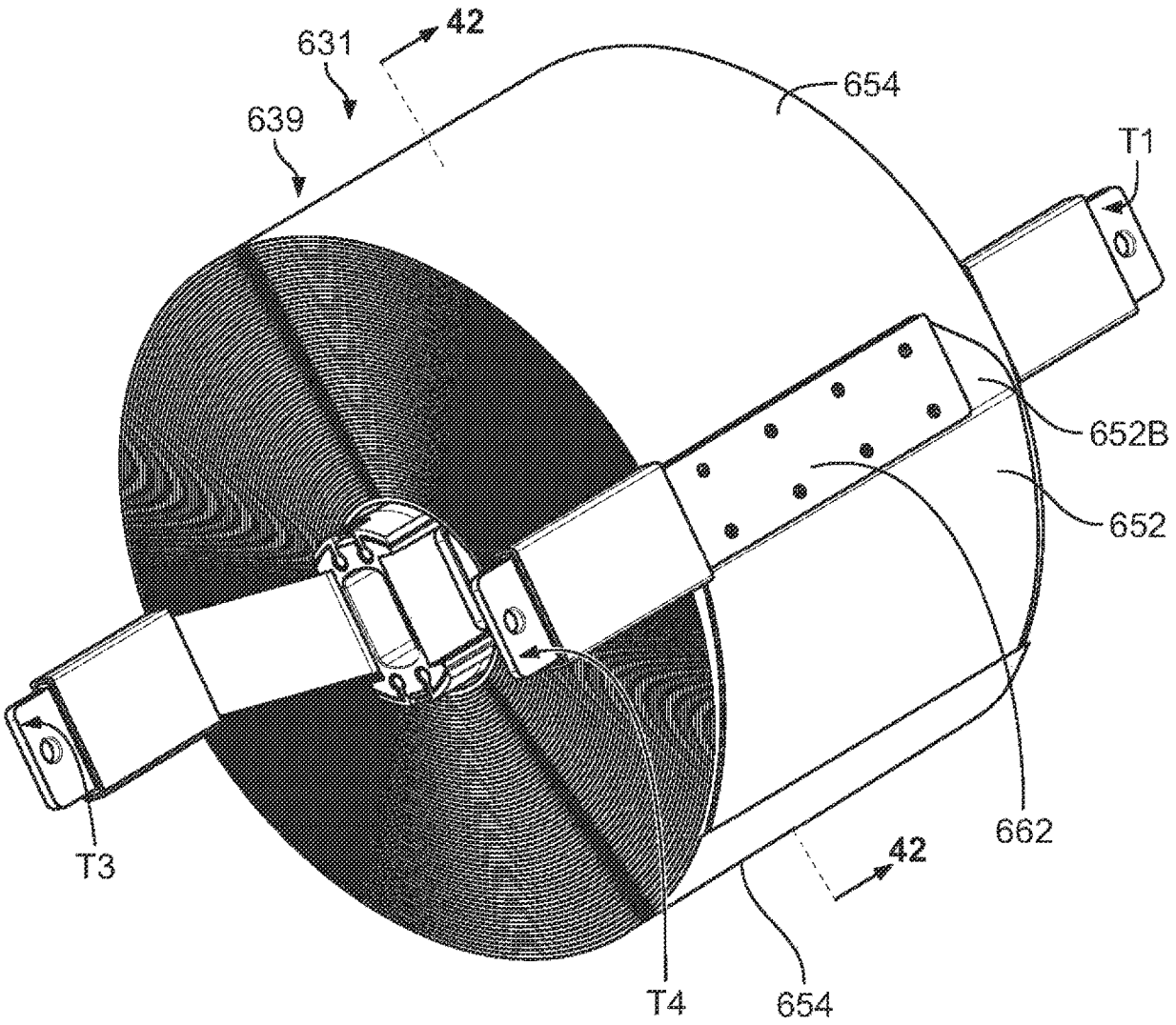
FIG. 40 is an opposing perspective view of the coil assembly of FIG. 38.
Figure 41:
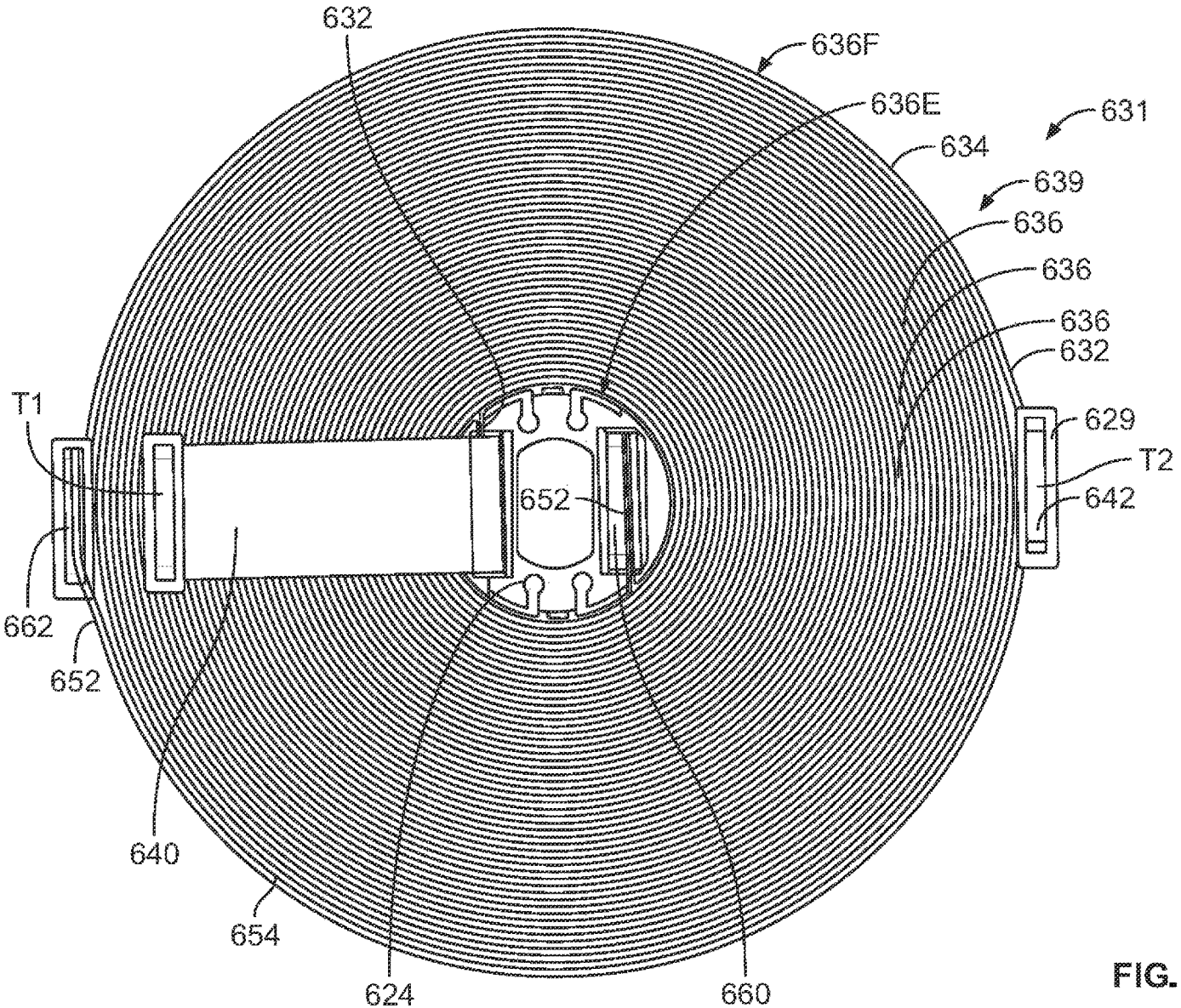
FIG. 41 is an end view of the coil assembly of FIG. 38.
Figure 44:
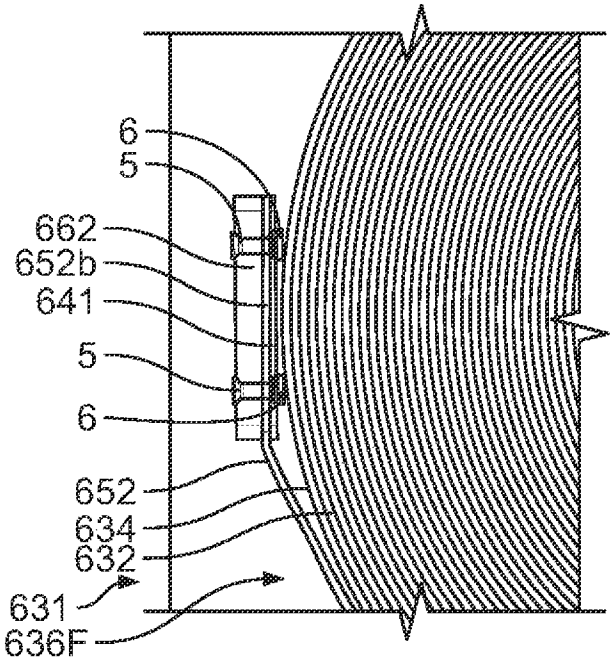

The foils 632, 652 may be constructed and formed in the same manner as described for the foil 132. The foil 632 has an inner end 632A (FIGS. 38 and 42) and an opposing outer end 632B (FIGS. 38 and 43). The foil 652 has an inner end 652A (FIGS. 38 and 42) and an opposing outer end 652B (FIGS. 40 and 44). The insulator sheets 634, 654 may be constructed and formed in the same manner as described for the insulator sheet 134.

The first foil 632, the second foil 652, the first insulator sheet 634, and the second insulator sheet 654 are spirally co-wound or wrapped about the coil axis A-A to form windings 636 with the insulator sheets 634, 654 interposed or sandwiched between the first foil 632 and the second foil 652. The windings 636 extend successively or progressively from an innermost winding 636E of the foils 632, 652 to an outermost winding 636F of the foils 632, 652 on the outer diameter of the combined coil 639. Each winding 636 is radially superimposed on, stacked on, or wrapped around the preceding winding 636. The foils 632, 652 and the insulator sheets 634, 654 may be wound tightly in face-to-face contact with one another. That is, each insulator sheet 634, 654 is in face-to-face contact with the metal foils 632, 652 on either side of said insulator sheet 634, 654, but the metal foils 632, 652 are not in face-to-face contact with one another. The foils 632, 652 are not in electrical contact with one another, but are electromagnetically coupled, as discussed herein.

Figure 47:
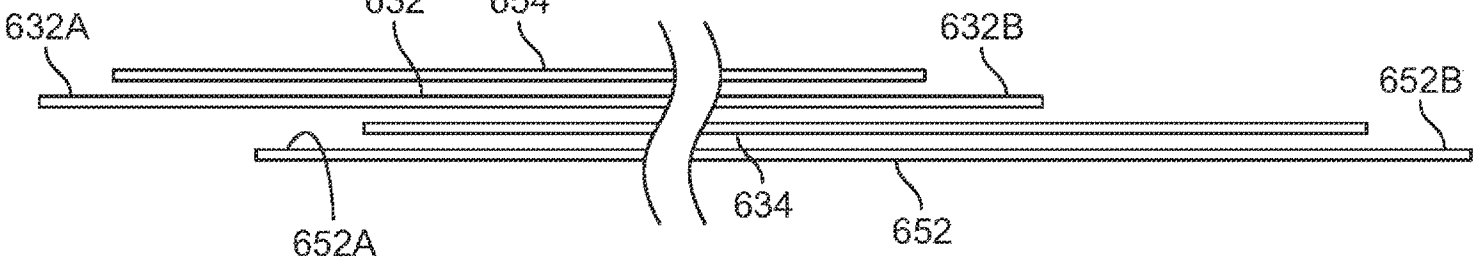
FIG. 47 is a fragmentary, side view of two conductor foils and two electrical insulator sheets forming parts of the coil assembly of FIG. 38, wherein the conductor foils and the electrical insulator sheets are shown flattened out for the purpose of explanation.
Figure 48:
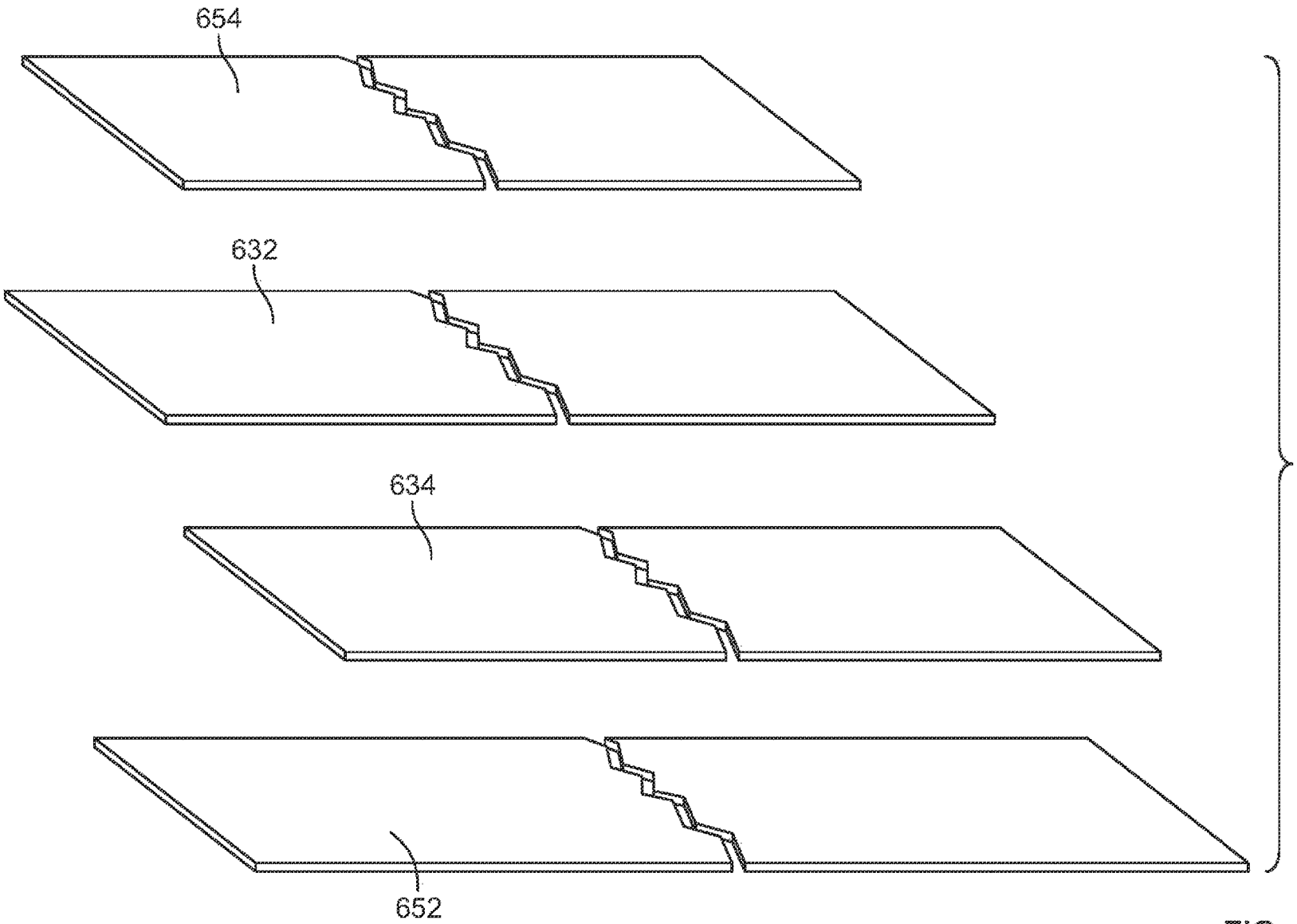
FIG. 48 is a fragmentary, perspective view of the two conductor foils and the two electrical insulator sheets forming parts of the coil assembly of FIG. 38, wherein the conductor foils and the electrical insulator sheets are shown flattened out for the purpose of explanation.

FIG. 47 is a fragmentary, side view of the conductor foils 632, 652 and the insulator sheets 634, 654 shown flattened out prior to winding to form the combined coil 639. FIG. 48 is an exploded, fragmentary, perspective view of the conductor foils 632, 652 and the insulator sheets 634, 654 shown flattened out prior to winding to form the combined coil 639.

As shown in FIGS. 42-44, 47 and 48, the foils 632, 652 and the insulator sheets 634, 654 are interleaved such that the foils 632, 652 are electrically insulated from one another by the insulator sheets 634, 654 along the entire length of each foil 632, 652.

Each of the conductor foils 632, 652 has opposed side edges that are axially spaced apart along the coil axis A-A and extend substantially parallel to one another. The conductor foils 632, 652 are spirally wound such that each side edge remains substantially in or proximate a single lateral plane (i.e., corresponding to planes E-E of FIG. 7) throughout the coil 639 from the winding 636E to the winding 636F. That is, the conductor foils 632, 652 are maintained in alignment with themselves and are spirally, not helically, wound. In some embodiments, the conductor foils 632, 652 each extend fully from the outer surface of the innermost winding 636E to the outermost winding 636F.

In some embodiments, the foils 632, 652 and the insulator sheets 634, 654 are not bonded to one another along their lengths prior to winding into the coil. That is, the foils 632, 652 and the insulator sheets 634, 654 are loosely co-wound and are not bonded or laminated to one another until after formation of the combined coil 639. In some embodiments, the foils 632, 652 and the insulator sheets 634, 654 are not bonded to one another in the completed combined coil 639 except by the potting 628 at the ends of the combined coil 639. In this case, the layers, 632, 652, 634, 654 are not bonded to one another across their widths. In some embodiments, the foils 632, 652 and the insulator sheets 634, 654 are tightly wound so that air gaps between the windings of the conductor foils 632, 652 and the insulator sheets 634, 654 are minimized or eliminated, while enhancing the electromagnetic coupling.

Figure 42:
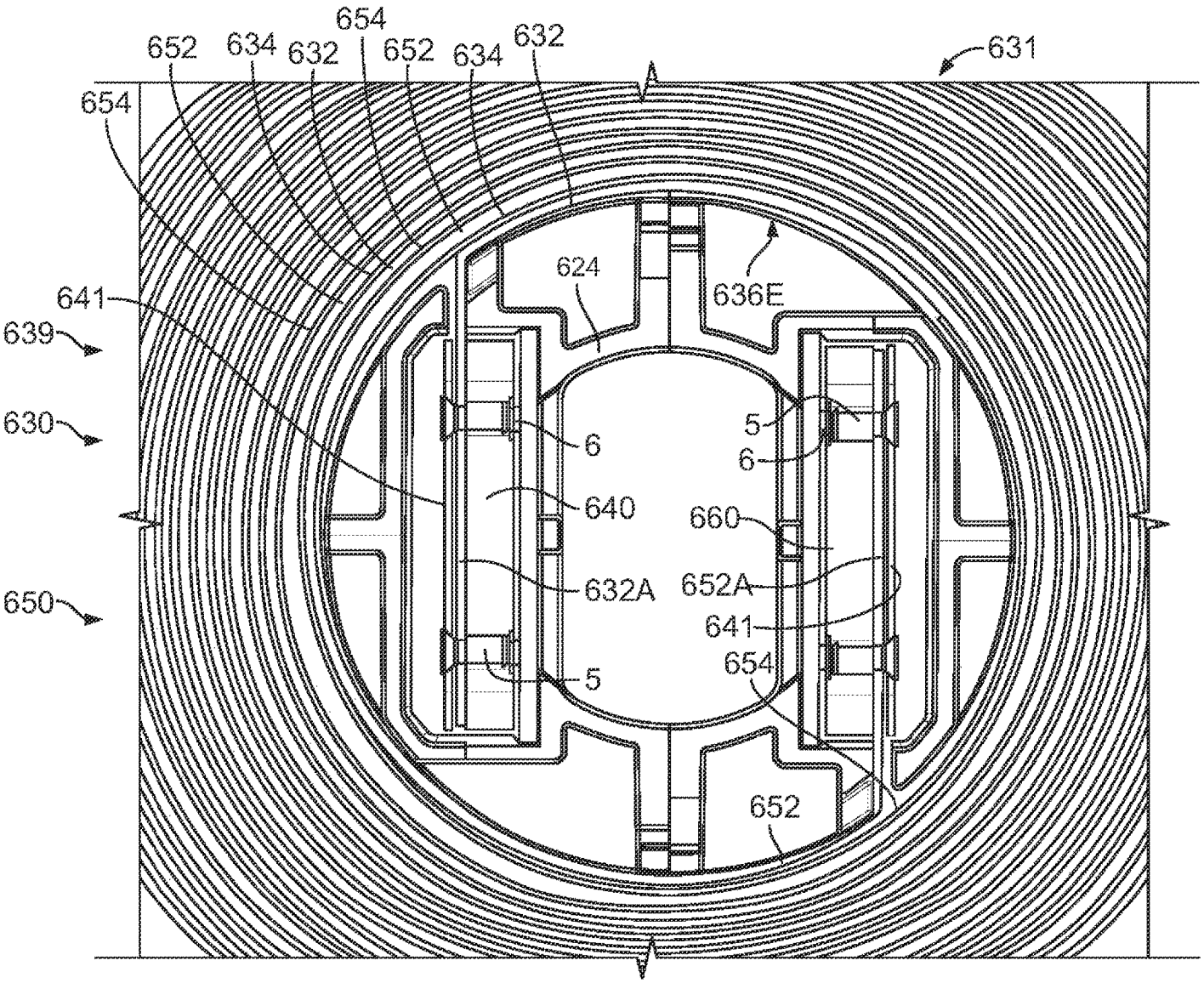
FIGS. 42-44 are enlarged, fragmentary, cross-sectional views of the coil assembly of FIG. 38 taken along the line 42-42 of FIG. 40.
Figure 43:
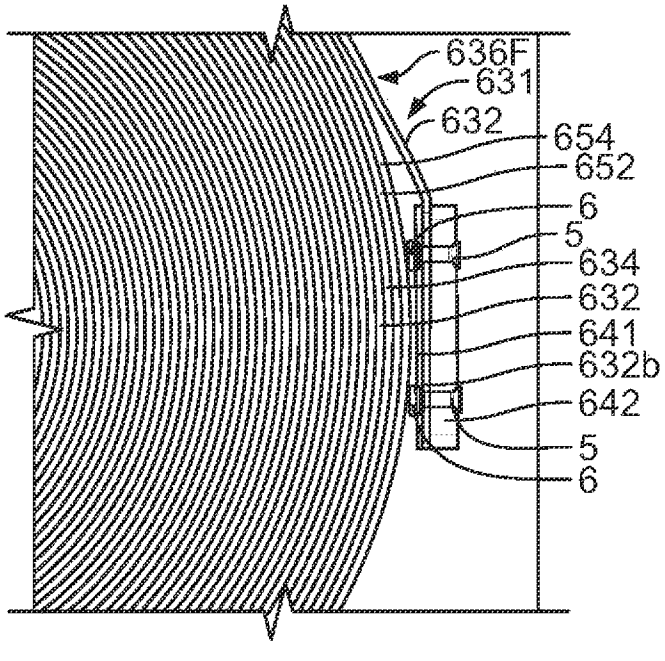
Figure 45:
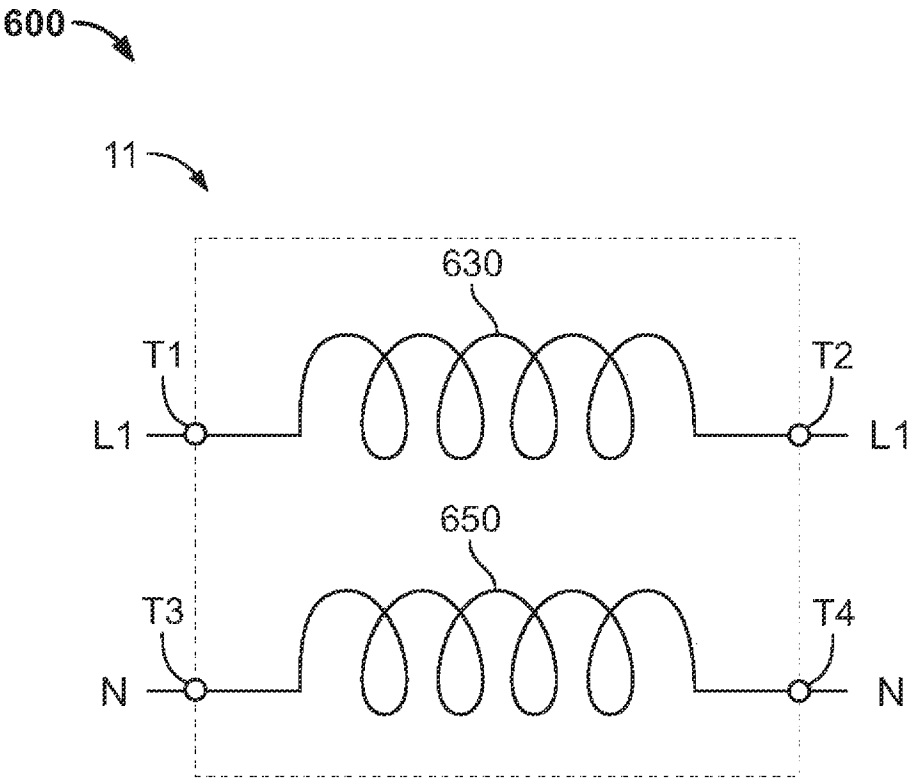
FIG. 45 is schematic representing an AC electrical power system including the dual coil inductor assembly of FIG. 35.

As shown in FIGS. 37 and 42, the terminal leg T1 is electrically connected to the conductor foil 632 at a first location. In some embodiments and as shown, the first location is proximate (i.e., at or near) the inner end 632A of the foil 632. More particularly, the end of the innermost winding 636E of the conductor foil 632 is mechanically secured in electrical contact with the terminal bus bar 640 by a clamp plate 641 and fasteners 5, 6. The bus bar 640, clamp plate 641 and conductor foil 632 may be received in a slot in the fitting 624 as illustrated.

As shown in FIGS. 37 and 43, the terminal leg T2 is electrically connected to the conductor foil 632 at a second location spaced apart from the first location along the length of the foil 632. In some embodiments and as shown, the second location is proximate (i.e., at or near) the outer end 632B of the foil 632. More particularly, the end of the outermost winding 636F of the foil 632 is mechanically secured in electrical contact with the terminal bus bar 642 by a clamp plate 641 and fasteners 5, 6.

As shown in FIGS. 37 and 42, the terminal leg T3 is electrically connected to the conductor foil 652 at a first location. In some embodiments and as shown, the first location is proximate (i.e., at or near) the inner end 652A of the foil 652. More particularly, the end of the innermost winding 636E of the conductor foil 652 is mechanically secured in electrical contact with the terminal bus bar 660 by a clamp plate 641 and fasteners 5, 6. The bus bar 660, clamp plate 641 and conductor foil 652 may be received in a slot in the fitting 624 as illustrated.

As shown in FIGS. 37 and 44, the terminal leg T4 is electrically connected to the conductor foil 652 at a second location spaced apart from the first location along the length of the foil 652. In some embodiments and as shown, the second location is proximate (i.e., at or near) the outer end 652B of the foil 652. More particularly, the end of the outermost winding 636F of the foil 652 is mechanically secured in electrical contact with the terminal bus bar 662 by a clamp plate 641 and fasteners 5, 6.

The bus bar 640 serves as a lead or terminal (T1) to the inner end 632A of the foil 632. The bus bar 642 serves as a lead or terminal (T2) to the outer end 632B of the foil 632. The electrical connection locations between the terminals T1, T2 and the foil 632 are spaced apart along the length of the foil 632, and are separated by turns of the coil 630.

The bus bar 660 serves as a lead or terminal (T3) to the inner end 652A of the foil 652. The bus bar 662 serves as a lead or terminal (T4) to the outer end 652B of the foil 652. The electrical connection locations between the terminals T3, T4 and the foil 652 are spaced apart along the length of the foil 652, and are separated by turns of the coil 650.

The dual coil inductor assembly 600 can be used in place of the inductor assemblies 100 and 300. According to method embodiments, the inductor assembly 600 is used in an AC electrical power system 11 including a phase line L1 and a neutral line N as illustrated by the diagram in FIG. 45. The input of line L1 is connected to the terminal T1 of the inductor assembly 600 and the output of line L1 is connected to the terminal T2 of the inductor assembly 600. The input of the neutral line N is connected to the terminal T3 of the inductor assembly 600 and the output of the neutral line N is connected to the terminal T4 of the inductor assembly 600. In some embodiments, AC power system has a voltage L1-N of about 650 Vrms and a load current of about 100 A. Circuit breakers may be provided between the input terminals T1, T3 of the inductor assembly 600 and the power supply. The output terminals T2, T4 of the inductor assemblies 600 may be connected to a power distribution panel.

Figure 46:
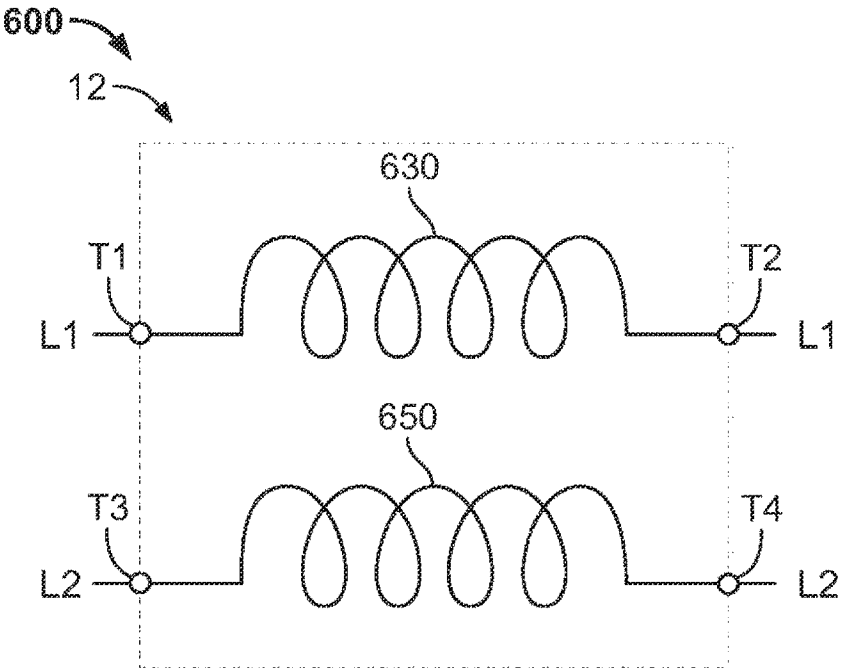
FIG. 46 is schematic representing a further AC electrical power system including the dual coil inductor assembly of FIG. 35.

According to other embodiments, the inductor assembly 600 is used in a two phase AC electrical power system 12 as illustrated by the diagram in FIG. 46. The input of line L1 is connected to the terminal T1 of the inductor assembly 600 and the output of line L1 is connected to the terminal T2 of the inductor assembly 600. The input of line L2 is connected to the terminal T3 of the inductor assembly 600 and the output of line L2 is connected to the terminal T4 of the inductor assembly 600. In some embodiments, AC power system has a voltage L1-L2 of about 650 Vrms and a load current of about 100 A. Circuit breakers may be provided between the input terminals T2, T3 of the inductor assembly 600 and the power supply. The output terminals T1, T4 of the inductor assemblies 600 may be connected to a power distribution panel.

It will be appreciated that the coils 630 and 650 are effectively inserted into one another. This construction can reduce the size, weight, and cost of the inductor assembly 600 as compared to the inductor assembly 300, for example.

This construction can also improve the inductor assembly's ability to withstand vibration.

The coils 630 and 650 are electromagnetically mutually coupled. By co-winding the coils 630, 650 as described (i.e., spirally turning the conductor foils 632 and 652 together), the mutual inductance and inductive electromagnetic coupling between the coils 630, 650 is increased. This enables the combined coil 639 to achieve a greater inductance value using individual coils 630, 650 having lower individual inductance values. As a result, the coils 630, 650 can be formed with fewer turns and the size and weight of the combined coil 639 can be smaller for the same overall inductance value as compared to the inductor assembly 300, for example.

For example, in some embodiments, the coefficient of inductive coupling between the coils 630 and 650 is about 0.9 versus a coefficient of inductive coupling between the coils 330 and 350 of about 0.13 for the inductor assembly 300. As a result, the inductor assembly 600 can include coils 630, 650 each having an individual inductance value of about 500 pH each in order to achieve an effective overall inductance on the line L1 or the line N of about 900 pH.

Embodiments of the combined dual inductor assembly (e.g., the inductor assembly 600) can provide very high voltage insulation level of around 400 kV along each line (L1, L2, or N) and around 30 kV in between the two lines (e.g., between L1 and N or between L1 and L2).

In alternative embodiments, either (i.e., one or both) of the conductor foils 632, 652 can be replaced with a pair of foils in face-to-face electrical contact as described above for the multilayer conductor 537.

Figure 49:
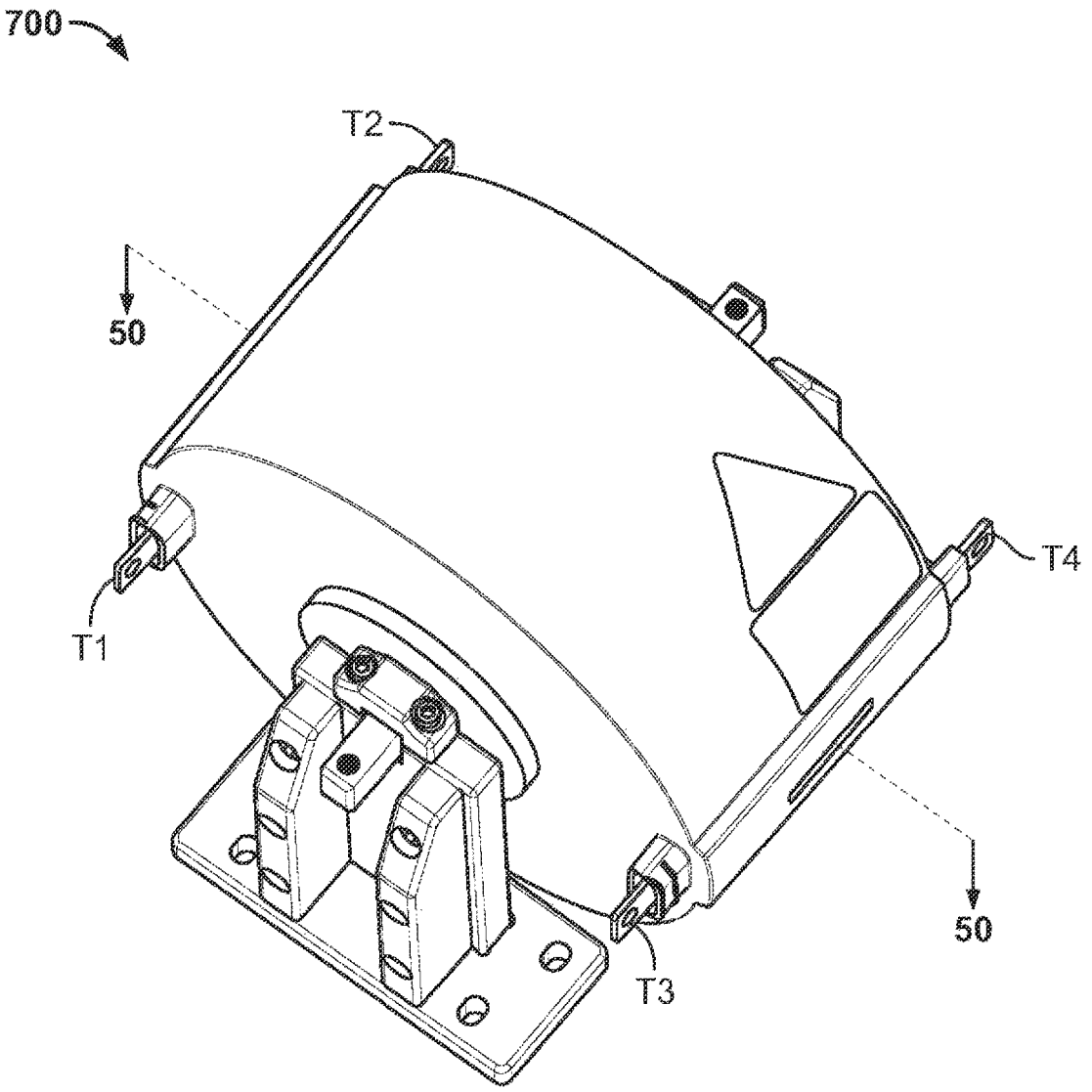
FIG. 49 is a top, perspective view of a dual coil inductor assembly according to further embodiments.
Figure 50:
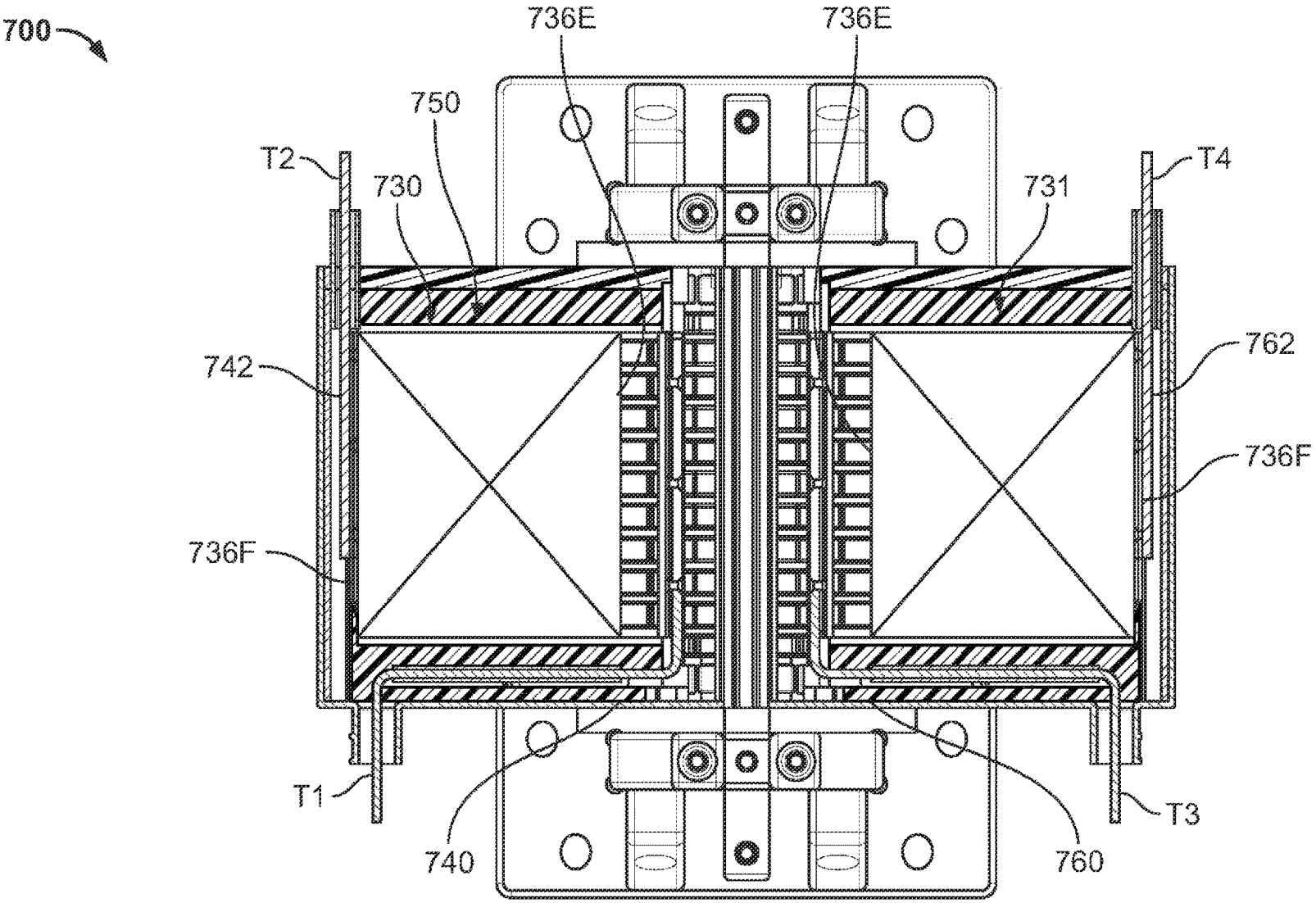
FIG. 50 is a cross-sectional view of the dual coil inductor assembly of FIG. 49 taken along the line 50-50 of FIG. 49.

With reference to FIGS. 49 and 50, a combined dual coil inductor assembly 700 according to further embodiments of the invention is shown therein. The inductor assembly 700 is constructed in the same manner as, and can be used in the same manner as, the dual coil inductor assembly 600, except as discussed below.

The dual coil inductor assembly 700 includes a coil assembly 731 constructed in substantially the same manner as the coil assembly 631. The dual coil inductor assembly 700 also includes terminal bus bars 740, 742, 760, and 762 corresponding to the terminal bus bars 640, 642, 660, and 662.

The terminal bus bars 740, 742, 760, and 762 form terminals T1, T2, T3, and T4. The terminal bus bars 740, 742, 760, and 762 are connected to the innermost winding 736E of the first coil 730 (corresponding to the coil 630), the outermost winding 736F of the first coil 730, the innermost winding 736E of the second coil 750 (corresponding to the coil 650), and the outermost winding 736F of the second coil 750, respectively, in the same manner as described for the terminal bus bars 640, 642, 660, and 662.

The dual coil inductor assembly 700 differs from the dual coil inductor assembly 600 in that the terminal legs T1 and T3 project from one end of the coil assembly 631, and the terminal legs T2 and T4 project from the opposite end of the coil assembly 631. Thus, each of the coils 730, 750 has one of its terminal legs T1, T4, T3, T4 on each end of the coil assembly 731.

With reference to FIGS. 51-54, a combined dual coil inductor assembly 800 according to further embodiments of the invention is shown therein. The inductor assembly 800 is constructed in the same manner as, and can be used in the same manner as, the dual coil inductor assembly 600, except as discussed below.

The combined dual coil inductor assembly 800 includes an inner coil 830 and an outer coil 850 that are combined or radially stacked to form a combined coil assembly 839. The coils 830 and 850 are not co-wound as in the dual coil inductor assembly 600.

The inductor assembly 800 includes an enclosure 810, a pair of axially spaced apart support bases 820, a support shaft 822, an electrically insulating fitting 824, potting 828, insulation sleeves or tubes 829, a first or inner coil assembly 831, a second or outer coil assembly 851, and an inter-coil electrical insulation layer 870. The enclosure 810, support bases 820, support shaft 822, potting 828, and insulation sleeves or tubes 829 may be constructed in the same manner as the enclosure 110, support bases 120, support shaft 122, the electrically insulating fitting 124, potting 128, and insulation sleeves or tubes 129, for example. The potting 828 is not shown in FIG. 54.

The inner coil assembly 831 includes a multi-layer coil 830, an inner terminal bus bar 840, and an outer terminal bus bar 842. The inner coil assembly 831, the inner coil 830, the inner terminal bus bar 840, and the outer terminal bus bar 842 are constructed substantially in the same manner as the coil assembly 131, the inner coil 130, the inner terminal bus bar 140, and the outer terminal bus bar 142 (FIGS. 6-10).

Figure 52:
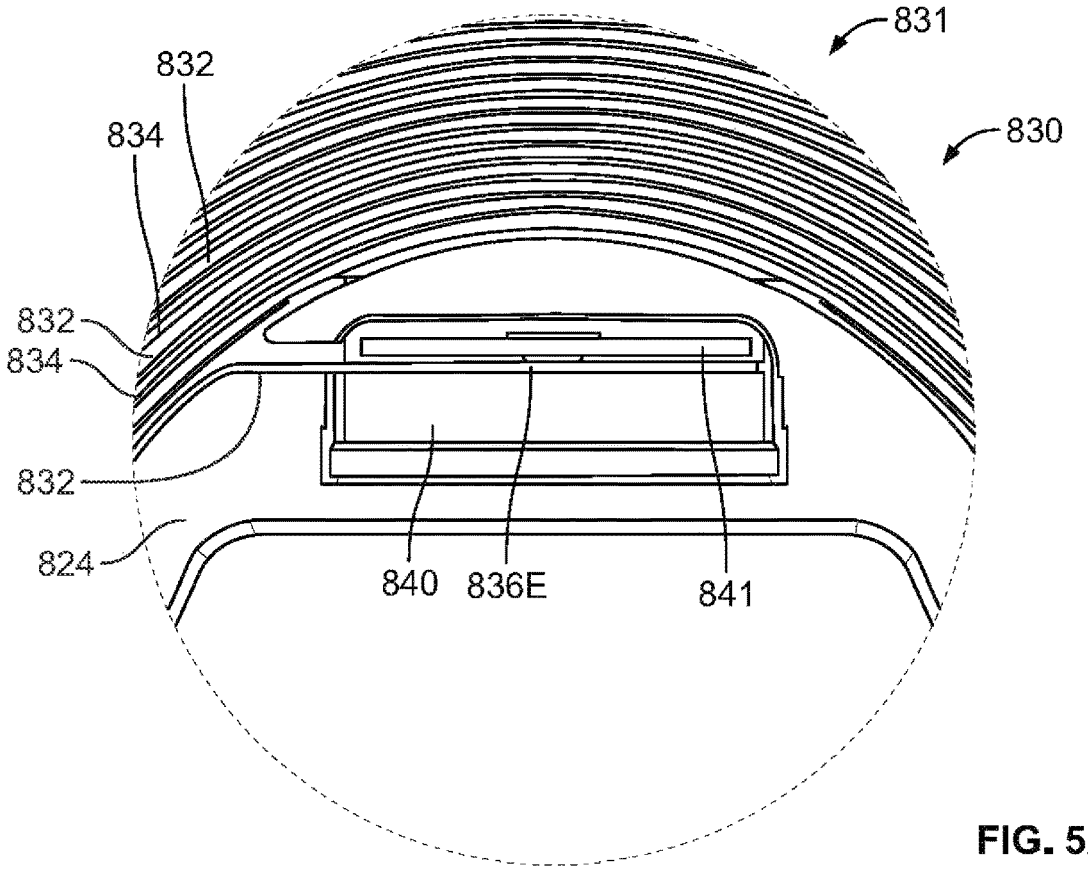
FIG. 52 is an enlarged, fragmentary, end view of an inner coil assembly forming a part of the dual coil inductor assembly of FIG. 51.
Figure 53:
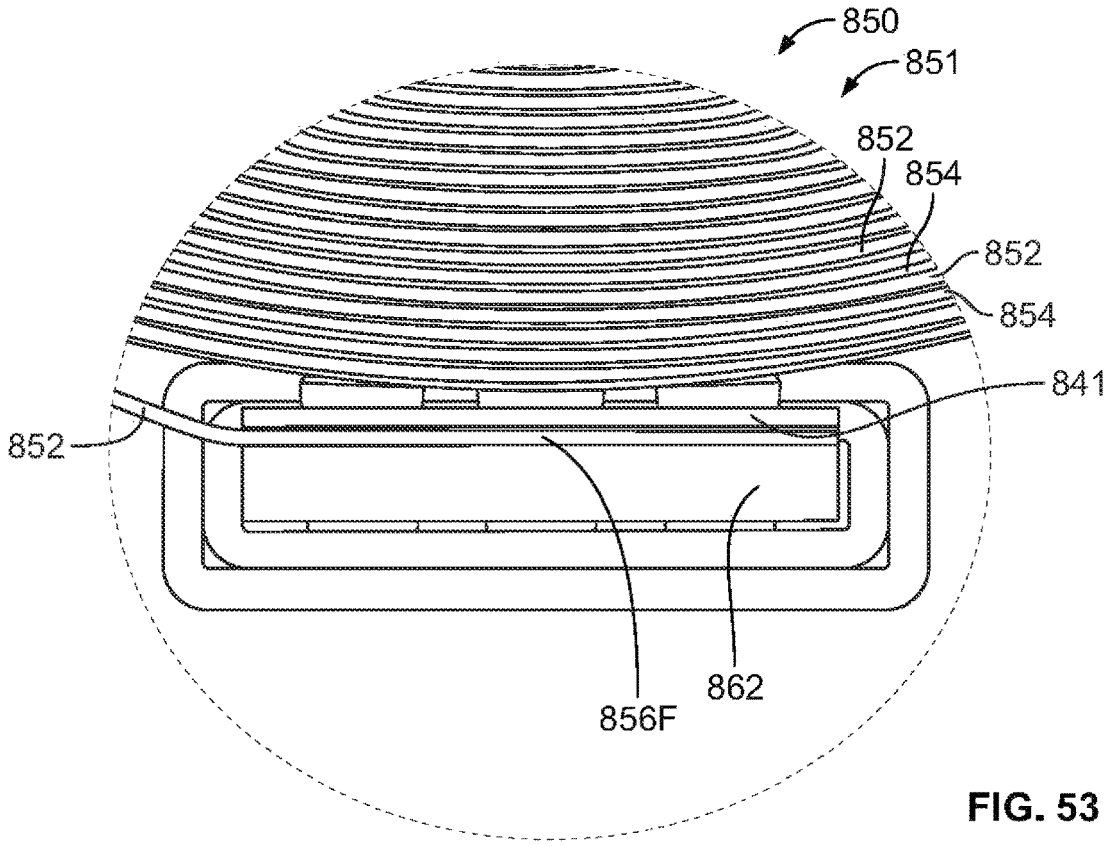
FIG. 53 is an enlarged, fragmentary, end view of an outer coil assembly forming a part of the dual coil inductor assembly of FIG. 51.

The inner coil 830 is an air core coil. With reference to FIG. 52, the inner coil 830 includes an electrically conductive conductor sheet, strip or foil 832 (corresponding to the foil 132) and an electrically insulative insulator strip or sheet 834 (corresponding to the insulation sheet 134). The foil 832 and sheet 834 are spirally co-wound or wrapped about a coil axis A-A to form windings 836, as described for the coil 130.

The inner terminal bus bar 840 includes a contact leg 840A and a terminal leg T1. The contact leg 840A is secured in mechanical and electrical contact with the innermost winding 836E of the conductor foil 832 by a clamping member or plate 841 and fasteners as described above for the coil 130. The terminal leg T1 extends out of the enclosure 810 through an opening.

The outer terminal bus bar 842 includes a contact leg 842A and a terminal leg T2. The contact leg 842A is secured in mechanical and electrical contact with the outermost winding 836F of the conductor foil 832 by a clamping member or plate 841 and fasteners as described above for the coil 130. The terminal leg T2 extends out of the enclosure 810 through an opening.

The outer coil assembly 851 includes a multi-layer coil 850, an inner terminal bus bar 860, and an outer terminal bus bar 862. The inner coil assembly 851, the inner coil 850, the inner terminal bus bar 860, and the outer terminal bus bar 862 are constructed substantially in the same manner as the coil assembly 131, the inner coil 130, the inner terminal bus bar 140, and the outer terminal bus bar 142 (FIGS. 6-10).

The outer coil 850 is an air core coil. With reference to FIG. 52, the outer coil 850 includes an electrically conductive conductor sheet, strip or foil 852 (corresponding to the foil 132) and an electrically insulative insulator strip or sheet 854 (corresponding to the insulation sheet 134). The foil 852 and sheet 854 are spirally co-wound or wrapped about the coil axis A-A to form windings 856, as described for the coil 130.

The inner terminal bus bar 860 includes a contact leg 860A and a terminal leg T3. The contact leg 860A is secured in mechanical and electrical contact with the innermost winding 856E of the conductor foil 852 by a clamping member or plate 841 and fasteners as described above for the coil 130. The terminal leg T3 extends out of the enclosure 810 through an opening.

The outer terminal bus bar 862 includes a contact leg 862A and a terminal leg T4. The contact leg 862A is secured in mechanical and electrical contact with the outermost winding 856F of the conductor foil 852 by a clamping member or plate 841 and fasteners as described above for the coil 130. The terminal leg T4 extends out of the enclosure 810 through an opening.

The insulation layer 870 may be tubular. The insulation layer 870 defines an inner cavity or passage 870B. Each terminal leg T1, T2, T3, T4 is covered by an insulation tube 829 that extends through the respective opening of the enclosure 810. The insulation tubes 829 may be constructed as described for the insulation tubes 129.

Figure 51:
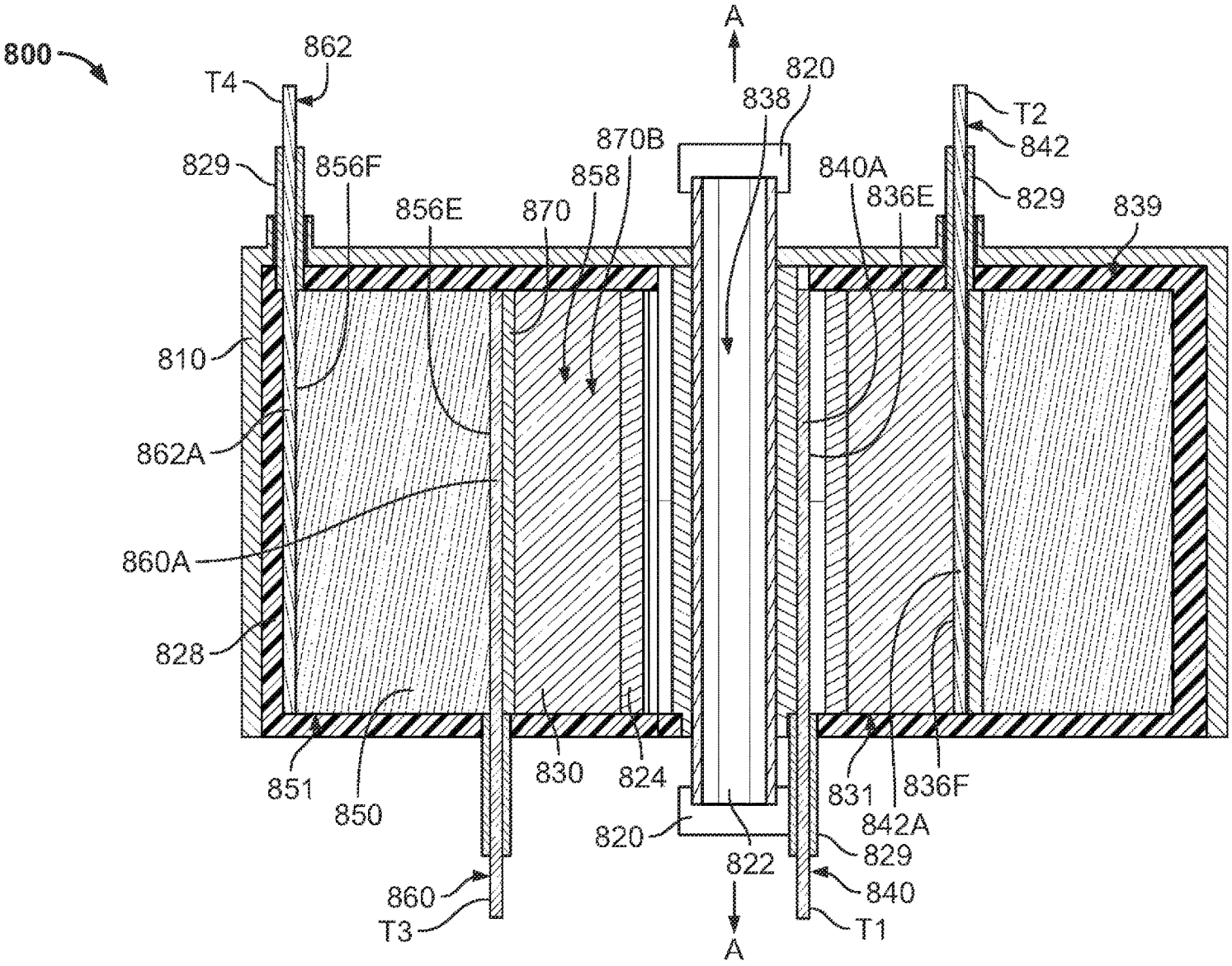
FIG. 51 is a cross-sectional view of a dual coil inductor assembly according to further embodiments.
Figure 54:
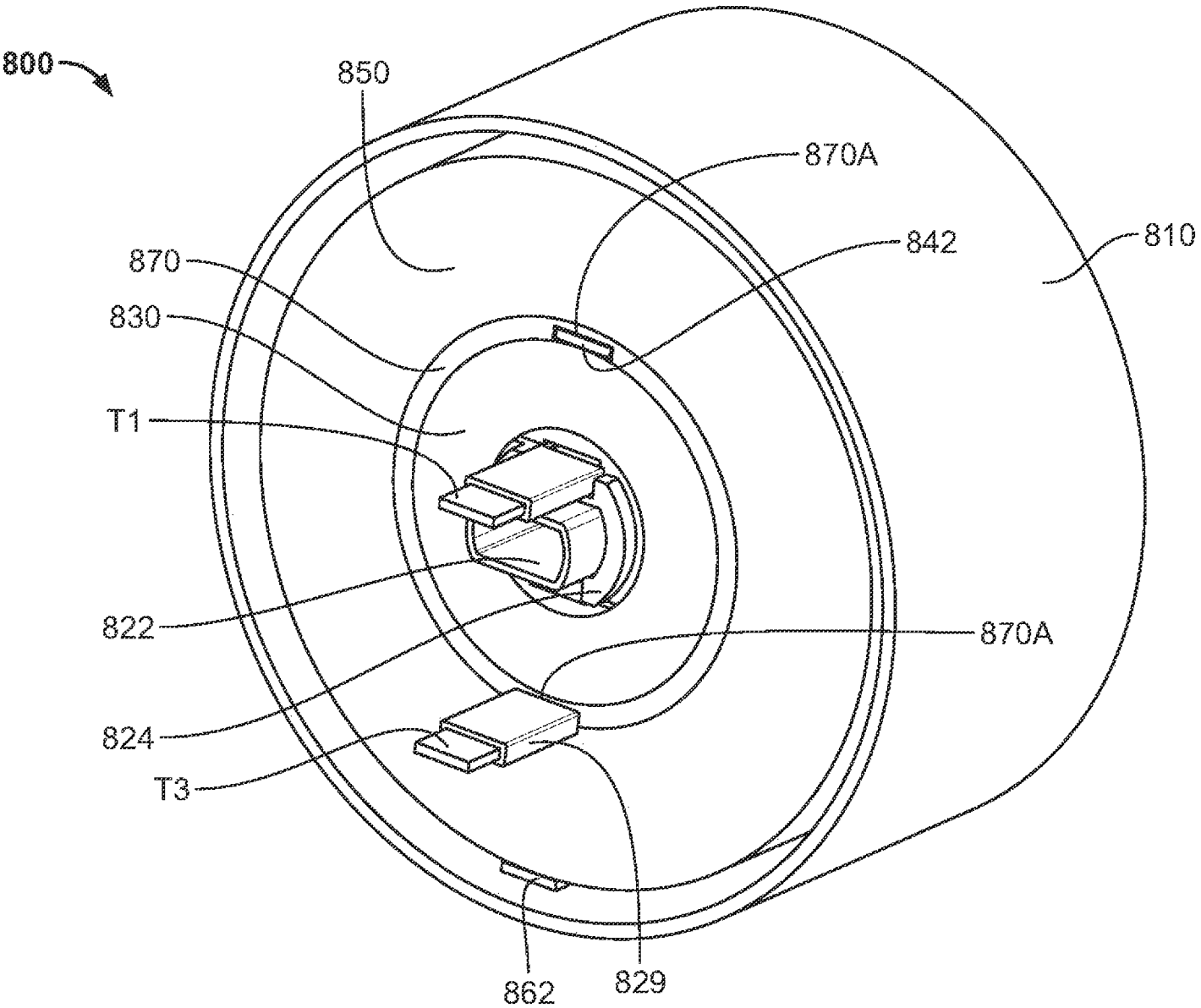
FIG. 54 is a fragmentary, perspective view of the dual coil inductor assembly of FIG. 51.

The inter-coil electrical insulation layer 870 may be formed of any suitable material and in any suitable form. In some embodiments, the inter-coil electrical insulation layer 870 is or includes a tubular layer or member of electrical insulating material. In some embodiments, the inter-coil electrical insulation layer 870 is or includes a spirally wrapped or wound sheet or web of electrical insulating material. The insulation layer 870 may be formed a plurality of rigid insulation members that are combined to form the tubular structure. In some embodiments and as illustrated in FIGS. 51 and 54, the insulation layer 870 includes a single tubular member. In some embodiments, one or more axially extending channels 870A (FIG. 54) are defined in the insulation layer 870 and conformally receive the busbars 842, 860.

The inner coil assembly 830 is mounted about or on the insulating fitting 824 such that the fitting 824 extends through the inner passage or air core 838 of the coil 830. The outer coil 850 is in turn mounted about or about the inner coil 830. The inter-coil electrical insulation layer 870 is disposed radially between the coil assemblies 831, 851 to prevent electrical contact between the electrically conductive components (i.e., the foils and the bus bars) of the respective coils. The inner coil 830 is disposed in the inner cavity 870B of the insulation layer 870.

The dual coil inductor assembly 800 may be formed by winding the foil 832 and insulation layer 834 about the fitting 824 (to form the coil 830), mounting the inter-coil electrical insulation layer 870 over the coil 830, and winding the foil 852 and insulation layer 854 about the inter-coil electrical insulation layer 870. The foil 832 and the foil 852 are each wrapped around the axis A-A and, in some embodiments, are wrapped concentrically.

The outer coil 850 circumferentially surrounds the inner coil 830. That is, the outer coil 850 is radially superimposed over the inner coil 830 and the inner coil 830 is disposed in the inner passage or air core 858 of the outer coil 850. The outer coil 850 and the inner coil 830 are electrically insulated from one another. The inner foil 832 is not spirally co-wound with the outer foil 854 as in the dual coil inductor assembly 700. The innermost winding 856E of the foil 852 is located radially outward beyond the outermost winding 836F of the foil 832. The ends of the foils 832, 852 are terminated by respective bus bars 840, 842, 860, and 862 that provide respective terminals T1, T2, T3, and T4 to form external connections.

In some embodiments, the inner coil 830 and the outer coil 850 are concentric.

As discussed above, in some embodiments the coil assemblies 831, 851 and coils 830, 850 are constructed (including components, arrangements, materials, dimension, and methods of assembling) as described above with regard to the coil assembly 131 and the coil 130.

While a separate insulation layer 870 is shown to provide electrical insulation between the electrically conductive components of the coil assemblies 831, 851, in other embodiments, the insulation layer 834, 854 of one of the coils 830, 850 may be extended to wrap fully around the outer surface of the coil assembly 831 to electrically insulate the coil assembly 831 from the coil assembly 851.

In alternative embodiments, either (i.e., one or both) of the conductor foils 832, 852 can be replaced with a pair of foils in face-to-face contact as described above for the multilayer conductor 537.

The dual coil inductor assembly 800 can be used in place of the inductor assembly 600. According to method embodiments, the inductor assembly 800 is used in an AC electrical power system 11 including a phase line L1 and a neutral line N as illustrated by the diagram in FIG. 45. The input of line L1 is connected to the terminal T1 of the dual coil inductor assembly 800 and the output of line L1 is connected to the terminal T2 of the dual coil inductor assembly 800. The input of the neutral line N is connected to the terminal T3 of the dual coil inductor assembly 800 and the output of the neutral line N is connected to the terminal T4 of the dual coil inductor assembly 800. In some embodiments, AC power system has a voltage L1-N of about 650 Vrms and a load current of about 100 A. Circuit breakers may be provided between the input terminals T1, T3 of the inductor assembly 800 and the power supply. The output terminals T2, T4 of the inductor assemblies 800 may be connected to a power distribution panel.

According to other embodiments, the inductor assembly 800 is used in a two phase AC electrical power system 12 as illustrated by the diagram in FIG. 46. The input of line L1 is connected to the terminal T1 of the dual coil inductor assembly 800 and the output of line L1 is connected to the terminal T2 of the dual coil inductor assembly 800. The input of line L2 is connected to the terminal T3 of the dual coil inductor assembly 800 and the output of line L2 is connected to the terminal T4 of the dual coil inductor assembly 800. In some embodiments, AC power system has a voltage L1-L2 of about 650 Vrms and a load current of about 100 A. Circuit breakers may be provided between the input terminals T2, T3 of the inductor assembly 800 and the power supply. The output terminals T1, T4 of the inductor assemblies 800 may be connected to a power distribution panel.

By surrounding the coil 830 with the coil 850 as described, the mutual inductance and inductive coupling between the coils 830, 850 is increased. This enables the combined coil assembly 839 to achieve a greater inductance value using individual coils 830, 850 having lower individual inductance values. As a result, the coils 830, 850 can be formed with fewer turns and the size and weight of the combined coil 839 can be smaller for the same overall inductance value as compared to the inductor assembly 300, for example. As discussed above with regard to the inductor assembly 600, the coefficient of inductive coupling between the coils 830 and 850 serves to provide a greater effective overall inductance on the line L1 or the line N than would be achieved by the coils 830, 850 individually. Embodiments of the combined dual inductor assembly (e.g., the inductor assembly 800) can also provide very high voltage insulation level of around 400 kV along each line (L1, L2, or N) and around 30 kV in between the two lines (e.g., between L1 and N or between L1 and L2).

While the arrangement of the inductor assembly 800 will also provide improved inductive coupling (for example, inductive coupling of about 0.6), it typically will not be as great as that provided by the inductor assembly 600.

A dual coil inductor assembly including a coil in coil design as described (e.g., the dual coil inductor assembly 800) may advantageously provide lower capacitance as compared to the dual coil inductor assembly 600. A dual coil inductor assembly of this design also separates the line L and neutral N conductors, so that the risk of short circuit between L and Neutral is reduced or eliminated.

While inductor assemblies as shown herein and in accordance with some embodiments are air-core (ironless) coils, according to other embodiments each of the inductor assemblies may a Ferromagnetic-core (e.g., an iron-core, a laminated-core, a ferrie-core, a powered-iron-core, a Manganese-Zinc Ferrite, a Molybdenum Permalloy Powder core, a Nickel-Zinc Ferrite core, a Sendust core, a Silicon Steel core, or a Nano-crystalline core).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A dual coil inductor assembly comprising:

a coil assembly including:

a first metal foil;

a first electrical insulator sheet;

a second metal foil;

a second electrical insulator sheet; and first, second, third and fourth terminals;

wherein:

the first metal foil, the first electrical insulator sheet, the second metal foil, and the second electrical insulator sheet are all spirally co-wound to form a combined coil;

the spirally wound first metal foil forms a first coil;

the spirally wound second metal foil forms a second coil;

the first and second electrical insulator sheets are interposed between the first and second metal foils so that the first and second metal foils are electrically insulated from one another by the first and second electrical insulator sheets;

the first terminal is electrically connected to the first metal foil at a first location, the second terminal is electrically connected to the first metal foil at a second location, and the first and second locations are spaced apart along the first metal foil; and the third terminal is electrically connected to the second metal foil at a third location, the fourth terminal is electrically connected to the second metal foil at a fourth location, and the third and fourth locations are spaced apart along the second metal foil.

2. The dual coil inductor assembly of claim 1 wherein:

the first metal foil has opposed first and second ends;

the second metal foil has opposed first and second ends;

the first terminal is electrically connected to the first metal foil proximate the first end thereof;

the second terminal electrically is connected to the first metal foil proximate the second end thereof;

the third terminal electrically is connected to the second metal foil proximate the first end thereof; ands the fourth terminal electrically is connected to the second metal foil proximate the second end thereof.

3. The dual coil inductor assembly of claim 1 wherein:

the combined coil has a coil axis about which the first and second metal foils and the first and second electrical insulator sheets are wound; and the first, second, third and fourth terminals are first, second, third and fourth terminal legs, respectively, that project outwardly from the combined coil to enable electrical connections between the dual coil assembly and electrical lines.

4. The dual coil inductor assembly of claim 3 wherein each of the first, second, third and fourth terminal legs projects outwardly from an axial end of the combined coil.

5. The dual coil inductor assembly of claim 1 wherein the dual coil inductor assembly includes:

a first terminal bus bar including the first terminal and secured to an innermost winding of the first metal foil;

a second terminal bus bar including the second terminal and secured to an outermost winding of the first metal foil;

a third terminal bus bar including the third terminal and secured to an innermost winding of the second metal foil; and a fourth terminal bus bar including the fourth terminal and secured to an outermost winding of the second metal foil.

6. The dual coil inductor assembly of claim 5 including:

a first electrically insulating polymeric tube surrounding a portion of the first terminal bus bar;

a second electrically insulating polymeric tube surrounding a portion of the second terminal bus bar;

a third electrically insulating polymeric tube surrounding a portion of the third terminal bus bar; and a fourth electrically insulating polymeric tube surrounding a portion of the fourth terminal bus bar.

7. The dual coil inductor assembly of claim 5 including a clamp plate and a fastener mechanically securing one of the first and second terminal bus bars in electrical contact with the first metal foil.

8. The dual coil inductor assembly of claim 1 wherein the first and second metal foils and the first and second electrical insulator sheets are not bonded to one another across their widths.

9. The dual coil inductor assembly of claim 1 wherein the first and second metal foils each have a foil thickness in the range of from about 0.5 mm to 1 mm.

10. The dual coil inductor assembly of claim 1 wherein the first and second electrical insulator sheets each have a thickness in the range of from about 0.05 to 1 mm.

11. The dual coil inductor assembly of claim 1 wherein the first and second metal foils each have a foil thickness and a foil width, and a ratio of the foil width to the foil thickness of each of the first and second metal foils is in the range of from about 170 to 500.

12. The dual coil inductor assembly of claim 1 wherein the combined coil has a substantially cylindrical outer profile.

13. The dual coil inductor assembly of claim 1 including an electrically insulating epoxy resin surrounding and engaging the combined coil.

14. The dual coil inductor assembly of claim 1 including an enclosure defining an enclosed chamber, wherein the combined coil is disposed in the chamber.

15. The dual coil inductor assembly of claim 14 including at least one mounting bracket supporting the enclosure and the combined coil.

16. The dual coil inductor assembly of claim 1 wherein the first coil includes a third metal foil spirally co-wound in face-to-face electrical contact with the first metal foil to form a multilayer conductor.

17. The dual coil inductor assembly of claim 16 wherein the first, second and third metal foils and the first and second electrical insulator sheets are not bonded to one another across their widths.

18. The dual coil inductor assembly of claim 16 wherein the second coil includes a fourth metal foil spirally co-wound in face-to-face electrical contact with the second metal foil to form a second multilayer conductor.

19. A method for forming a dual coil inductor assembly, the method comprising:

providing a first metal foil, a first electrical insulator sheet, a second metal foil, and a second electrical insulator sheet; and spirally co-winding the first metal foil, the first electrical insulator sheet, the second metal foil, and the second electrical insulator sheet to form a combined coil in which:

the spirally wound first metal foil forms a first coil;

the spirally wound second metal foil forms a second coil; and the first and second electrical insulator sheets are interposed between the first and second metal foils so that the first and second metal foils are electrically insulated from one another by the first and second electrical insulator sheets;

electrically connecting a first terminal to the first metal foil at a first location;

electrically connecting a second terminal to the first metal foil at a second location spaced apart from the first location along the first metal foil;

electrically connecting a third terminal to the second metal foil at a third location; and electrically connecting a fourth terminal to the second metal foil at a fourth location spaced apart from the third location along the second metal foil.

20. The method of claim 19 wherein:

the first metal foil has opposed first and second ends;

the second metal foil has opposed first and second ends;

the first location is proximate the first end of the first metal foil;

the second location is proximate the second end of the first metal foil;

the third location is proximate the first end of the second metal foil;

the fourth location is proximate the second end of the second metal foil.

21. The method of claim 19 wherein the first and second metal foils and the first and second electrical insulator sheets are not bonded to one another across their widths during the step of co-winding the first metal foil, the first electrical insulator sheet, the second metal foil, and the second electrical insulator sheet.

22. A method for using a dual coil inductor assembly, the method comprising:

providing a dual coil inductor assembly including:

a coil assembly including:

a first metal foil having opposed first and second ends;

a first electrical insulator sheet;

a second metal foil having opposed first and second ends;

a second electrical insulator sheet; and first, second, third and fourth terminals;

wherein:

the first metal foil, the first electrical insulator sheet, the second metal foil, and the second electrical insulator sheet are all spirally co-wound to form a combined coil;

the spirally wound first metal foil forms a first coil;

the spirally wound second metal foil forms a second coil; and the first and second electrical insulator sheets are interposed between the first and second metal foils so that the first and second metal foils are electrically insulated from one another by the first and second electrical insulator sheets;

the first terminal is electrically connected to the first metal foil at a first location, the second terminal is electrically connected to the first metal foil at a second location, and the first and second locations are spaced apart along the first metal foil; and the third terminal is electrically connected to the first metal foil at a third location, the fourth terminal is electrically connected to the second metal foil at a fourth location, and the third and fourth locations are spaced apart along the second metal foil;

connecting the dual coil inductor assembly to first and second lines of an AC electrical system, including:

electrically connecting an input of the first line to the first terminal;

electrically connecting an output of the first line to the second terminal;

electrically connecting an input of the second line to the third terminal; and electrically connecting an output of the second line to the fourth.

23. The method of claim 22 wherein the first line is a phase line and the second line is a neutral line.

24. The method of claim 22 wherein the first line is a first phase line and the second line is a second phase line.

25. A dual coil inductor assembly comprising:

an inner coil assembly including:

an inner coil including:

an inner metal foil; and an inner electrical insulator sheet spirally co-wound with the inner metal foil; and first and second terminals;

an outer coil assembly including:

an outer coil including:

an outer metal foil; and an outer electrical insulator sheet spirally co-wound with the outer metal foil; and third and fourth terminals;

wherein:

the outer coil defines an outer coil air core;

the inner coil is disposed within the outer coil air core so that the outer coil circumferentially surrounds the inner coil;

the first terminal is electrically connected to the inner metal foil at a first location, the second terminal is electrically connected to the inner metal foil at a second location, and the first and second locations are spaced apart along the inner metal foil; and the third terminal is electrically connected to the outer metal foil at a third location, the fourth terminal is electrically connected to the outer metal foil at a fourth location, and the third and fourth locations are spaced apart along the outer metal foil.

26. A method for using a dual coil inductor assembly, the method comprising:

providing a dual coil inductor assembly including:

an inner coil assembly including:

an inner coil including:

an inner metal foil; and an inner electrical insulator sheet spirally co-wound with the inner metal foil; and first and second terminals;

an outer coil assembly including:

an outer coil including:

an outer metal foil; and an outer electrical insulator sheet spirally co-wound with the outer metal foil; and third and fourth terminals;

wherein:

the outer coil defines an outer coil air core;

the inner coil is disposed within the outer coil air core so that the outer coil circumferentially surrounds the inner coil;

the first terminal is electrically connected to the inner metal foil at a first location, the second terminal is electrically connected to the inner metal foil at a second location, and the first and second locations are spaced apart along the inner metal foil; and the third terminal is electrically connected to the outer metal foil at a third location, the fourth terminal is electrically connected to the outer metal foil at a fourth location, and the third and fourth locations are spaced apart along the outer metal foil;

connecting the dual coil inductor assembly to first and second lines of an AC electrical system, including:

electrically connecting an input of the first line to the first terminal;

electrically connecting an output of the first line to the second terminal;

electrically connecting an input of the second line to the third terminal; and electrically connecting an output of the second line to the fourth.

27. The dual coil inductor assembly of claim 25 wherein the dual coil inductor assembly includes:

a first terminal bus bar including the first terminal and secured to an innermost winding of the inner metal foil;

a second terminal bus bar including the second terminal and secured to an outermost winding of the inner metal foil;

a third terminal bus bar including the third terminal and secured to an innermost winding of the outer metal foil; and a fourth terminal bus bar including the fourth terminal and secured to an outermost winding of the outer metal foil.

28. The dual coil inductor assembly of claim 27 including a clamp plate and a fastener mechanically securing one of the first and second terminal bus bars in electrical contact with the inner metal foil.

29. The dual coil inductor assembly of claim 25 wherein:

the inner metal foil and the inner electrical insulator sheet are not bonded to one another across their widths; and the outer metal foil and the outer electrical insulator sheet are not bonded to one another across their widths.

30. The method of claim 26 wherein the first line is a phase line and the second line is a neutral line.

31. The method of claim 26 wherein the first line is a first phase line and the second line is a second phase line.

* * * * *